US012538938B2

(12) United States Patent
Swager et al.

(10) Patent No.: US 12,538,938 B2
(45) Date of Patent: Feb. 3, 2026

(54) MATERIALS FOR EXTRACTING TOXINS FROM TOBACCO

(71) Applicant: Massachusetts Institute of Technology, Cambridge, MA (US)

(72) Inventors: Timothy Manning Swager, Newton, MA (US); Ruqiang Lu, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 637 days.

(21) Appl. No.: 17/981,233

(22) Filed: Nov. 4, 2022

(65) Prior Publication Data

US 2024/0164432 A1 May 23, 2024

(51) Int. Cl.
*A24B 15/18* (2006.01)
*A24B 15/28* (2006.01)
*A24B 15/30* (2006.01)

(52) U.S. Cl.
CPC ..... *A24B 15/183* (2013.01); *A24B 15/286* (2013.01); *A24B 15/301* (2013.01)

(58) Field of Classification Search
CPC ... A24B 15/183; A24B 15/286; A24B 15/301; A24B 15/307; A24D 3/06
See application file for complete search history.

(56) References Cited

U.S. PATENT DOCUMENTS 5,286,887 A * 2/1994 Traylor ..... C08G 73/0672 528/402
2015/0005464 A1* 1/2015 Vail ..... C08G 79/00 526/241
2015/0073122 A1* 3/2015 Seo ..... C07K 14/795 530/328

FOREIGN PATENT DOCUMENTS

KR 20070056746 A * 6/2007 ..... C08J 5/22

OTHER PUBLICATIONS

Machine translation of Choi et al (Year: 2007).*
Chiang et al., Metabolic effects of CYP2A6 and CYP2A13 on 4-(methylnitrosamino)-1-(3-pyridyl)-1-butanone (NNK)-induced gene mutation—a mammalian cell-based mutagenesis approach. Toxicol Appl Pharmacol. Jun. 1, 2011;253(2):145-52. doi: 10.1016/j.taap.2011.03.022. Epub Apr. 4, 2011.
García-Zubiri et al., Sorption models in cyclodextrin polymers: Langmuir, Freundlich, and a dual-mode approach. J Colloid Interface Sci. Sep. 1, 2009;337(1):11-8. doi: 10.1016/j.jcis.2009.04.071. Epub May 6, 2009.
Ge et al., Tobacco carcinogen NNK-induced lung cancer animal models and associated carcinogenic mechanisms. Acta Biochim Biophys Sin (Shanghai). Jul. 2015;47(7):477-87. doi: 10.1093/abbs/gmv041. Epub Jun. 3, 2015.
Hecht et al., Exposure and Metabolic Activation Biomarkers of Carcinogenic Tobacco-Specific Nitrosamines. Acc Chem Res. Jan. 19, 2016;49(1):106-14. doi: 10.1021/acs.accounts.5b00472. Epub Dec. 17, 2015.
Hecht et al., Tobacco carcinogens, their biomarkers and tobacco-induced cancer. Nat Rev Cancer. Oct. 2003;3(10):733-44. doi: 10.1038/nrc1190. Erratum in: Nat Rev Cancer. Jan. 2004;4(1):84.

(Continued)

*Primary Examiner* — Brian A Mccaig
(74) *Attorney, Agent, or Firm* — Wolf, Greenfield & Sacks, P.C.

(57) ABSTRACT

Compositions configured to interact with organic molecules, and related articles and methods, are generally described.

28 Claims, 34 Drawing Sheets

(56) References Cited

OTHER PUBLICATIONS

Hecht et al., Tobacco-specific nitrosamines, an important group of carcinogens in tobacco and tobacco smoke. Carcinogenesis. Jun. 1988;9(6):875-84. doi: 10.1093/carcin/9.6.875.
Hecht SS., Biochemistry, biology, and carcinogenicity of tobacco-specific N-nitrosamines. Chem Res Toxicol. Jun. 1998;11(6):559-603. doi: 10.1021/tx980005y.
Law et al., Tobacco, Microbes, and Carcinogens: Correlation Between Tobacco Cure Conditions, Tobacco-Specific Nitrosamine Content, and Cured Leaf Microbial Community. Microb Ecol. Jul. 2016;72(1):120-129. doi: 10.1007/s00248-016-0754-4. Epub Mar. 29, 2016.
Lu et al., Metallocalix [4]arene Polymers for Gravimetric Detection of N-Nitrosodialkylamines. J Am Chem Soc. Dec. 1, 2021;143(47):19809-19815. doi: 10.1021/jacs.1c08739. Epub Nov. 18, 2021.
Lu et al., Porous Polymers Containing Metallocalix[4]arene for the Extraction of Tobacco-Specific Nitrosamines. Chem Mater. Dec. 13, 2022;34(23):10623-10630. doi: 10.1021/acs.chemmater.2c02713. Epub Nov. 18, 2022.
Luo et al., Simultaneous determination of polycyclic aromatic hydrocarbons and tobacco-specific N-nitrosamines in mainstream cigarette smoke using in-pipette-tip solid-phase extraction and on-line gel permeation chromatography—gas chromatography—tandem mass spectrometry. J Chromatogr A. Aug. 19, 2016;1460:16-23. doi: 10.1016/j.chroma.2016.07.018. Epub Jul. 8, 2016.
Luo et al., Solid-phase extraction of tobacco-specific N-nitrosamines with a mixed-mode hydrophobic/cation-exchange sorbent. Sep Sci Plus Apr. 3, 2018;1(4):288-95. doi: 10.1002/sscp.201700049.
Mckeown et al., Polymers of intrinsic microporosity (PIMs): organic materials for membrane separations, heterogeneous catalysis and hydrogen storage. Chem Soc Rev. Aug. 2006;35(8):675-83. doi: 10.1039/b600349d. Epub Mar. 17, 2006.
Pang et al., Magnetic solid-phase extraction of tobacco-specific N-nitrosamines using magnetic graphene composite as sorbent. J Sep Sci. Oct. 2019;42(19):3119-3125. doi: 10.1002/jssc.201900438. Epub Aug. 12, 2019.
Shi et al., A pillar[5]arene-based 3D network polymer for rapid removal of organic micropollutants from water. J. Mater. Chem. A Nov. 2017;5(46):24217-24222. doi: 10.1039/C7TA08894A.
Shi et al., Changes in TSNA contents during tobacco storage and the effect of temperature and nitrate level on TSNA formation. J Agric Food Chem. Nov. 27, 2013;61(47):11588-94. doi: 10.1021/jf404813m. Epub Nov. 18, 2013.
Shi et al., Efficiently capturing tobacco specific nitrosamines with Hβ zeolite in solution. J Hazard Mater. Mar. 5, 2019;365:196-204. doi: 10.1016/j.jhazmat.2018.10.095. Epub Nov. 1, 2018.
Spiegelhalder et al., Tobacco-specific nitrosamines. Eur J Cancer Prev. Sep. 1996;5 Suppl 1:33-8.
Sun et al., Porous polymer catalysts with hierarchical structures. Chem Soc Rev. Oct. 7, 2015;44(17):6018-34. doi: 10.1039/c5cs00198f. Author manuscript, 38 pages.
Takahashi et al., Tobacco smoke promotes lung tumorigenesis by triggering IKKbeta- and JNK1-dependent inflammation. Cancer Cell. Jan. 19, 2010;17(1):89-97. doi: 10.1016/j.ccr.2009.12.008.
Tan et al., Hypercrosslinked porous polymer materials: design, synthesis, and applications. Chem Soc Rev. Jun. 6, 2017;46(11):3322-3356. doi: 10.1039/c6cs00851h. Erratum in: Chem Soc Rev. Jun. 6, 2017;46(11):3481. doi: 10.1039/c7cs90027a.
Wang et al., SPE-HPLC-MS/MS method for the trace analysis of tobacco-specific N-nitrosamines and 4-(methylnitrosamino)-1-(3-pyridyl)-1-butanol in rabbit plasma using tetraazacalix[2]arene[2]triazine-modified silica as a sorbent. J Sep Sci. Aug. 2013;36(16):2664-71. doi: 10.1002/jssc.201300219. Epub Jul. 17, 2013.
Xu et al., Adsorption of tobacco-specific nitrosamine 4-(methylnitrosamino)-1-(3-pyridyl)-1-butanone from aqueous solution with graphene aerogel. IOP Conf. Ser.: Mater. Sci. Eng. 2018;324:012028. doi: 10.1088/1757-899X/324/1/012028.
Yang et al., Effective and Rapid Removal of Polar Organic Micropollutants from Water by Amide Naphthotube-Crosslinked Polymers. Angew Chem Int Ed Engl. Sep. 20, 2021;60(39):21404-21411. doi: 10.1002/anie.202106998. Epub Aug. 20, 2021.
Zhao et al., Functionalized Metalated Cavitands via Imidation and Late-Stage Elaboration. European J Org Chem. Jul. 1, 2015;2015(21):4593-4597. doi: 10.1002/ejoc.201500714. Epub Jun. 24, 2015.
Zhao et al., Porous Organic Polymers via Ring Opening Metathesis Polymerization. ACS Macro Lett. Mar. 20, 2018;7(3):300-304. doi: 10.1021/acsmacrolett.8b00041. Epub Feb. 15, 2018.
Zheng et al., Preparation of hollow porous molecularly imprinted polymers for N-nitrosamine adsorption. Mater. Lett. Jan. 2018;211:21-23. doi: 10.1016/j.matlet.2017.09.047.

* cited by examiner

NNK-trans

Relative energy:
0 kcal/mol

NNK-cis 0.073 kcal/mol

Binding energy: -32.0 kcal/mol

-31.0 kcal/mol

MATERIALS FOR EXTRACTING TOXINS FROM TOBACCO

TECHNICAL FIELD

Compositions configured to interact with organic molecules, and related articles and methods, are generally described.

BACKGROUND

About 8 million people die from tobacco use each year, and smoking related cancers are one of the main causes of death. Tobacco-specific nitrosamines (TSNAs) have been identified as carcinogenic species present in tobacco products. TSNAs are formed during the growth, curing, storage, and processing of tobacco leaves. The determination of the concentration of TSNAs during the post-harvest period of tobacco can be used for quality control of tobacco products. A common method of determining the concentration of TSNAs is based on LC/GC-MS/MS along with pre-concentration steps. The pre-concentration of TSNAs using an adsorbent is important for samples with a complex matrix and/or low concentration of TSNAs. Moreover, the adsorbent for TSNAs can also be used to extract TSNAs from tobacco waste to reduce the disposal of carcinogenic species into the environment.

Over the past decades, several conventional adsorbents for TSNAs have been developed based on inorganic porous compounds, graphene aerogels, and imprinted polymers. However, the removal efficiencies of these conventional adsorbents for TSNAs are low. More efficient and selective adsorbents for TSNAs are therefore desired.

SUMMARY

Compositions configured to interact with organic molecules, and related articles and methods, are generally described. The subject matter of the present invention involves, in some cases, interrelated products, alternative solutions to a particular problem, and/or a plurality of different uses of one or more systems and/or articles.

According to certain embodiments, a composition is described, the composition comprising a polymer comprising a first component and a second component, wherein the first component and the second component are different, and wherein the first component comprises a selector configured to interact with an organic molecule. In some embodiments, the polymer comprises the first component in amount of at least 15 weight percent (wt. %) versus the total weight of the polymer and the second component in an amount of at least 50 wt. % versus the total weight of the polymer.

According to some embodiments, an article is described, the article comprising a substrate and a composition disposed on the substrate, wherein the composition comprises a polymer comprising a first component and a second component, wherein the first component and the second component are different, and wherein the first component comprises a selector configured to interact with an organic molecule. In certain embodiments, an adsorption capacity of the composition towards the organic molecule is at least 200 mg of the organic molecule per gram of the polymer.

In certain embodiments, a method of extracting an organic molecule is described the method comprising: providing a composition comprising a polymer, wherein the polymer comprises a first component and a second component, wherein the first component and the second component are different, and wherein the first component comprises a selector configured to interact with an organic molecule; and exposing the composition to the organic molecule such that the composition interacts with the organic molecule with an adsorption capacity of at least 200 mg of the organic molecule per gram of the polymer.

Other advantages and novel features of the present disclosure will become apparent from the following detailed description of various non-limiting embodiments of the disclosure when considered in conjunction with the accompanying figures. In cases where the present specification and a document incorporated by reference include conflicting and/or inconsistent disclosure, the present specification shall control.

BRIEF DESCRIPTION OF THE DRAWINGS

Non-limiting embodiments of the present disclosure will be described by way of example with reference to the accompanying figures, which are schematic and are not intended to be drawn to scale unless otherwise indicated. In the figures, each identical or nearly identical component illustrated is typically represented by a single numeral. For purposes of clarity, not every component is labeled in every figure, nor is every component of each embodiment of the disclosure shown where illustration is not necessary to allow those of ordinary skill in the art to understand the disclosure. In the figures.

DETAILED DESCRIPTION

Tobacco-specific nitrosamines (TSNAs), including 4-(methylnitrosamino)-1-(3-pyridyl)-1-butanone (nicotine-derived nitrosamine ketone, NNK), N'-nitrosonomicotine (NNN), N'-nitrosoanatabine (NAT), and N'-nitrosoanabasine (NAB), have been identified as carcinogenic species. Among them, NNK and NNN show the highest carcinogenicity and are classified as group 1 carcinogens (carcinogenic to humans) by the International Agency for Research on Cancer (IARC).

Although conventional adsorbents for TSNAs have been developed based on inorganic porous compounds, graphene aerogels, and imprinted polymers, the removal efficiencies for TSNAs using such conventional adsorbents are low (e.g., the maximum adsorption capacity for NNK is usually lower than 70 mg/g). Porous organic polymers (POPs) have been used in extraction of micropollutants, gas separation and storage, sensors, and heterogeneous catalysis due to their high free volume. POPs can be roughly classified as either extrinsically porous (porosity coming from insufficient packing) or intrinsically porous (porosity coming from the molecular constituents such as cavities and voids). One-dimensional linear intrinsically POPs, such as spirobisindane-based polymers of intrinsic microporosity (PIMs) and triptycene-based poly(arylene ether)s, which do not require three-dimensional (3D) covalent bond networks to create porosity, feature straightforward solution processability and facially adjustable chemical compositions and porosity.

As adsorbents, however, POPs are relatively non-specific for guest molecules, and adsorption is primarily determined by molecular size. The Inventors have realized that the incorporation of predesigned selector (e.g., receptor) elements into porous polymers can make them more specific towards targeting species. Additionally, the Inventors have realized that a high-porosity polymer ensures sufficient interaction between selectors (e.g., receptors) and guest molecules not only at the solvent-polymer interface, but also throughout the bulk of the material, which provides more efficient materials for adsorption of specific target analytes.

Figure 5:
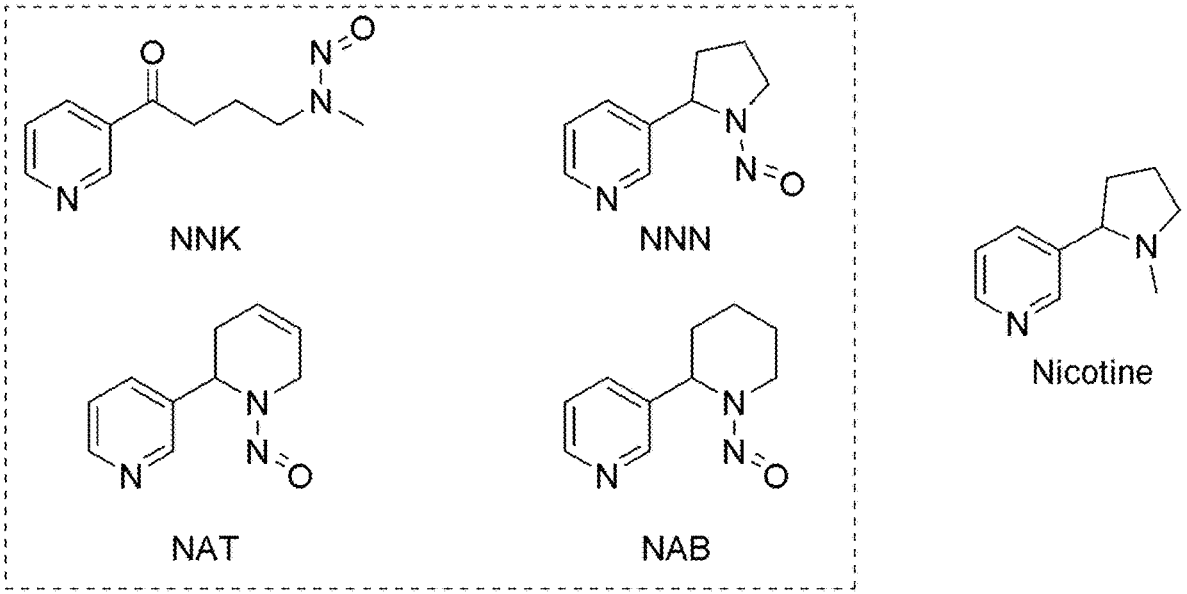
FIG. 5 shows, according to certain embodiments, structures of four representative tobacco-specific nitrosamines (TSNAs) (left) and nicotine (right)

In certain embodiments, a composition is described, wherein the composition comprises a first component and a second component. According to some embodiments, the first component and the second component are different. The first component may, in some embodiments, comprise a monomer. The first component (e.g., monomer) may, in some embodiments, comprise a selector (e.g., receptor) configured to interact with one or more target organic molecules. In certain embodiments, the second component comprises a macromonomer (e.g., an oligomer comprising one or more end-groups). The second component (e.g., macromonomer) may be configured, in certain embodiments, to provide the polymer with an overall porosity (e.g., BET surface area) sufficient to host the target organic molecules such that the composition adsorbs the target organic molecule. The weight percentages of each component in the polymer versus the total weight of the polymer may advantageously be tuned to provide a sufficient amount of selectors (e.g., receptors) while also affording a porosity of the polymer structure that enables the ability to host guest molecules throughout the bulk of the material, Configuring the polymer in this way advantageously allows the polymer to be modified such that the polymer is selective towards adsorbing one or more specific target organic molecules of interest while excluding non-target organic species, even when the concentration of the one or more specific target organic molecules in the extraction solution is comparatively less than the non-target organic species. In certain embodiments, for example, the specific target organic molecules include any of the nitrosamines shown in FIG. 5, such as NNK, NNN, NAT, and/or NAB. Furthermore, the polymer may advantageously by synthesized in a straightforward and scalable manner, therefore enabling processability and industrial implementation.

According to some embodiments, an article is described, the article comprising a substrate and a composition disposed on the substrate, wherein the composition comprises a polymer comprising a first component and a second component, as described above. The substrate may, in some embodiments, comprise a particle (e.g., a nanoparticle, a microparticle), a film, and/or filter. Configuring the article in this way advantageously facilitates the dispersibility of the composition in solution and/or provides the ability to expose the composition to an extraction solution comprising one or more target organic molecules in a high-throughput fashion such that the composition interacts with the one or more target molecules. For example, in some embodiments wherein the article comprises a substrate comprising a particle, a plurality of articles may be dispersed in a solution comprising one or more target molecules. In other embodiments wherein the article comprises a substrate comprising a particle, the solution comprising one or more target organic molecules may be flowed through a tube and/or column comprising a plurality of articles. In yet other embodiments wherein the article comprises a substrate comprising a film and/or filter, the solution comprising one or more target organic molecules may be flowed over the film and/or through the filter.

According to some embodiments, a method of extracting an organic molecule (e.g., from a mixture of organic species) is described. In certain embodiments, for example, the method comprises providing a composition (or an article comprising the composition), wherein the composition comprises a polymer comprising a first component and a second component, as described above. In some embodiments, the method comprises exposing the composition (or the article comprising the composition) to the organic molecule such that the composition interacts with the organic molecule. In certain embodiments, the composition may have an advantageously high adsorption capacity as compared to conventional adsorbents. For example, in some embodiments, the composition has an adsorption capacity of at least 200 mg of the organic molecule per gram of the polymer. The method may, in certain embodiments, further comprise desorbing the organic molecule from the composition, by, for example, exposing the composition that has adsorbed the organic molecule to a regenerating species. Desorbing the organic molecule from the composition advantageously provides the ability to reuse the composition for additional extractions of target molecules.

According to certain embodiments, a polymer comprises a first component and a second component. As used herein, the term "component" may refer to a monomer, a macromonomer, and/or an oligomer, as will be explained in further detail. In some embodiments, the first component and the second component are different.

In certain embodiments, the first component comprises a monomer. According to some embodiments, the first component (e.g., monomer) comprises a selector (e.g., a receptor or related construction) configured to interact with one or more organic molecules. The term "selector", as presented in the context of this disclosure, will be clearly understood by those or ordinary skill in the art. As one example, a selector refers to a moiety that will preferentially and/or selectively interact with (e.g., bind to) one or more target molecules (e.g., one or more target organic molecules) to carry out the purposes described herein, for example, to adsorb the one or more target molecules. Suitable interactions between the selector and the one or more organic molecules are described herein in greater detail.

In certain embodiments, the first component (e.g., monomer) comprises a macrocycle. According to certain embodiments and as will be explained herein in greater detail, the macrocycle may advantageously provide the polymer with one or more pores and/or cavities that create a free volume to, for example, host guest molecules. Any of a variety of suitable macrocycles may be employed. In some embodiments, for example, the first component comprises a calixarene moiety (e.g., a calix[4]arene moiety), salts thereof, and/or derivatives thereof. The first component may, in some embodiments, comprise a cyclodextrin, cyclophane, cavitand, pillarene, porphyrin, crown ether, salts thereof, and/or derivatives thereof. Other macrocycles are also possible.

According to some non-limiting embodiments, the first component comprises the calixarene moiety shown below in structure I(A).

(I(A))

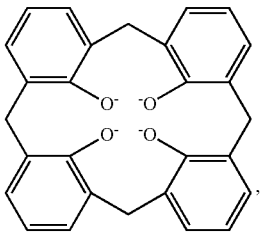

wherein:

one or more positions of one or more phenyl rings of the calixarene moiety may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide, a halogen, and/or a haloalkane, and one or more positions of one or more alkyl groups of the calixarene moiety may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide, a halogen, and/or a haloalkane.

According to some embodiments, the macrocycle may be a macrocyclic ligand associated with (e.g., bound to), for example, a metal center. In some embodiments, for example, the first component (e.g., monomer) comprises a metallocalixarene moiety (e.g., a metallocalix[4]arene moiety), salts thereof and/or derivatives thereof. The first component may, in some embodiments, comprise a cyclodextrin, cyclophane, cavitand, pillarene, porphyrin, crown ether, salt thereof, and/or derivative thereof associated with (e.g., bound to) a metal center.

Any of a variety of suitable metals may be employed. In some embodiments, for example, the metal comprises tungsten (W) and/or molybdenum (Mo). Other metals are also possible. Suitable metallocalixarene metallocalix[4]arene) moieties include, for example, a calix[4]arene tungsten moiety and/or a calix[4]arene molybdenum moiety.

In certain embodiments, the selector (e.g., a receptor) of the first component (e.g., monomer) configured to interact with one or more organic molecules may comprise the metal. According to some embodiments, for example, the metal (e.g., tungsten, molybdenum) associated with (e.g., bound to) the macrocyclic ligand may be configured to interact with one or more organic molecules. The selector (e.g., receptor), in certain embodiments, may include a metal-based selector produced by binding a Lewis acidic metal to one or more nitrogen-containing moieties, phosphorus-containing moieties, or ionic sites of the first component. Suitable interactions between the selector and one or more organic molecules are explained herein in further detail.

In some non-limiting embodiments, the first component comprises the metallocalixarene moiety shown below in structure I(B).

(I(B))

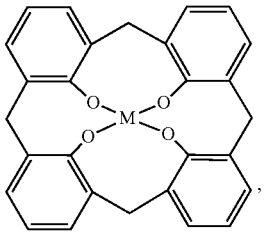

wherein:

M is a metal, one or more positions of one or more phenyl rings of the calixarene moiety may be optionally substituted, for example, with —$C_1$-$C_{10}$ alkyl, —$C_2$-$C_{10}$ alkenyl, —$C_3$-$C_{10}$ alkenyl, one or more optionally substituted cyclic hydrocarbons (e.g., phenyl groups), an alkoxide, a halogen, and/or a haloalkane, and one or more positions of one or more alkyl groups of the calixarene moiety may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide, a halogen, and/or a haloalkane.

According to some embodiments, the first component (e.g., monomer) comprises a transition metal-imido complex (e.g., a coordination compound comprising an imido ligand), salts thereof, and/or derivatives thereof.

According to certain embodiments, the imido ligand may comprise one or more reactive moieties (e.g., one or more first component reactive moieties) that are configured to react with one or more moieties of another first component (e.g., monomer) to provide a repeating unit of the first component (e.g., a polymer of the first component). In some embodiments, the imido ligand comprises one or more reactive moieties (e.g., one or more first component reactive moieties) that are configured to react with the second component (e.g., macromonomer) to provide the polymer. According to some embodiments, the one or more first component reactive moieties may react (e.g., with one or more moieties of another first component, with the second component) via ring-opening metathesis polymerization, although other reaction mechanisms are also possible as the disclosure is not meant to be limiting in this regard, such as, for example, radical (e.g., free-radical) polymerization.

Any of a variety of suitable first component reactive moieties may be employed. In certain embodiments, for example, the imido ligand comprises a reactive moiety comprising a cyclic hydrocarbon. In some embodiments, for example, the imido ligand comprises a reactive moiety comprising norbornene, which may be optionally substituted. The imido ligand may, in some embodiments, comprise a reactive moiety comprising an alkene (e.g., a terminal alkene) optionally substituted with one or more functional groups that promote radical (e.g., free-radical) polymerization. Other reactive moieties are also possible.

In certain non-limiting embodiments, the first component comprises the transition metal-imido complex shown below in structure I(C).

(I(C))

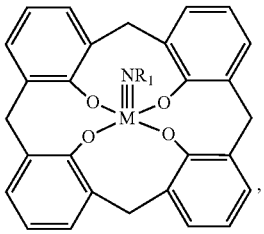

wherein:

M is a metal, $R^1$ comprises hydrogen, an optionally substituted cyclic hydrocarbon (e.g., phenyl group), —$C_1$-$C_{10}$ to alkyl, —$C_2$-$C_{10}$ alkenyl, —$C_3$-$C_{10}$ alkynyl, an alkoxide, a halogen, and/or a haloalkane, one or more positions of one or more phenyl rings of the calixarene moiety may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide, a halogen, and/or a haloalkane, and one or more positions of one or more alkyl groups of the calixarene moiety may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide, a halogen, and/or a haloalkane.

According to some non-limiting embodiments, the first component comprises the complex shown below in structure I(D).

(I(D))

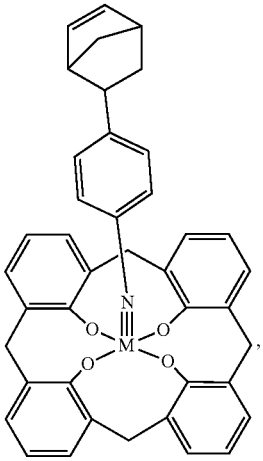

wherein:

M is a metal, one or more positions of one or more phenyl rings of the first component may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide, a halogen, and/or a haloalkane, and one or more positions of one or more alkyl groups and/or cycloalkyl groups of the first component may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide, a halogen, and/or a haloalkane.

In some non-limiting embodiments wherein the first component comprises the structure shown in structure I(D), the norbornene moiety (e.g., first component reactive moiety) is configured to react with one or more moieties of another first component to provide a repeating unit of the first component (e.g., a polymer of the first component) via, for example, ring-opening metathesis polymerization. In certain non-limiting embodiments wherein the first component comprises the structure shown in structure I(D), the norbornene moiety (e.g., first component reactive moiety) is configured to react with the second component to provide the polymer via, for example, ring-opening metathesis polymerization.

As would generally be understood by a person of ordinary skill in the art, the polymer may comprise a derivative of the structure shown in structure I(D) wherein one or more reactive moieties of the first component have reacted with one or more reactive moieties of another first component (e.g., to provide a polymer of the first component) and/or one or more reactive moieties of the second component (e.g., to provide the polymer).

In some embodiments, for example, the first component comprises the complex shown below in structure I(E).

(I(E))

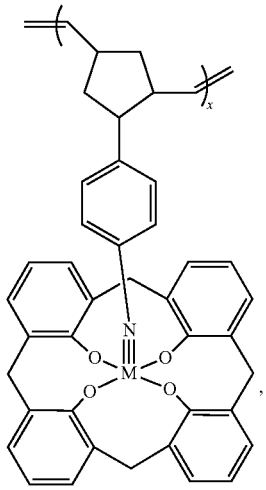

wherein:

M is a metal, one or more positions of one or more phenyl rings of the first component may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide, a halogen, and/or a haloalkane, one or more positions of one or more alkyl groups and/or cycloalkyl groups of the first component may be optionally substituted, fir example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide, a halogen, and/or a haloalkane, and x is between greater than or equal to 1 and less than or equal to 100.

According to certain embodiments, the first component (e.g., monomer) may be synthesized by procedures that would be known to a person of ordinary skill in the art. In other embodiments, the first component (e.g., monomer) may be purchased commercially.

The polymer may comprise the first component (e.g., monomer) in any of a variety of suitable amounts. In certain embodiments, for example, the polymer comprises the first component in amount of at least 15 weight percent (wt. %), at least 20 wt. %, at least 25 wt. %, at least 30 wt. %, at least 35 wt. %, at least 40 wt. %, or at least 45 wt. % versus the total weight of the polymer. In some embodiments, the polymer comprises the first component in an amount less than or equal to 50 wt. %, less than or equal to 45 wt. %, less than or equal to 40 wt. %, less than or equal to 35 wt. %, less than or equal to 30 wt. %, less than or equal to 25 wt. %, or less than or equal to 20 wt. % versus the total weight of the polymer. Combinations of the above recited ranges are possible (e.g., the polymer comprises the first component in an amount greater than or equal to 15 wt. % and less than or equal to 50 wt. % versus the total weight of the polymer, the polymer comprises the first component in an amount greater than or equal to 30 wt. % and less than or equal to 35 wt. % versus the total weight of the polymer). Other ranges are also possible.

According to certain embodiments wherein the first component comprises a macrocycle that provides the polymer with one or more pores and/or cavities that create a sufficient free volume, the polymer may comprise a comparatively higher amount of the first component than the second component. In some such embodiments, for example, the polymer may comprise the first component in an amount greater than or equal to 50 wt. %, greater than or equal to 60 wt. %, greater than or equal to 70 wt. %, greater than or equal to 80 wt. %, or greater than or equal to 90 wt. % versus the total weight of the polymer. In other embodiments wherein the first component either does not comprise a macrocycle or comprises a macrocycle that does not provide the polymer with one or more pores and/or cavities that create a sufficient free volume, the polymer may comprise a comparatively higher amount of the second component than the first component (e.g., to ensure that the second component provides the polymer with one or more pores and; or cavities that create a sufficient free volume). In some such embodiments, for example, the polymer may comprise the first component in an amount less than or equal to 50 wt. %, less than or equal to 40 wt. %, less than or equal to 30 wt. %, less or equal to 20 wt. %, or less than or equal to 10 wt. % versus the total weight of the polymer.

In some embodiments, the second component comprises a macromonomer. In certain embodiments, for example, the second component comprises an oligomer associated with one or more end-groups. In other embodiments, the second component comprises a monomer. The monomer may comprise, in certain embodiments, one or more end-groups.

According to certain embodiments, the one or more end-groups comprise one or more reactive moieties (e.g., second component reactive moieties) that are configured to react with one or more moieties of another second component (e.g., macromonomer) to provide a repeating unit of the second component (e.g., a polymer of the second component). In some embodiments, the one or more end-groups comprise one or more reactive moieties (e.g., one or more second component reactive moieties) that are configured to react with the first component (e.g., monomer) to provide the polymer. According to some embodiments, the one or more second component reactive moieties may react (e.g., with one or more moieties of another second component, with the first component) via ring-opening metathesis polymerization, although other reaction mechanisms are also possible as the disclosure is not meant to be limiting in this regard, such as, for example, radical (e.g., free-radical) polymerization.

Any of a variety of suitable end-groups may be employed. In certain embodiments, the one or more end-groups comprise a cyclic hydrocarbon. In some embodiments, for example, the one or more end-groups comprise norbornene, benzene, naphthalene, and/or anthracene, any of which may be optionally substituted. The one or more end-groups may, in some embodiments, comprise an alkene (e.g., a terminal Acne) optionally substituted with one or more functional groups that promote radical (e.g., free-radical) polymerization. Other end-groups are also possible.

The second component may comprise, in certain embodiments, a ladder structure. In some embodiments, for example, the second component comprises a backbone that consists of at least two independent polymer strands. In certain embodiments wherein the second component comprises a macromonomer, the second component may comprise an oligomer comprising a backbone that consists of at least two independent polymer strands. The ladder structure may, in certain embodiments, advantageously provide the polymer with one or more pores and/or cavities that create a free volume to, for example, host guest molecules, as will be explained herein in greater detail.

According to some non-limiting embodiments, the second component comprises a ladder structure (e.g., an oligomer comprising a ladder structure) as shown below in structure II(A).

(II(A))

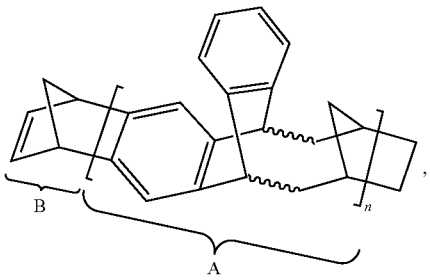

wherein:

A represents the ladder structure (e.g., the oligomer comprising the ladder structure), B represents an end-group (e.g., a second component reactive moiety), one or more positions of one or more phenyl rings of the second component may be optionally substituted, for example, with —$C_1$-$C_{10}$ alkyl, —$C_2$-$C_{10}$ alkenyl, —$C_3$-$C_{10}$ alkenyl, one or more optionally substituted cyclic hydrocarbons (e.g., phenyl groups), an alkoxide (e.g., —$OCH_3$), a halogen, and/or a haloalkane, one or more positions of one or more alkyl groups of the second component may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide (e.g., —$OCH_3$), a halogen, and/or a haloalkane, and n is between greater than or equal to 1 and less than or equal to 100.

According to certain non-limiting embodiments, the second component may comprise a ladder structure (e.g., an oligomer comprising a ladder structure) as shown below in structure II(B).

(II(B))

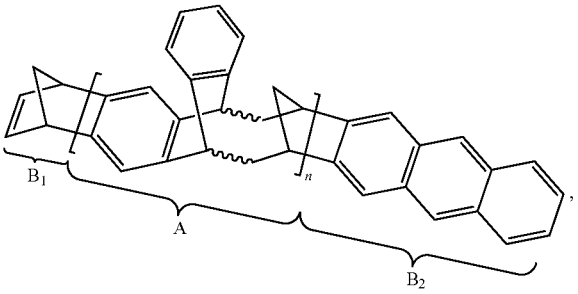

wherein:

A represents the ladder structure (e.g., the oligomer comprising the ladder structure), $B_1$ represents a first end-group (e.g., a second component reactive moiety), $B_2$ represents a second end-group, one or more positions of one or more phenyl rings of the second component may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide (e.g., —$OCH_3$), a halogen, and/or a haloalkane, one or more positions of one or more alkyl groups of the second component may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide (e.g., —$OCH_3$), a halogen, and/or a haloalkane, and n is between greater than or equal to 1 and less than or equal to 100.

In some non-limiting embodiments wherein the second component comprises the structure shown in structures II(A) and/or II(B), the end-group comprising norbornene (e.g., second component reactive moiety) is configured to react with one or more moieties of another second component to provide a repeating unit of the second component (e.g., a polymer of the second component). In certain non-limiting embodiments wherein the second component comprises the structure shown in structures II(A) and/or II(B), the end-group comprising norbornene (e.g., second component reactive moiety) is configured to react with the first component to provide the polymer.

As would generally be understood by a person of ordinary skill in the art, the polymer may comprise a derivative of the structures shown in structure II(A) and/or II(B) wherein one or more reactive moieties of the second component have reacted with one or more reactive moieties of another second component (e.g., to provide a polymer of the second component) and/or one or more reactive moieties of the first component (e.g., to provide the polymer).

According to some embodiments, for example, the second component comprises the structure shown below in structure II(C).

(II(C))

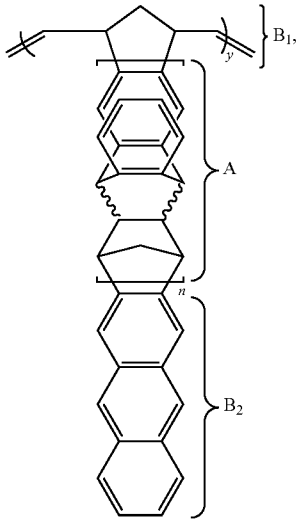

wherein:

A represents the ladder structure e.g., the oligomer comprising the ladder structure), $B_1$ represents a first enol-group (e.g., a second component reactive moiety that has reacted with one or more reactive moieties of another second component and/or one or more reactive moieties of the first component), $B_2$ represents a second end-group, one or more positions of one or more phenyl rings of the second component may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide (e.g., —$OCH_3$), a halogen, and/or a haloalkane, one or more positions of one or more alkyl groups of the second component may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide (e.g., —$OCH_3$), a halogen, and/or a haloalkane, n is between greater than or equal to 1 and less than or equal to 100, and y is between greater than or equal to 1 and less than or equal to 100.

In certain embodiments, the value of "n", i.e., the number of repeating units of the oligomer in the second component (for example, as shown in structures II(A), II(B), and II(C)), may be any of a variety of suitable values. In some embodiments, for example, the value of "n" is greater than or equal to 1, greater than or equal to 5, greater than or equal to 10, greater than or equal to 20, greater than or equal to 30, greater than or equal to 40, greater than or equal to 50, greater than or equal to 60, greater than or equal to 70, greater than or equal to 80, or greater than or equal to 90. In certain embodiments, the value of "n" is less than or equal to 100, less than or equal to 90, less than or equal to 80, less than or equal to 70, less than or equal to 60, less than or equal to 50, less than or equal to 40, less than or equal to 30, less than or equal to 20, less than or equal to 5, or less than or equal to 10. Combinations of the above recited ranges are possible (e.g., the value of "n" is greater than or equal to 1 and less than or equal to 100, the value of "n" is greater than or equal to 5 and less than or equal to 10). Other ranges are also possible.

According to certain embodiments, the second component may be synthesized by procedures that would be known to a person of ordinary skill in the art. In other embodiments, the second component may be purchased commercially.

The polymer may comprise the second component in any of a variety of suitable amounts. In certain embodiments, for example, the polymer comprises the second component in amount of al least 50 wt. %, at least 55 wt. %, at least 60 wt. %, at least 65 wt. %, at least 70 wt. %, at least 75 wt. %, or at least 80 wt. % versus the total weight of the polymer. In some embodiments, the polymer comprises the second component in an amount less than or equal to 85 wt. %, less than or equal to 80 wt. %, less than or equal to 75 wt. %, less than or equal to 70 wt. %, less than or equal to 65 wt. %, less than or equal to 60 wt. %, or less than or equal to 55 wt. % versus the total weight of the polymer. Combinations of the above recited ranges are possible (e.g., the polymer comprises the second component in an amount greater than or equal to 50 wt. % and less than or equal to 85 wt. % versus the total weight of the polymer, the polymer comprises the second component in an amount greater than or equal to 65 wt. % and less than or equal to 70 wt. % versus the total weight of the polymer). Other ranges are also possible.

According to certain embodiments wherein the polymer comprises a first component that either does not comprise a macrocycle or comprises a macrocycle that does provide the polymer with one or more pores and/or cavities that create a sufficient free volume, the polymer may comprise a comparatively higher amount of the second component than the first component (e.g., to ensure that the second component provides the polymer with one or more pores and/or cavities that create a sufficient free volume). In some such embodiments, for example, the polymer may comprise the second polymer in an amount greater than or equal to 50 wt. %, greater than or equal to 60 wt. %, greater than or equal to 70 wt. %, greater than or equal to 80 wt. %, or greater than or equal to 90 wt. % versus the total weight of the polymer. In some embodiments wherein the polymer comprises a first component that comprises a macrocycle that provides the polymer with one or more pores and/or cavities that create a sufficient free volume, the polymer may comprise a comparatively lesser amount of the second component than the first component. In some such embodiments, for example, the polymer may comprise the second component in an amount less than or equal to 50 wt. %, less than or equal to 40 wt. %, less than or equal to 30 wt. %, less than or equal to 20 wt. %, or less than or equal to 10 wt. % versus the total weight of the polymer.

In certain embodiments, the polymer comprises a polymer of the first component and the second component. In some embodiments, the polymer comprises one or more repeating units of the first component. In certain embodiments, the polymer comprises one or more repealing units of the second component. In some embodiments, the polymer comprises one or more repeating units of the first component and one or more repeating units of the second component. In certain embodiment, the polymer comprises one or more repeating units of alternating units of the first component and the second component.

According to some non-limiting embodiments, for example, the polymer comprises the structure shown below in structure III(A).

(III(A))

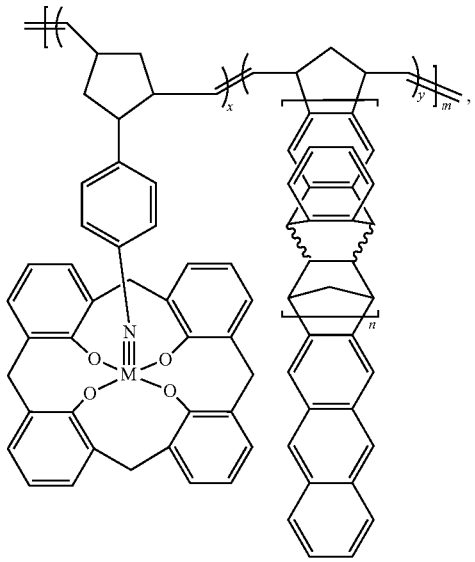

wherein:

M is a metal, one or more positions of one or more phenyl rings of the polymer may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide, a halogen, and/or a haloalkane, one or more positions of one or more alkyl groups and/or cycloalkyl groups of the polymer may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide, a halogen, and/or a haloalkane, x is between greater than or equal to 1 and less than or equal to 100, n is between greater than or equal to 1 and less than or equal to 100, y is between greater than or equal to 1 and less than or equal to 100, and m is between greater than or equal to 1 and less than or equal to 100.

According to certain non-limiting embodiments, the polymer comprises the structure shown in structure III(B).

(III(B))

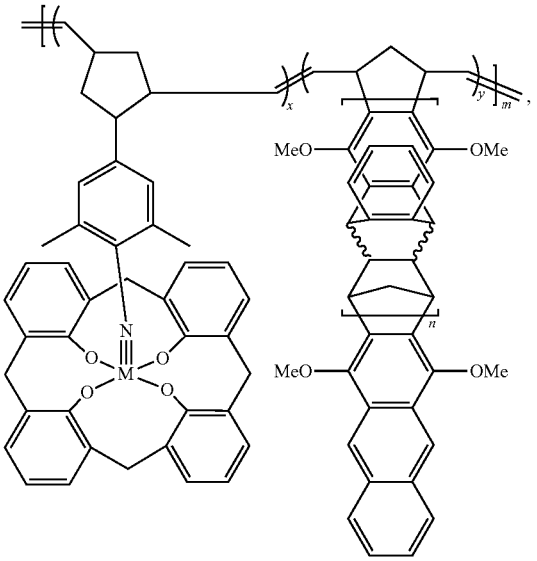

wherein:

M is a metal, one or more positions of one or more phenyl rings of the polymer may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide, a halogen, and/or a haloalkane, one or more positions of one or more alkyl groups and/or cycloalkyl groups of the polymer may be optionally substituted, for example, with —$C_1$-$C_{10}$ alkyl, —$C_2$-$C_{10}$ alkenyl, —$C_3$-$C_{10}$ alkynyl, one or more optionally substituted cyclic hydrocarbons (e.g., phenyl groups), an alkoxide, a halogen, and/or a haloalkane, x is between greater than or equal to 1 and less than or equal to 100, n is between greater than or equal to 1 and less than or equal to 100, y is between greater than or equal to 1 and less than or equal to 100, and m is between greater than or equal to 1 and less than or equal to 100.

In some embodiments, the value of "x", i.e., the number of repeating units of the first component in the polymer (for example, as shown in structures III(A) and/or III(B)), may be any of a variety of suitable values. In some embodiments, for example, the value of "x" is greater than or equal to 1, greater than or equal to 10, greater than or equal to 20, greater than or equal to 30, greater than or equal to 40, greater than or equal to 50, greater than or equal to 60, greater than or equal to 70, greater than or equal to 80, or greater than or equal to 90. In certain embodiments, the value of "x" is less than or equal to 100, less than or equal to 90, less than or equal to 80, less than or equal to 70, less than or equal to 60, less than or equal to 50, less than or equal to 40, less than or equal to 30, less than or equal to 20, or less than or equal to 10. Combinations of the above recited ranges are possible (e.g., the value of "x" is greater than or equal to 1 and less than or equal to 100, the value of "x" is greater than or equal to 40 and less than or equal to 60). Other ranges are also possible.

In some embodiments, the value of "y", i.e., the number of repeating units of the second component in the polymer (for example, as shown in structures III(A) and/or III(B)), may be any of a variety of suitable values. In some embodiments, for example, the value of "y" is greater than or equal to 1, greater than or equal to 10, greater than or equal to 20, greater than or equal to 30, greater than or equal to 40, greater than or equal to 50, greater than or equal to 60, greater than or equal to 70, greater than or equal to 80, or greater than or equal to 90. In certain embodiments, the value of "y" is less than or equal to 100, less than or equal to 90, less than or equal to 80, less than or equal to 70, less than or equal to 60, less than or equal to 50, less than or equal to 40, less than or equal to 30, less than or equal to 20, or less than or equal to 10. Combinations of the above recited ranges are possible (e.g., the value of "y" is greater than or equal to 1 and less than or equal to 100, the value of "y" is greater than or equal to 40 and less than or equal to 60). Other ranges are also possible.

In some embodiments, the value of "m", i.e., the number of repeating units of the polymer (for example, as shown in structures III(A) and/or III(B)), may be any of a variety of suitable values. In some embodiments, for example, the value of "m" is greater than or equal to 1, greater than or equal to 10, greater than or equal to 20, greater than or equal to 30, greater than or equal to 40, greater than or equal to 50, greater than or equal to 60, greater than or equal to 70, greater than or equal to 80, or greater than or equal to 90. In certain embodiments, the value of "m" is less than or equal to 100, less than or equal to 90, less than or equal to 80, less than or equal to 70, less than or equal to 60, less than or equal to 50, less than or equal to 40, less than or equal to 30, less than or equal to 20, or less than or equal to 10. Combinations of the above recited ranges are possible (e.g., the value of "m" is greater than or equal to 1 and less than or equal to 100, the value of "m" is greater than or equal to 40 and less than or equal to 60). Other ranges are also possible.

According to certain embodiments, the polymer may be synthesized by any of a variety of suitable methods. In some embodiments, the synthesis of the polymer is an advantageously straightforward and scalable reaction. In certain embodiments, for example, the first component (e.g., monomer) and the second component (e.g., macromonomer) may be provided together in an organic solvent (e.g., dissolved in an organic solvent) and reacted (e.g., polymerized) overnight at room temperature in the presence of a catalyst Suitable organic reaction solvents include, for example, dichloromethane, although other organic reaction solvents are also possible. Suitable catalysts include, for example, the third generation Grubbs catalyst, although other catalysts are also possible. In certain embodiments, the polymer may be synthesized in an inert atmosphere (e.g., in a $N_2$ glovebox). According to some embodiments, the polymer may be synthesized via a ring-opening metathesis polymerization reaction between the first component (e.g., monomer) and the second component (e.g., macromonomer), although other reaction mechanisms are also possible as the disclosure is not meant to be limiting in this regard.

The polymer may have any of a variety of suitable molecular weights. In some embodiments, for example, the molecular weight of the polymer is greater than or equal to 60 kDa, greater than or equal to 65 kDa, greater than or equal to 70 kDa, or greater than or equal to 75 kDa. In certain embodiments, the molecular weight of the polymer is less than or equal to 80 kDa, less than or equal to 75 kDa, less than or equal to 70 kDa, or less than or equal to 65 kDa. Combinations of the above recited ranges are possible (e.g., the molecular weight of the polymer is greater than or equal to 60 kDa and less than or equal to 80 kDa, the molecular weight of the polymer is greater than or equal to 65 kDa and less than or equal to 75 kDa). Other ranges are also possible. In certain embodiments, the molecular weight of the polymer may be determined by GPC.

According to some embodiments, the polymer comprises a structure that comprises one or more pores and/or cavities. The one or more pores and/or cavities in the polymer may, in some embodiments, be formed by the structure of the first component (e.g., monomer) and/or the second component (e.g., macromonomer). In some embodiments, for example, the macrocycle of the first component and/or the ladder structure of the second component may form the one or more pores and/or cavities in the polymer. In certain embodiments, the one or more pores and/or cavities may be configured to host guest molecules, which is explained in further detail herein.

In some embodiments, the one or more pores and/or cavities may create a free volume. In certain embodiments, for example, and as explained in further detail herein, a free volume created by the pores and/or cavities can provide a solid material with a BET surface area greater than or equal to 100 $m^2/g$ (e.g., 150 $m^2/g$, 200 $m^2/g$, 250 $m^2/g$, 300 $m^2/g$, 350 $m^2/g$, etc.).

According to certain embodiments, the solid material is solvent free. In some embodiments, for example, the solid material comprises no or substantially no solvents within one or more pores and/or cavities of the polymer.

The polymer may have any of a variety of suitable BET surface areas. In some embodiments, for example, the polymer has a BET surface area greater than or equal to 100 $m^2/g$, greater than or equal to 150 $m^2/g$, greater than or equal to 200 $m^2/g$, greater than or equal to 250 $m^2/g$, or greater than or equal to 300 $m^2/g$. In certain embodiments, the polymer has a BET surface area less than or equal to 350 $m^2/g$, less than or equal to 300 $m^2/g$, less than or equal to 250 $m^2/g$, less than or equal to 200 $m^2/g$, or less than or equal to 150 $m^2/g$. Combinations of the above recited ranges are possible (e.g., the polymer has a BET surface area greater than or equal to 100 $m^2/g$ and less than or equal to 350 $m^2/g$, the polymer has a BET surface area greater than or equal to 200 $m^2/g$ and less than or equal to 250 $m^2/g$). Other ranges are also possible. According to certain embodiments, the BET surface area of the polymer may be measured with a Micromeritics ASAP2020.

The polymer may have an advantageously low weight loss as a result of thermal decomposition. In some embodiments, for example, the polymer has a weight loss less than or equal to 5%, less than or equal to 4%, less than or equal to 3%, less than or equal to 2%, or less than or equal to 1% as a result of thermal decomposition at 250° C. in certain embodiments, the polymer has a weight loss greater than or equal to 0.1%, greater than or equal to 1%, greater than or equal to 2%, greater than or equal to 3%, or greater than or equal to 4% as a result of thermal decomposition at 250° C. Combinations of the above recited ranges are possible (e.g., the polymer has a weight loss less than or equal to 5% and greater than or equal to 0.1% as a result of thermal decomposition al 250° C., the polymer has weight loss less than or equal to 3% and greater than or equal to 2% as a result of thermal decomposition at 250° C.). Other ranges are also possible. In certain embodiments, the weight loss as a result of thermal decomposition at 250° C. may be determined by thermogravimetric analysis.

According to certain embodiments, the composition (e.g., comprising the polymer) may have any of a variety of suitable adsorption capacities towards an organic molecule. In some embodiments, for example, the adsorption capacity of the composition towards an organic molecule is at least 200 mg of the organic molecule per gram of polymer, at least 220 mg of the organic molecule per gram of polymer, at least 240 mg of the organic molecule per gram of polymer, at least 260 mg of the organic molecule per gram of polymer, or at least 280 mg of the organic molecule per gram of polymer. In certain embodiments, the adsorption capacity of the composition towards an organic molecule is less than or equal to 300 mg of the organic molecule per gram of polymer, less than or equal to 280 mg of the organic molecule per gram of polymer, less than or equal to 260 mg of the organic molecule per gram of polymer, less than or equal to 240 mg of the organic molecule per gram of polymer, or less than or equal to 220 mg of the organic molecule per gram of polymer. Combinations of the above recited ranges are possible (e.g., the adsorption capacity of the composition towards an organic molecule is at least 200 mg of the organic molecule per gram of polymer and less than or equal to 300 mg of the organic molecule per gram of polymer, the adsorption capacity of the composition towards an organic molecule is at least 240 mg of the organic molecule per gram of polymer and less than or equal to 260 of the organic molecule mg per gram of polymer). Other ranges are also possible. According to certain embodiments, the adsorption capacity of the composition towards an organic molecule may be determined by NMR spectroscopy (e.g., $^1$H-NMR spectroscopy) and/or UV-vis spectroscopy.

The composition may be configured to adsorb any of a variety of suitable organic molecules. In some embodiments, for example, the organic molecule is a nitrosamine (e.g., a tobacco-specific nitrosamine). Other organic molecules are also possible.

Suitable nitrosamines (e.g., tobacco-specific nitrosamines) include, according to some embodiments, 4-(methylnitrosamino)-1-(3-pyridyl)-1-butanone (NNK); N'-nitrosonomicotine (NNN); N'-nitrosoanatabine (NAT); N'-nitrosoanabasine (NAB); and/or 4-(methylnitrosamino)-1-(3-pyridyl)-1-butanol (NNAL). Other nitrosamines are also possible, including, for example, dialkyl nitrosamines such as N-nitrosodimethylamine.

Figure 1:
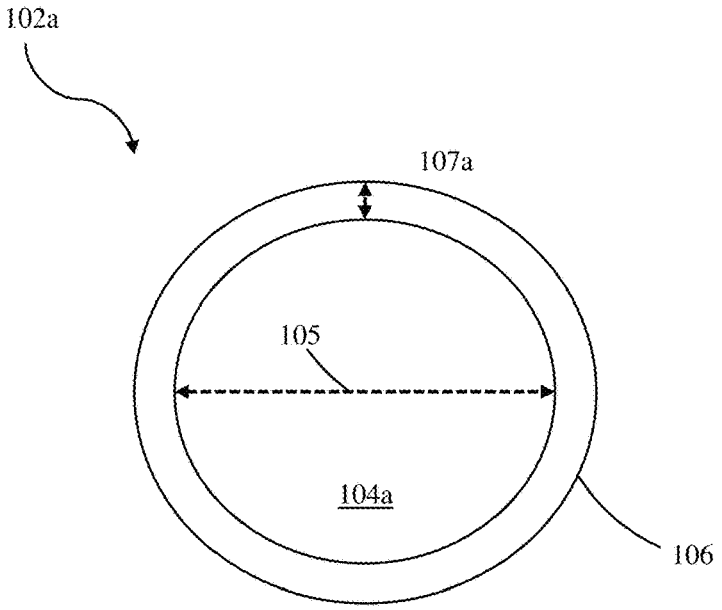
FIG. 1 shows, according to certain embodiments, a cross-sectional schematic diagram of an article, wherein the article comprises a substrate comprising a particle.

According to certain embodiments, an article is described. FIG. 1 shows, according to certain embodiments, a cross-sectional schematic diagram of article 102*a*. In some embodiments, the article comprises a substrate. Referring to FIG. 1, for example, article 102*a* comprises substrate 104*a*.

In certain embodiments, the composition may be disposed on the substrate. In some embodiments, for example, the composition may be coated and/or deposited on the substrate. Referring to FIG. 1, for example, composition 106 is disposed on substrate 104*a*.

The substrate may have any of a variety of suitable forms. In some embodiments, for example, the substrate comprises a particle. Referring to FIG. 1, substrate 104*a* comprises a particle, according to certain embodiments. In some embodiments, the particle is a nanoparticle. As used herein, the term "nanoparticle" is given its ordinary meaning in the art and generally refers to a particle having a maximum characteristic dimension (e.g., a maximum diameter) between greater than or equal to 1 nanometer and less than 1 micrometer. In some embodiments, for example, maximum characteristic dimension (e.g., maximum diameter) 105 of the particle shown in FIG. 1 is between greater than or equal to 1 nanometer and less than 1 micrometer. In other embodiments, the particle is a microparticle. As used herein; the term "microparticle" is given its ordinary meaning in the art and refers to a particle having a maximum characteristic dimension (e.g., a maximum diameter) between greater than or equal to 1 micrometer and less than 1000 micrometers. In certain embodiments, for example, maximum characteristic dimension (e.g., maximum diameter) 105 of the particle shown in FIG. 1 is between greater than or equal to 1 micrometer and less than 1000 micrometers.

According to certain embodiments, the particle (e.g., nanoparticle, microparticle) may have any of a variety of suitable sizes. In some embodiments, for example, the particle (e.g., nanoparticle, microparticle) has a maximum characteristic dimension (e.g., a maximum diameter) greater than or equal to 1 nanometer, greater than or equal to 10 nanometers, greater than or equal to 100 nanometers, greater than or equal to 500 nanometers, greater than or equal to 1 micrometer, greater than or equal to 10 micrometers, greater than or equal to 100 micrometers, or greater than or equal to 500 micrometers. In certain embodiments, the particle (e.g., nanoparticle, microparticle) has a maximum characteristic dimension (e.g., a maximum diameter) less than 1000 micrometers, less than or equal to 500 micrometers, less than or equal to 100 micrometers, less than or equal to 10 micrometers, less than or equal to 1 micrometer, less than or equal to 500 nanometers, less than or equal to 100 nanometers, or less than or equal to 10 nanometers. Combinations of the above recited ranges are possible (e.g., the particle has a maximum characteristic dimension greater than or equal to 1 nanometer and less than 1000 micrometers, the particle has a maximum characteristic dimension greater than or equal to 500 nanometers and less than or equal to 1 micrometer). Other ranges are also possible.

The particle may comprise any of a variety of suitable materials. According to certain embodiments, the particle comprises a magnetic material. In certain embodiments, the particle comprises a hydrophilic material. In some embodiments, the particle comprises silica. The particle may, in some embodiments, comprise polystyrene (e.g., crosslinked polystyrene) and/or an iron oxide. Other materials are also possible.

In some embodiments wherein the substrate comprises a particle, the composition may be disposed (e.g., coaled and/or deposited) on at least a portion of the particle. Referring to FIG. 1, for example, composition 106 is disposed (e.g., coated and/or deposited) on at least a portion of substrate (e.g., particle) 104*a*. Although FIG. 1 shows composition 106 completely coating substrate (e.g., particle) 104*a*, the composition may coat only a portion of the substrate (e.g., particle), as the disclosure is not meant to be limiting in this regard. In certain embodiments, for example, the composition may coat only a portion of the particle such that one or more surfaces of the particle are exposed to an external atmosphere.

According to certain embodiments, the composition may be coated on at least a portion of the particle by dissolving the composition in a solvent (e.g., an organic solvent), adding the particles to the solution comprising the composition to form a mixture, and drying the mixture. In other embodiments, the composition may be coated on the particle by spraying the composition on the particle and drying the particle. In yet other embodiments, the composition may be deposited on the particle, for example, by chemical vapor deposition.

The composition coated on a least a portion of the particle may have any of a variety of suitable average thicknesses. Referring, for example, to FIG. 1, composition 106 coated on substrate (e.g., particle) 104*a* has average thickness 107*a*. In some embodiments, the composition coated on at least a portion of the particle has an average thickness greater than or equal to 1 nm, greater than or equal to 10 nm, greater than or equal to 50 nm, greater than or equal to 100 nm, greater than or equal to 500 nm, greater than or equal to 1 Micrometer, greater than or equal to 10 micrometers, greater than or equal to 50 micrometers, or greater than or equal to 100 micrometers. In certain embodiments, the composition coated on at least a portion of the particle has an average thickness less than or equal to 500 micrometers, less than or equal to 100 micrometers, less than or equal to 50 micrometers, less than or equal to 10 micrometers, less than or equal to 1 micrometer, less than or equal to 500 nm, less than or equal to 100 nm, less than or equal to 50 nm, or less than or equal to 10 nm. Combinations of the above recited ranges are possible (e.g., the composition coated on least a portion of the particle has an average thickness greater than or equal to 1 nm and less than or equal to 500 micrometers, the composition coated on least a portion of the particle has an average thickness greater than or equal to 500 nm and less than or equal to 1 micrometer). Other ranges are also possible. The average thickness of the composition coated on the particle may be determined by SEM and/or TEM.

Figure 2:
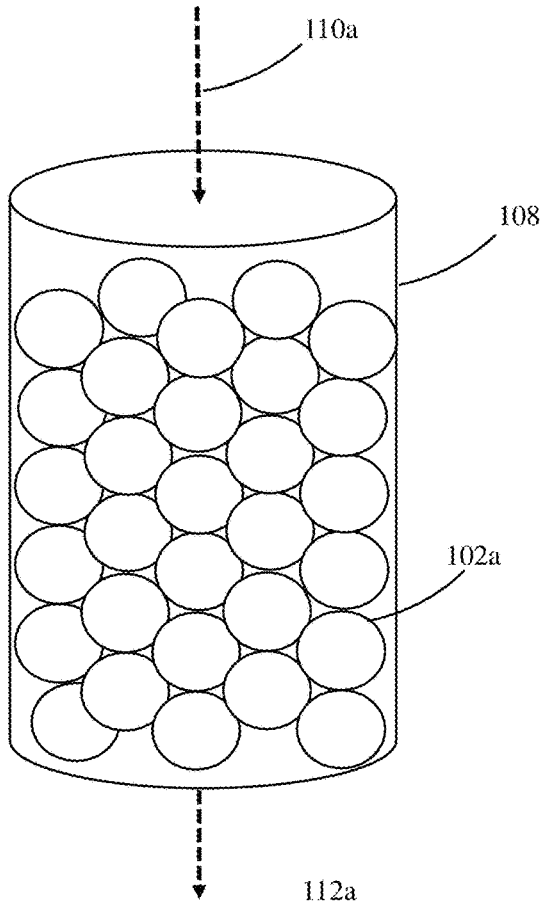
FIG. 2 shows, according to certain embodiments, a schematic diagram of a plurality of articles packed in a tube.

In certain embodiments wherein the substrate comprises a particle, the particle may be packed in a tube (e.g., a column). FIG. 2 shows, according to certain embodiments, a schematic diagram of a plurality of articles 102*a* packed in tube and/or column 108.

Figure 3:
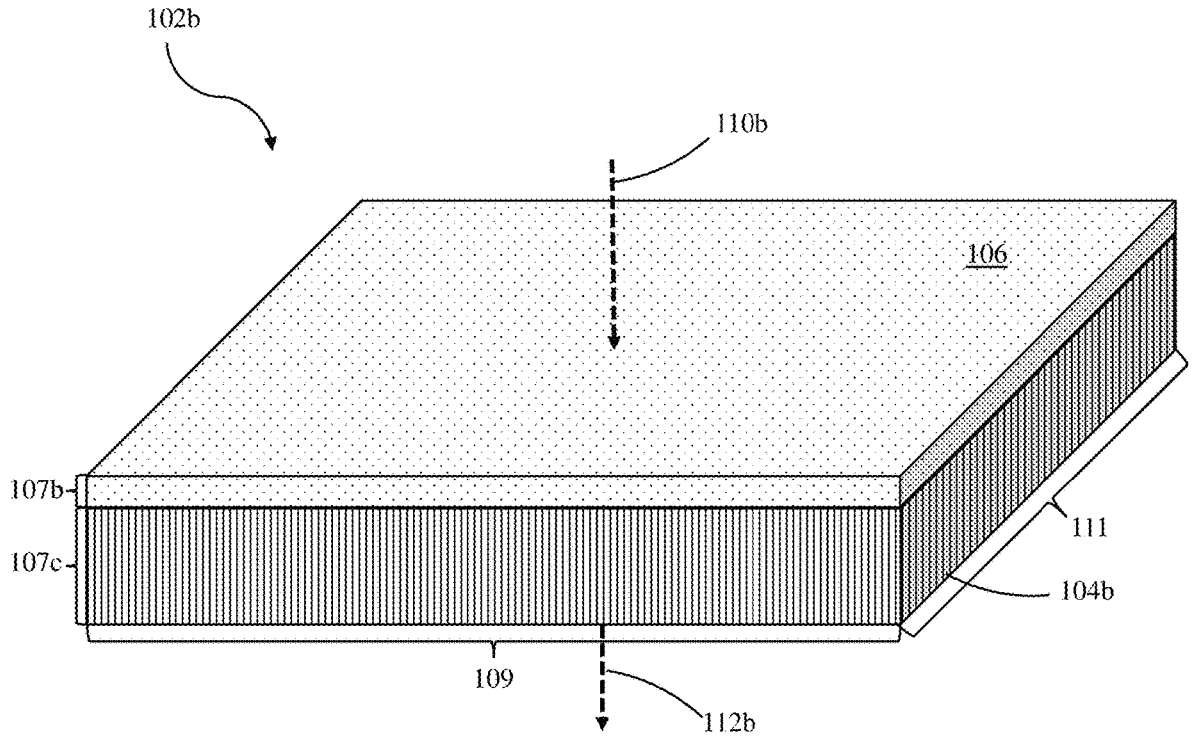
FIG. 3 shows, according to certain embodiments, a schematic diagram of an article, wherein the article comprises a substrate comprising a film and/or filter.

In certain embodiments, the substrate comprises a film and/or a filter. FIG. 3 shows, according to certain embodiments, a schematic diagram of article 102*b*, wherein article 102*b* comprises substrate 104*b* comprising a film and/or The film and/or filter may have any of a variety of suitable thicknesses. Referring to FIG. 3, for example, substrate (e.g., film and/or filter) 104*b* has average thickness 107*c*. In some embodiments, the film and/or filter has an average thickness greater than or equal to 1 micrometer, greater than or equal to 100 micrometers, greater than or equal to 500 micrometers, greater than or equal to 1 mm, greater than or equal to mm, or greater. In certain embodiments, the film and/or filter has an average thickness less than or equal to 10 mm, less than or equal to 5 mm, less than or equal to 1 mm, less than or equal to 500 micrometers, less than or equal to 100 micrometers, or less. Combinations of the above recited ranges are possible (e.g., the film and/or filter has an average thickness greater than or equal to 1 micrometer and less than or equal to 10 mm, the film and/or filter has an average thickness greater than or equal to 500 micrometers and less than or equal to 1 mm). Other ranges are also possible.

The film and/or filter may have any of a variety of suitable lengths and/or widths. Referring, for example, to FIG. 3, substrate e.g., film and/or filter) 104*b* has length 109 and width 111. The length and/or width of the film and/or filter may be greater than or equal to 1 cm, greater than or equal to 5 cm, greater than or equal to 10 cm, greater than or equal to 50 cm, or greater. In some embodiments, the length and/or width of the film and/or filter is less than or equal to 100 cm, less than or equal to 50 cm, less than or equal to 10 cm, less than or equal to 5 cm, or less. Combinations of the above recited ranges are also possible (e.g., the length and/or width of the film and/or filter is greater than or equal to 1 cm and less than or equal to 100 nm, the length and/or width of the film and/or filter is greater than or equal to 5 cm and less than or equal to 10 cm). Other ranges are also possible.

The film and/or filter may comprise any of a variety of suitable materials. According to some embodiments, the film and/or filter may comprise a porous material. In some such embodiments wherein the film and/or filter comprises a porous material, the pores may be macropores and/or micropores. In certain embodiments, the film and/or filter comprises cellulose, a polymer (e.g., an insoluble polymer), and/or glass, Other materials are also possible.

In some embodiments wherein the substrate comprises a film and/or filter, the composition may be disposed (e.g., coated and/or deposited) on at least a portion of the film and/or filter. Referring to FIG. 3, for example, composition 106 is disposed (e.g., coated and/or deposited) on at least a portion of substrate (e.g., film and/or filter) 104*b*. Although FIG. 3 shows composition 106 completely coating substrate (e.g., film and/or filter) 104*b*, the composition may coat only a portion of the substrate (e.g., film and/or filter), as the disclosure is not meant to be limiting in this regard. In some embodiments, for example, the composition may coat only a portion of the film and/or filter such that one or more surfaces of the film and/or filter are exposed to an external atmosphere.

According to certain embodiments, the composition may be coated on at least a portion of the film and/or filter by dissolving the composition in a solvent (e.g., an organic solvent), dipping and/or submerging the film and/or filter into the solution comprising the composition, and drying the film and/or filter. In other embodiments, the composition may be coated on the film and/or filter by spraying the composition on the film and/or filter and drying the film and/or filter. In yet other embodiments, the composition may be deposited on the film and/or filter by, for example, chemical vapor deposition.

The composition coated on a least a portion of the film and/or filter may have any of a variety of suitable average thicknesses. Referring, for example, to FIG. 3, composition 106 coated on substrate (e.g., film and/or filter) 104*b* has average thickness 107*b*. In some embodiments, the composition coated on at least a portion of the film and/or filter has an average thickness greater than or equal to 1 nm, greater than or equal to 10 nm, greater than or equal to 50 nm, greater than or equal to 100 nm, greater than or equal to 500 nm, greater than or equal to 1 micrometer, greater than or equal to 10 micrometers, greater than or equal to 50 micrometers, or greater than or equal to 100 micrometers. In certain embodiments, the composition coated on at least a portion of the film and/or filter has an average thickness less than or equal to 500 micrometers, less than or equal to 100 micrometers, less than or equal to 50 micrometers, less than or equal to 10 micrometers, less than or equal to 1 micrometer, less than or equal to 500 nm, less than or equal to 100 nm, less than or equal to 50 nm, or less than or equal to 10 nm. Combinations of the above recited ranges are possible (e.g., the composition coated on least a portion of the film and/or filter has an average thickness greater than or equal to 1 nm and less than or equal to 500 micrometers, the composition coated on least a portion of the film and/or filter has an average thickness greater than or equal to 500 nm and less than or equal to 1 micrometer). Other ranges are also possible. The average thickness of the composition coated on the film and/or filter may be determined by SEM and/or TEM.

In certain non-limiting embodiments wherein the film and/or filter comprises a porous material comprising macropores with a maximum characteristic dimension (e.g., maximum diameter) greater than or equal to 1 micrometer, thicker coatings of the composition on the film and/or filter may be effective. For example, in some embodiments wherein the film and/or filter comprises a porous material comprising macropores with a maximum characteristic dimension greater than or equal to 1 micrometer, the average thickness of the composition coated on at least a portion of the film and/or filter may be greater than or equal to 10 micrometers, greater than or equal to 50 micrometers, greater than or equal to 100 micrometers, greater than or equal to 500 micrometers, greater than or equal to 1 mm, or greater.

According to some embodiments, the composition coated on a least a portion of the film and/or filter may be at least partially porous (e.g., towards liquids). In certain embodiments, for example, the composition may conform to one or more pores of the underlying substrate (e.g., film and/or filter) such that the pores of the underlying substrate are accessible through the composition.

Figure 4:
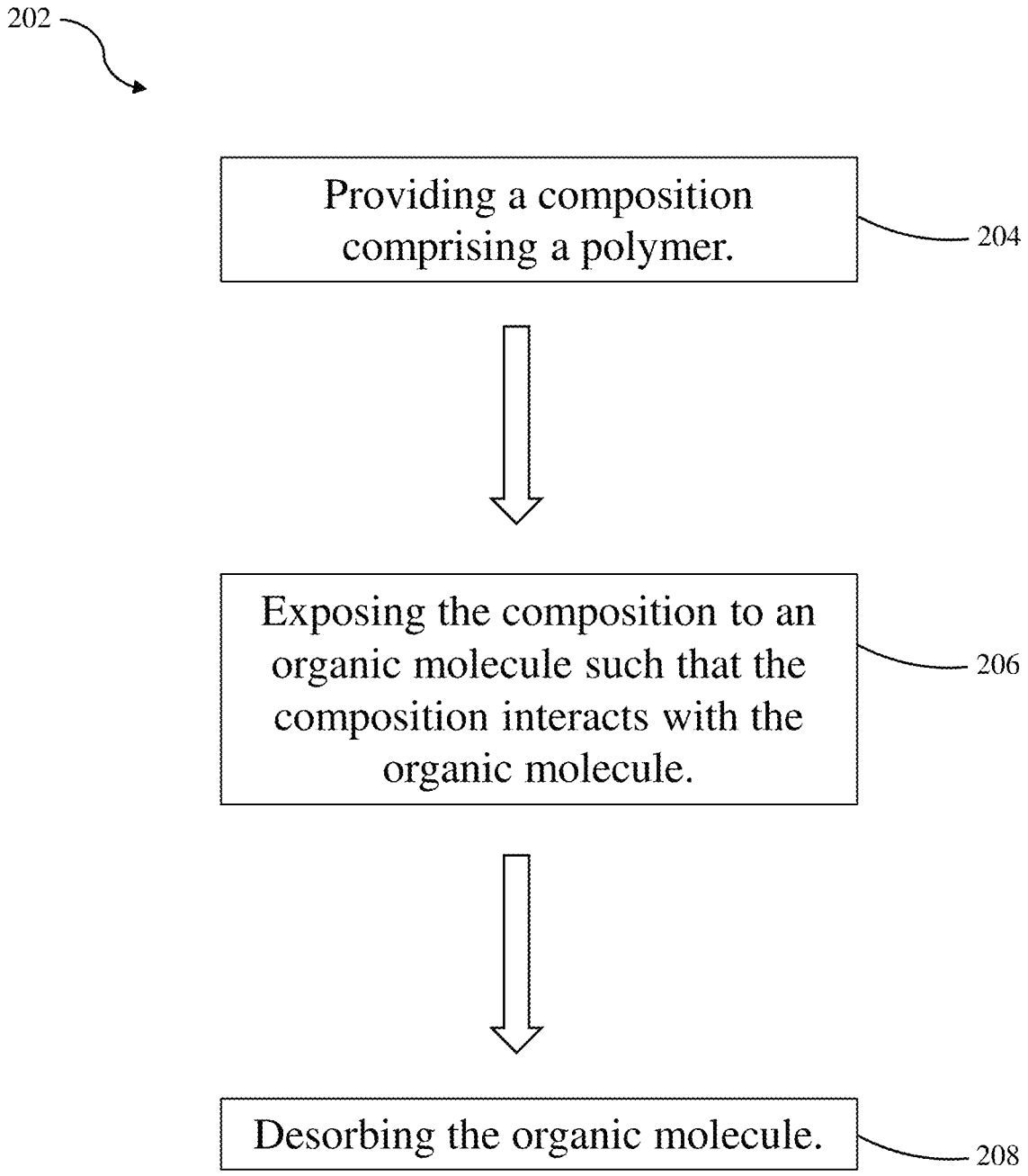
FIG. 4 shows, according to certain embodiments, a flow diagram of a method of extracting an organic molecule.

According to certain embodiments, a method of extracting an organic molecule is described. FIG. 4 shows, according to certain embodiments, a flow diagram of method 202. In some embodiments, method 202 comprises step 204 which comprises providing a composition comprising a polymer, as described herein.

In some embodiments, providing the composition comprises dissolving and/or dispersing the composition in a solution (e.g., an aqueous solution). In certain embodiments wherein providing the composition comprises dissolving and/or dispersing the composition in a solution, the composition may be dissolved and/or dispersed in the solution at any of a variety of suitable concentrations. In some embodiments, for example, the composition is dissolved and/or dispersed in solution at a concentration greater than or equal to 0.5 mg/mL, greater than or equal to 0.6 mg/mL, greater than or equal to 0.7 mg/mL, greater than or equal to 0.8 mg/mL, or greater than or equal to 0.9 mg/mL. In certain embodiments, the composition is dissolved and/or dispersed in solution at a concentration less than or equal to 1 mg/mL, less than or equal to 0.9 mg/mL, less than or equal to 0.8 mg/mL, less than or equal to 0.7 mg/mL, or less than or equal to 0.6 mg/mL. Combinations of the above recited ranges are possible (e.g., the composition is dissolved and/or dispersed in solution at a concentration greater than or equal to 0.5 mg/mL and less than or equal to 1 mg/mL, the composition is dissolved and/or dispersed in solution at a concentration greater than or equal to 0.7 mg/mL and less than or equal to 0.8 mg/mL). Other ranges are also possible.

In some embodiments, method 202 comprises step 206, as shown in FIG. 4, which comprises exposing the composition to an organic molecule. In certain embodiments wherein providing the composition comprises dissolving and/or dispersing the composition in a solution (e.g., an aqueous solution), the composition may be exposed to the organic molecule by adding (e.g., dissolving and/or dispersing) the organic molecule to the solution prior to and/or after the composition. According to certain embodiments, the composition may be exposed to the organic molecule while mixing (e.g., sonicating, stirring) the solution comprising a mixture of the composition and the organic molecule. According to some embodiments, mixing (e.g., sonicating) the solution comprising a mixture of the composition and the organic molecule may advantageously facilitate the dispersion of the composition in the solution, thereby facilitating adsorption of the organic molecule, as explained in greater detail herein.

According to certain embodiments, step 204 comprises providing an article comprising the composition. In some embodiments, for example, step 204 comprises providing article 102*a*, as shown in FIG. 1 (or a plurality of articles 102*a*, as shown in FIG. 2). According to certain embodiments, tier example, step 204 may comprise dispersing particle 102*a* (or a plurality of articles 102*a*) in a solution (e.g., an aqueous solution).

In some embodiments step 206 may comprise exposing the article comprising the composition to the organic molecule. Referring to FIG. 1, tier example, article 102*a* may be dispersed in a solution (e.g., an aqueous solution) and the organic molecule may be added to (e.g., dissolved and/or dispersed in) the solution prior to and/or after article 102*a*. According to certain embodiments, the article comprising the composition (e.g., article 102*a*) may be exposed to the organic molecule while mixing (e.g., sonicating, stirring) the solution comprising a mixture of the article comprising the composition (e.g., article 102*a*) and the organic molecule. According to some embodiments, mixing (e.g., stirring) the solution comprising a mixture of the article comprising the composition and the organic molecule may advantageously facilitate the dispersion of the article comprising the composition in the solution, thereby facilitating adsorption of the organic molecule, as explained in greater detail herein.

In certain embodiments, as shown in FIG. 2, plurality of articles 102*a* may be exposed to solution (e.g., extraction solution) 110*a* comprising the organic molecule by flowing solution 110*a* through tube and/or column 108 in the presence of plurality of articles 102*a*.

In some embodiments, step 204 comprises providing article 102*b*, as shown in FIG. 3.

According to certain embodiments, as shown in FIG. 3, step 206 comprises exposing article 102*b* to solution 110*b* comprising the organic molecule by flowing solution (e.g., extraction solution) 110*b* over and/or through article 102*b*.

According to some embodiments, as a result of exposing the composition to the organic molecule, the composition may interact with the organic molecule. The composition may interact with the organic molecule, in some embodiments, by forming one or more interactions between one or more components of the polymer and one of more functional groups of the organic molecule. In some embodiments, the composition (e.g., first component) interacts with one or more nitrogen-containing moieties of the organic molecule. In certain non-limiting embodiments, for example, the first component (e.g., monomer) interacts with one or more pyridyl groups and/or nitroso groups of the organic molecule. As explained herein in further detail, the metal of the first component (e.g., monomer) may interact with one or more functional groups of the organic molecule.

The one or more interactions between the one or more components of the polymer and the one or more functional groups of the organic molecule may be any of a variety of suitable interactions, in certain embodiments, for example, the one or more interactions are one or more bonding interactions (e.g., chemical bonding interactions), such as one or more covalent bonds, ionic bonds, metallic bonds, dipole-dipole interactions, van der Waals interactions, London dispersion forces, and/or hydrogen bonds. According to certain embodiments, one or more interactions between the one or more components of the polymer and the one or more functional groups of the organic molecule may be determined by NMR spectroscopy (e.g., $^{1}$H-NMR spectroscopy) and/or infrared (IR) spectroscopy.

In certain embodiments, the composition may interact with the organic molecule such that the composition adsorbs the organic molecule. According to some embodiments, for example, the organic molecule may be adsorbed into the free volume of the polymer, i.e., into one or more pores and/or cavities of the polymer. In certain embodiments, the one or more pores and/or cavities of the polymer may host the organic molecule, for example, throughout the bulk of the material. In certain embodiments, the adsorption capacity of the composition towards the organic molecule is any of the adsorption capacities described herein (e.g., at least 200 mg of the organic molecule per gram of polymer and less than or equal to 300 mg of the organic molecule per gram of polymer).

In some embodiments, as a result of exposing the composition to the solution comprising the organic molecule (e.g., the extraction solution), the organic molecule may be extracted from solution. Referring to FIG. 2, for example, exposing plurality of articles (e.g., particle) 102*a* to solution (e.g., extraction solution) 110*a* comprising the organic molecule results in plurality of articles 102*a* adsorbing the organic molecule, thereby providing effluent 112*a*, wherein effluent 112*a* comprises a lesser amount of the organic molecule as compared to solution 110*a*. In other embodiments, as shown in FIG. 3, exposing article (e.g., film and/or filter) 102*b* to solution (e.g., extraction solution) 110*b* comprising the organic molecule results in article 102*b* adsorbing the organic molecule, thereby providing effluent 112*b*, wherein effluent 112*b* comprises a lesser amount of the organic molecule as compared to solution 110*b*.

According to some embodiments, the composition may advantageously be selective towards one or more target organic molecules in the presence of other organic species (e.g., non-target molecules). In certain embodiments, for example, exposing the composition to the organic molecule comprises exposing the composition to a mixture of species comprising the organic molecule. In some such embodiments, the mixture of species may comprise a mixture or organic molecules. In some embodiments, for example, the mixture of species may comprise nicotine and one or more organic molecules (e.g., NNK, NNN, NAT, NAB, and/or NNAL).

According to certain embodiments, the concentration of one or more other organic molecules (e.g., non-target molecules) in the mixture of species may be greater than one or more target organic molecules in the mixture of species. In some embodiments, for example, the concentration of nicotine in the mixture of species may be greater than the concentration of one or more target organic molecules (e.g., NNK, NNN, NAT, NAB, and/or NNAL).

In some embodiments, method 202 comprises step 206 which comprises desorbing the organic molecule from the composition. In certain embodiments, for example, the composition that has adsorbed the organic molecule may be exposed to a regenerating species to desorb the organic molecule and regenerate the composition. According to some embodiments, the regenerating species may comprise an organic solvent (e.g., acetonitrile). The organic molecule may, in certain embodiments, have a high solubility in the regenerating species (e.g., organic solvent). In some embodiments, the composition may be submerged and/or immersed in the regenerating species (e.g., organic solvent). Other regenerating species are also possible.

According to certain embodiments, other methods of regeneration are also possible, including for example, thermal regeneration.

According to some embodiments, after desorbing the organic molecule from the composition, the composition may be reused, for example, to adsorb additional target organic molecules from solution.

The compositions, articles, and methods described herein may be employed in any of a variety of suitable applications, including, for example, industrial purification (e.g., of tobacco-containing products and/or tobacco-containing extract solutions), pollution reduction, and/or implementation as filters (e.g., in tobacco-containing products).

The following examples are intended to illustrate certain embodiments of the present invention, but do not exemplify the full scope of the invention.

Example 1

The following example describes the synthesis and characterization of a composition comprising a polymer configured to adsorb organic molecules.

The synthesis and utility of porous polymers with a tungsten-calix[4]arene imido nitrosamine receptor for the efficient extraction of TSNAs is described. The binding of NNK to the tungsten-calix[4]arene imido complex was studied using $^1$H-NMR spectroscopy. Porosity was generated by the use of a macromonomer that has a shape persistent, oligomeric, ladder sidechain. The effect of the ratio of this monomer to the receptor monomer was assessed. The polymer, P2, with the optimal ratio of the two monomers, shows a high extraction efficiency for NNK from aqueous solution with an adsorption capacity of 203 mg/g when the extraction is performed under sonication. The extraction efficiencies of the polymer towards nitrosamines (NNK, NNN, NAT, NAB and 4-(methylnitrosamino)-1-(3-pyridyl)-1-butanol (NNAL)) are larger than that of nicotine, which is present in tobacco in much higher concentrations, revealing the selectivity of the polymer to nitrosamines. To improve the dispersibility of the polymer in water while affording convenient removal of the adsorbent from the extraction solution, hydrophilic magnetic particles (MPs) were coated with P2. Stirring the polymer coated MPs in nitrosamine-containing samples gave comparable extraction efficiency to that of the pure polymer particles with sonication. Also presented herein, is validation that the polymer can extract TSNAs from complex extracts produced from a commercial tobacco product.

Figure 11:
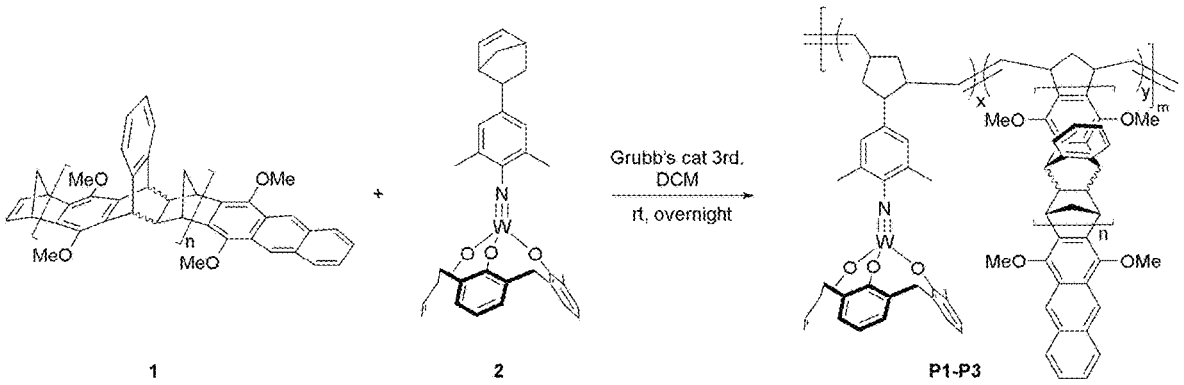
FIG. 11 shows, according to certain embodiments, a schematic diagram of the synthesis of polymers P1-P3.
Figure 12:
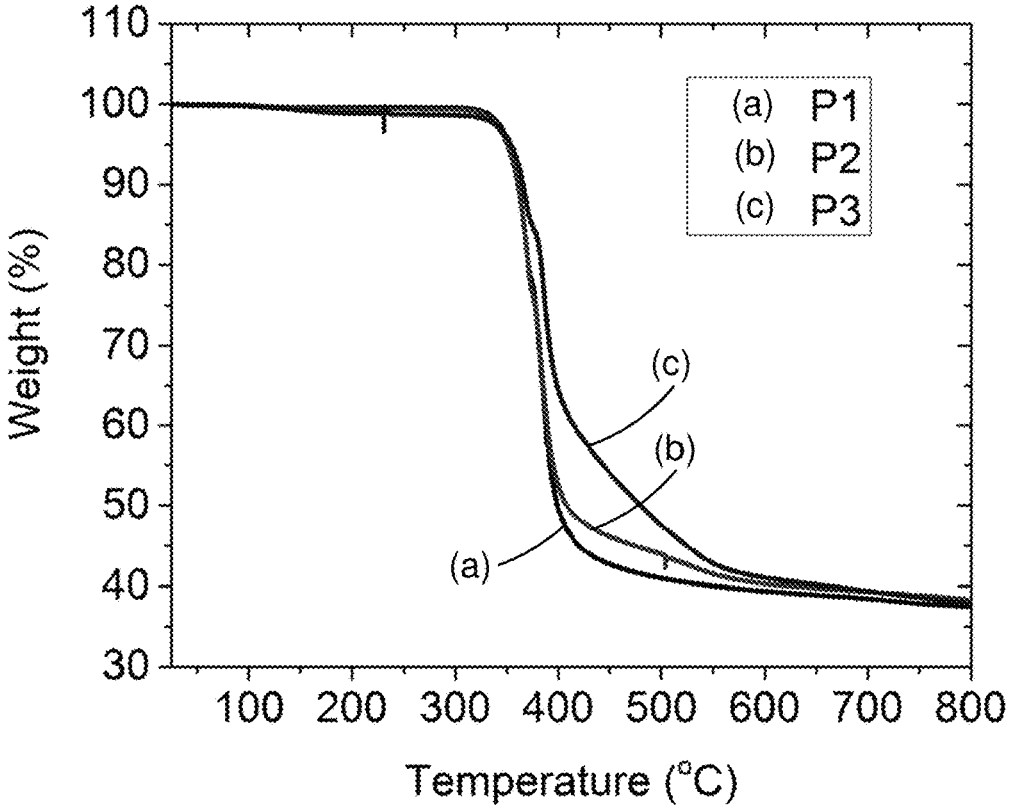
FIG. 12 shows, according to certain embodiments, thermogravimetric analyses of polymers P1-P3.

The synthesis of the statistical copolymers (P1-P3) is shown in FIG. 11. Macromonomer 1 and receptor monomer 2 were dissolved in dichloromethane (DCM) and polymerized at room temperature using the third-generation Grubbs catalyst in a glovebox. Polymers with different ratios of macromonomer 1 and receptor monomer 2 were synthesized to determine the optimal ratio of the nitrosamine receptor and the porosity generating macromonomer for extraction of NNK. Each polymer was synthesized twice (Batches 1 and 2) and their characterization data are summarized in Table 1 and Table 4. The polymers showed high thermal stability with decomposition temperatures higher than 350° C. (5% weight loss under $N_2$, FIG. 12).

TABLE 1

Chemical compositions and characterization data of P1, P2 and P3 (Batch 2).

| | 1 (%)[a] | 2 (%)[a] | $M_n$ (kDa)/PDI[b] | BET surface area ($m^2$/g) |
|---|---|---|---|---|
| P1 | 100 | 0 | 70.2/1.11 | 556 |
| P2 | 81.1 | 18.9 | 72.0/1.12 | 451 |
| P3 | 50 | 50 | 68.8/1.14 | 357 |

[a]Weight percentage.
[b]PDI: polydispersity index.

Figure 6A:
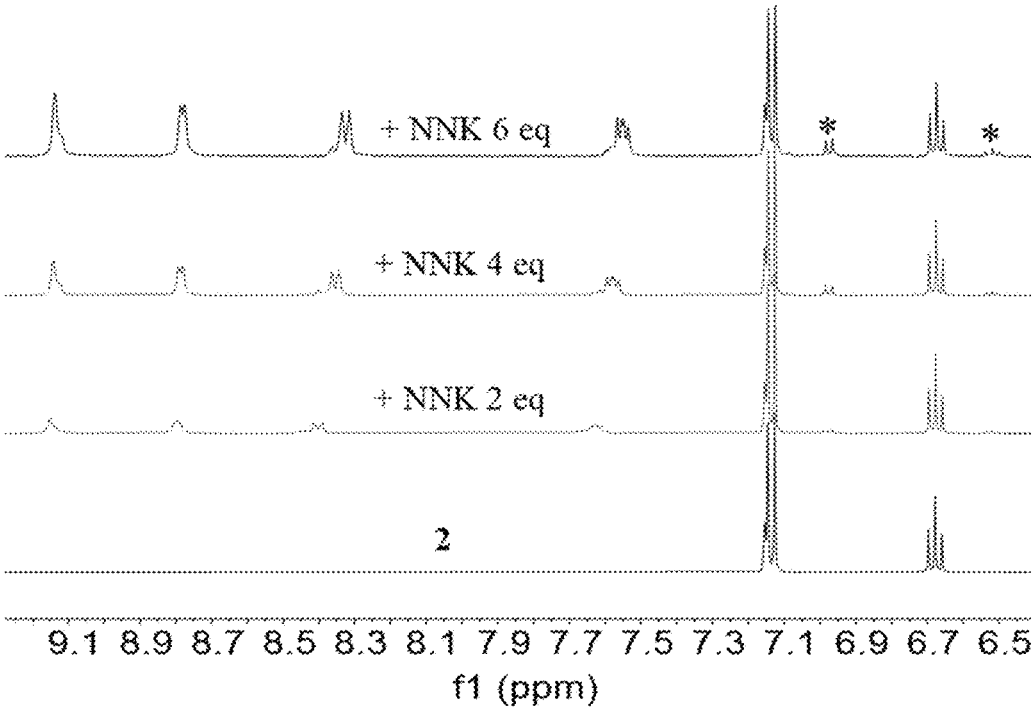
FIG. 6A shows, according to certain embodiments, transitions of $^1$H-NMR spectra of receptor monomer 2 in $CD_2Cl_2$ upon addition of nicotine-derived nitrosamine ketone (NNK) from 0 to 6 equivalents.
Figure 6B:
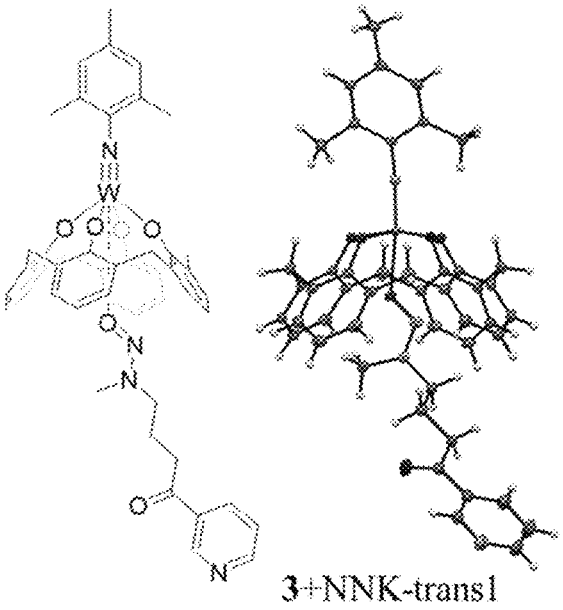
FIG. 6B shows, according to certain embodiments, a line drawing (left) and a crystal structure (right) of model molecule 3 and NNK revealing the interaction between tungsten and a nitroso group.
Figure 6C:
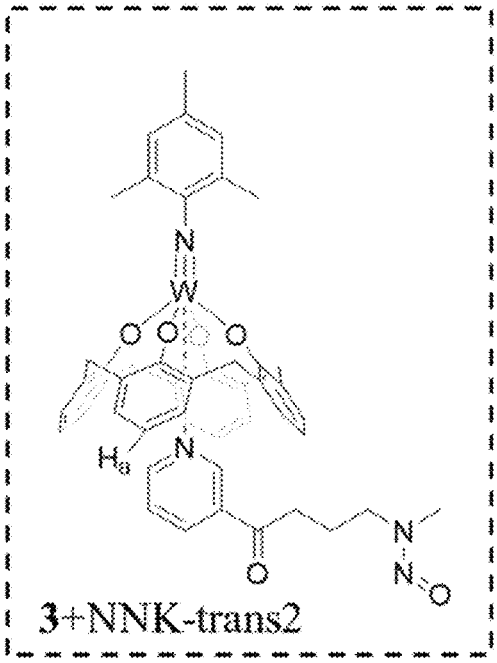
FIG. 6C shows, according to certain embodiments, a line drawing of model molecule 3 and NNK interacting through a pyridyl group.
Figure 13:
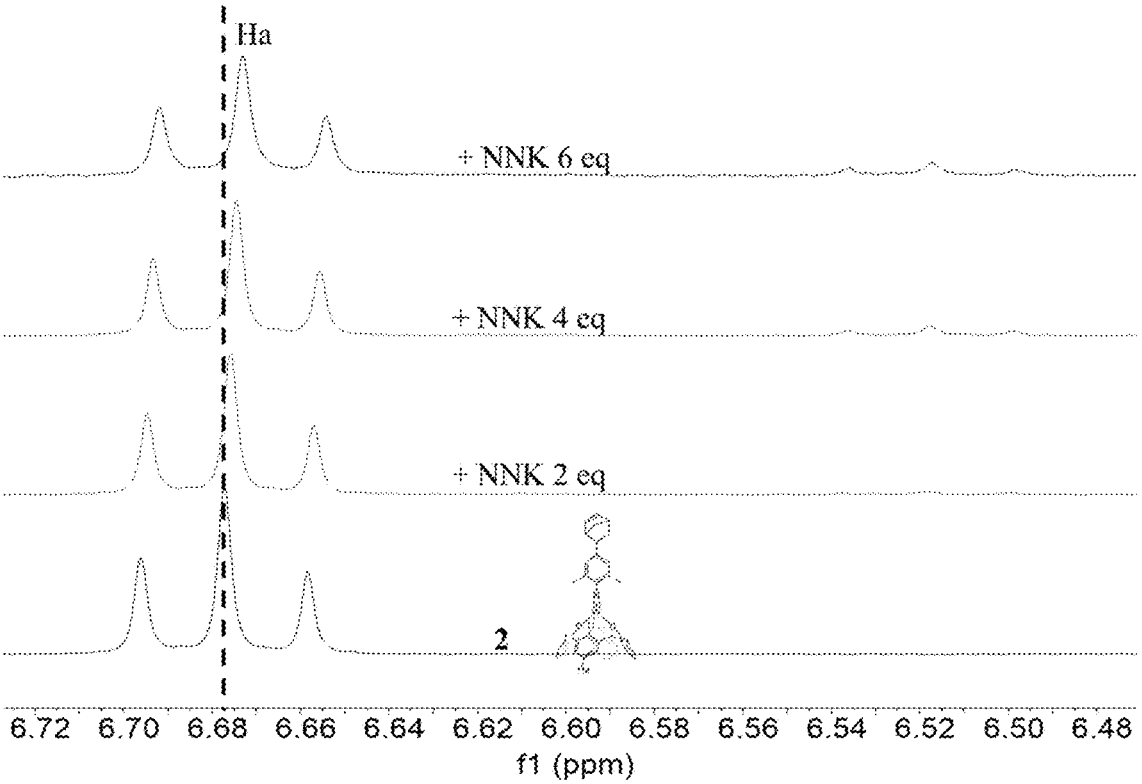
FIG. 13 shows, according to certain embodiments, transitions of $^1$H-NMR spectra of receptor monomer 2 in $CD_2Cl_2$ upon addition of NNK from 0 to 6 equivalents.
Figure 14A:
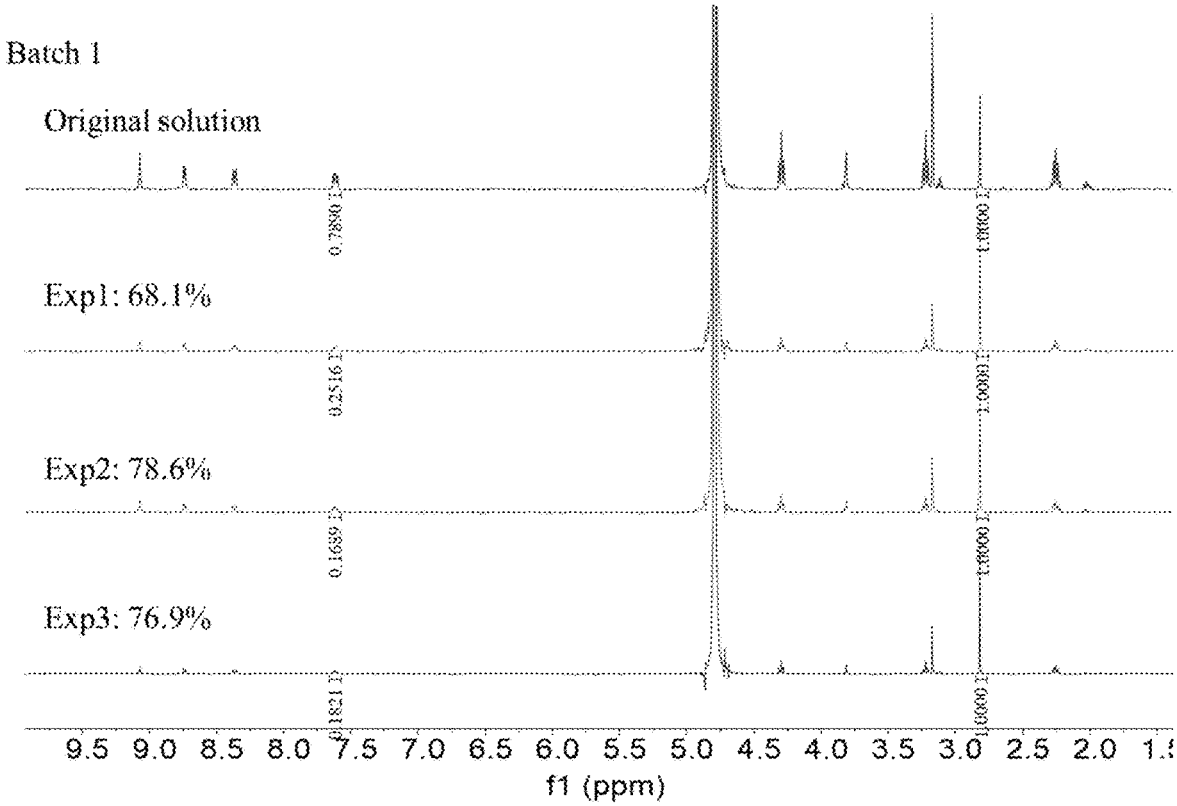
FIG. 14A shows, according to certain embodiments, $^1$H-NMR spectra of a first batch of NNK solution before and after extraction with polymer P1.
Figure 14B:
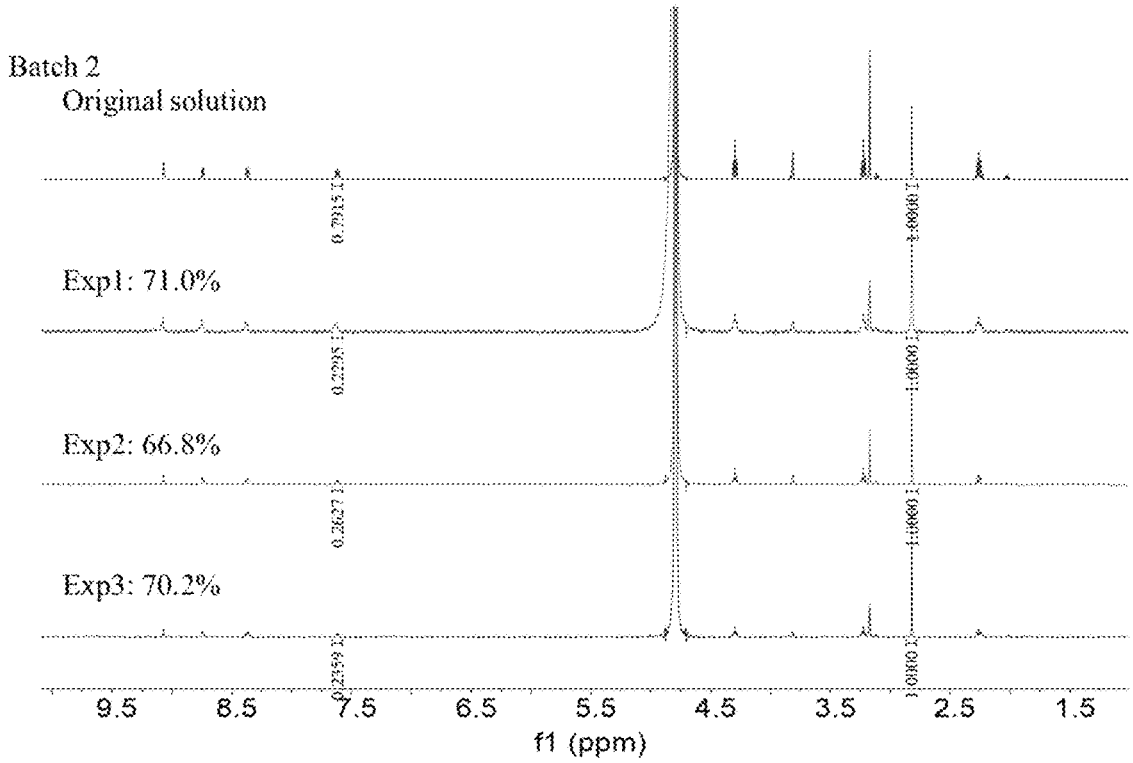
FIG. 14B shows, according to certain embodiments, $^1$H-NMR spectra of a second batch of NNK solution after extraction with polymer P1.
Figure 15A:
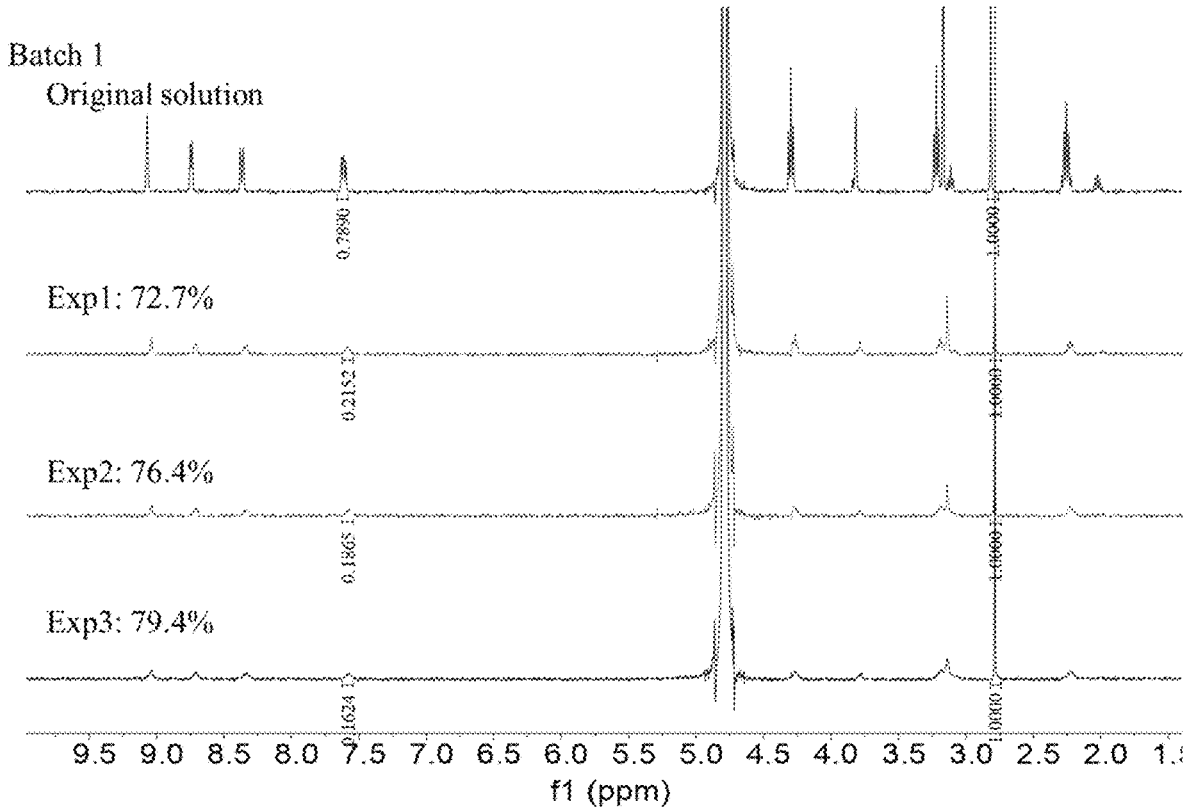
FIG. 15A shows, according to certain embodiments, $^1$H-NMR spectra of a first batch of NNK solution before and after extraction with polymer P2.
Figure 15B:
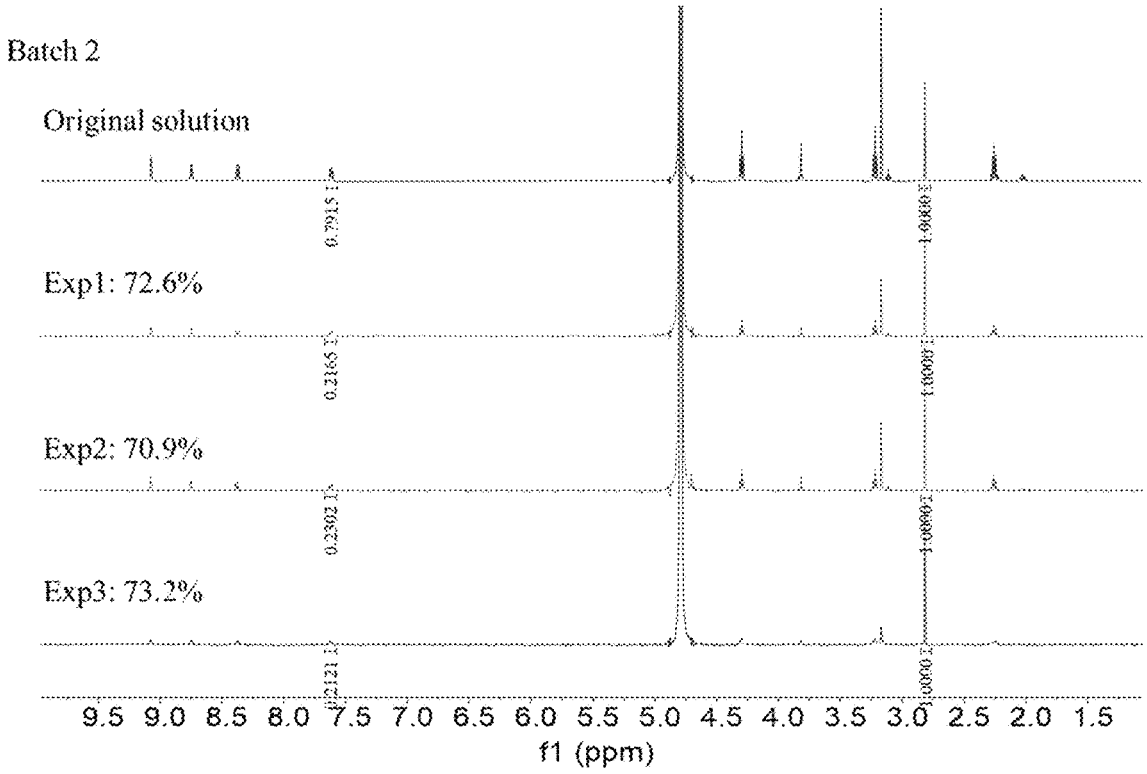
FIG. 15B shows, according to certain embodiments, $^1$H-NMR spectra of a second batch of NNK solution before and after extraction with polymer P2.
Figure 16A:
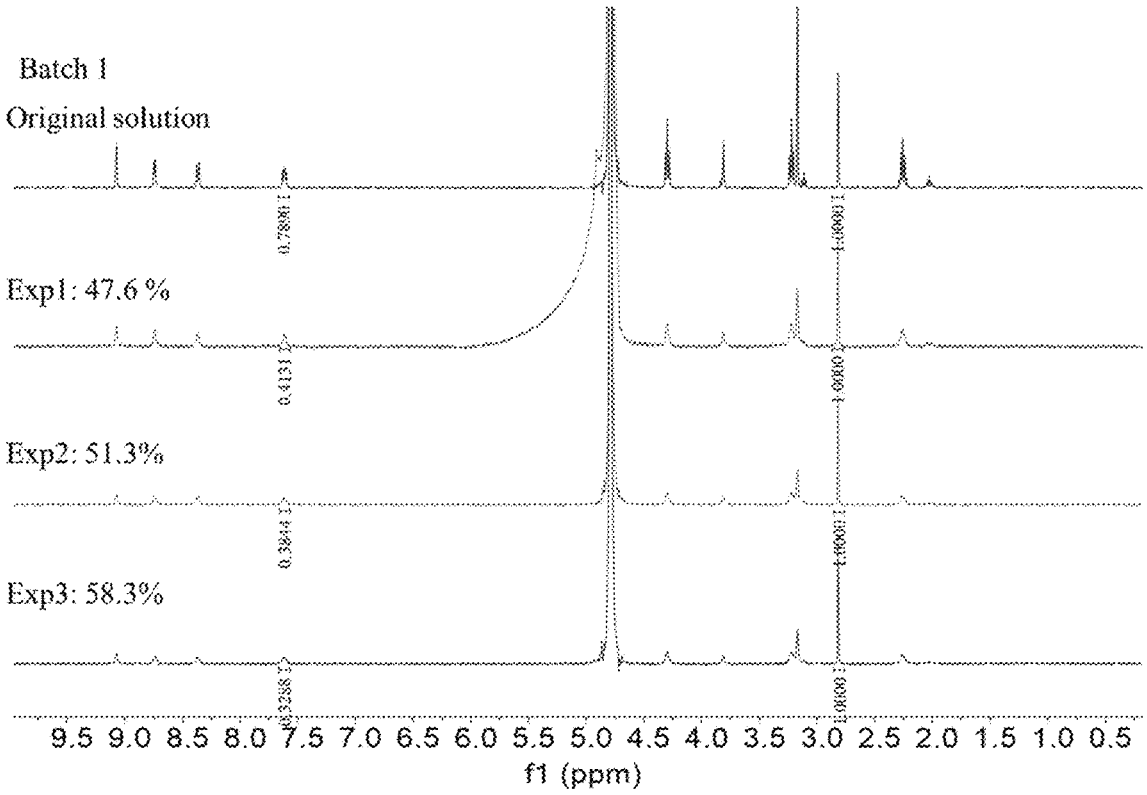
FIG. 16A shows, according to certain embodiments, $^1$H-NMR spectra of a first batch of NNK solution before and after extraction with polymer P3.
Figure 16B:
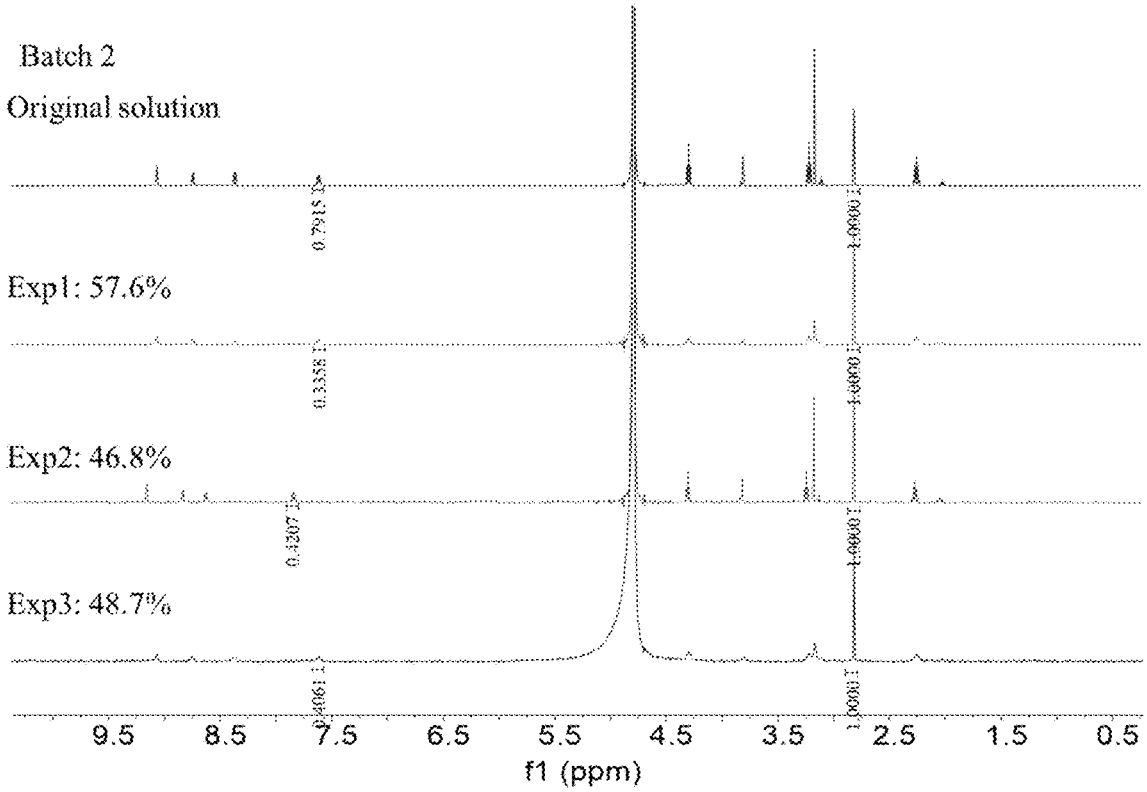
FIG. 16B shows, according to certain embodiments, $^1$H-NMR spectra of a second batch of NNK solution before and after extraction with polymer P3.
Figure 29A:
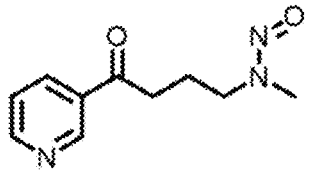
FIG. 29A shows, according to certain embodiments, relative energies of trans- and cis-NNK.
Figure 29A:
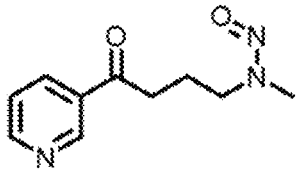
Figure 29B:
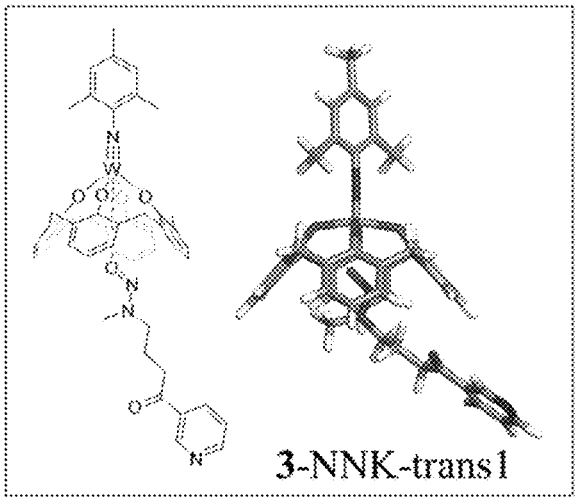
FIG. 29B shows, according to certain embodiments, molecular structures and binding energies of model molecule 3 toward trans-NNK (left) and cis-NNK (right)
Figure 29B:
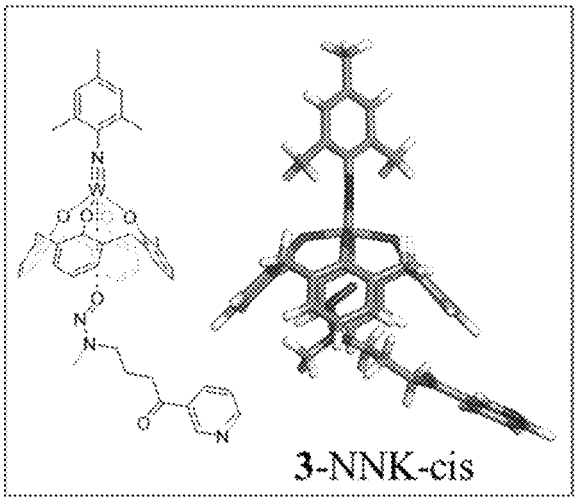
Figure 30:
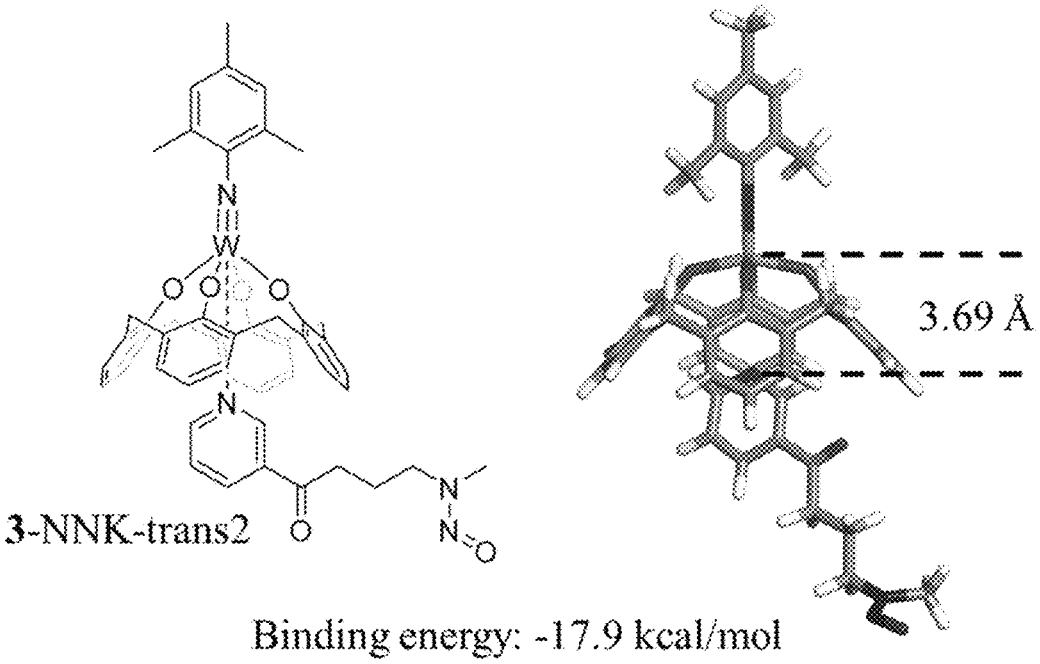
FIG. 30 shows, according to certain embodiments, molecular structures of the binding of model molecule 3 to trans-NNK through the interaction between the pyridyl group of NNK and model molecule 3.

The association between the receptor monomer 2 and NNK in $CD_2Cl_2$ was investigated by $^1$H-NMR spectroscopy. Upon addition of NNK, a new set of peaks attributed to the 2·NNK complex arose at 6.52 and 6.97 ppm (low-field region) (FIG. 6A, signals from receptor monomer 2 in the 2·NNK complex are marked with stars). Additionally, the aromatic peaks of calixarene moiety in receptor monomer 2 shifted to higher fields with increasing equivalents of NNK. Specifically, the peak assigned to Ha of receptor monomer 2 shifted gradually from 6.677 to 6.673 ppm upon addition of 0 to 6 equivalents of NNK (FIG. 13). This may result from the interaction between the free receptor and pyridyl groups of NNK. These results suggest that the tungsten-capped calix[4]arene interacts with both of the pyridyl and nitroso groups of NNK (FIGS. 6B-6C). Single crystals of model molecule 3 and NNK complex were successfully prepared by slow evaporation of their 1:1 mixture (molar ratio) in hexane/dichloromethane solution (FIG. 6B, Table 5). In FIG. 6B, thermal displacement ellipsoids are shown at 50% probability. In the solid state, the tungsten center tends to bind the nitroso group, as was predicted computationally (FIGS. 29A-30). The binding energies of model molecule 3 towards the nitroso group are 32.0 and 31.0 kcal/mol for trans- and cis-NNK in the gas phase, respectively. Computations also suggested that the pyridyl group was able to bind to the endohedral Lewis acidic tungsten. However, the interaction (17.9 kcal/mol) was only about half as strong as that between the nitrosamine and tungsten. It was envisioned that the interaction between the receptor monomer and NNK can promote the adsorption of NNK into the porous polymer.

Figure 7A:
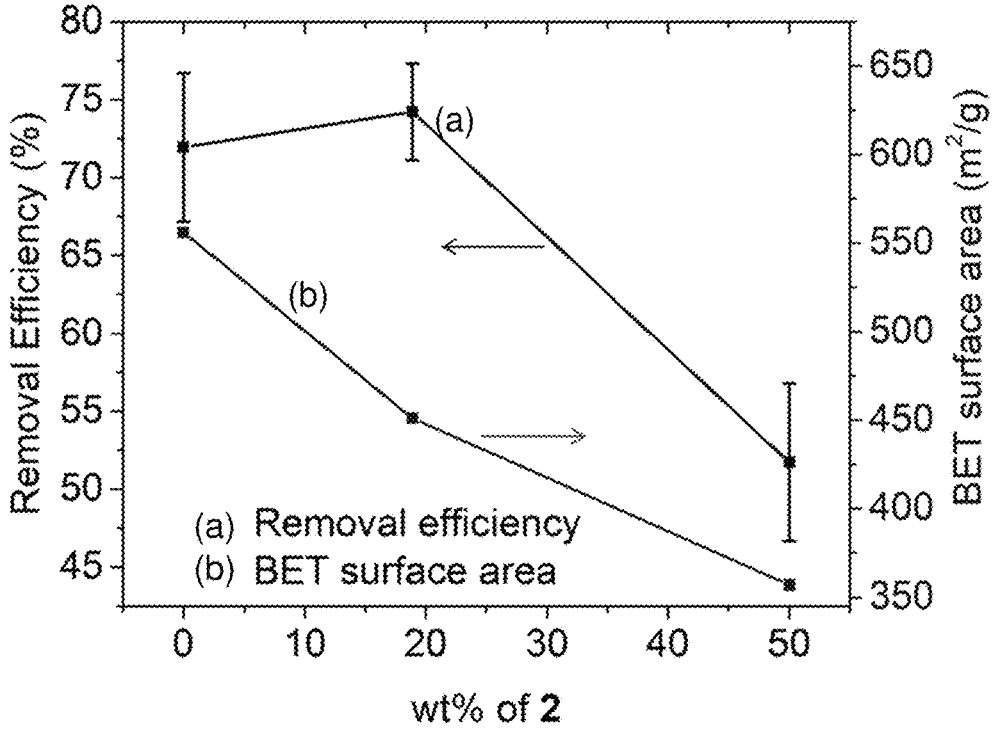
FIG. 7A shows, according to certain embodiments, NNK removal efficiencies and Brunauer, Emmett, and Teller (BET) surface areas of polymers P1, P2, and P3.
Figure 7B:
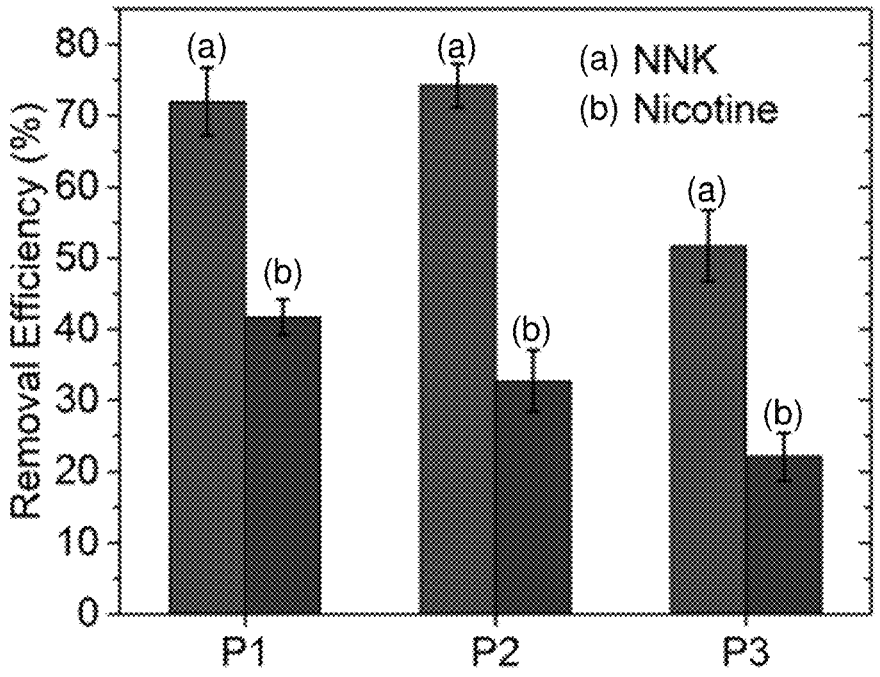
FIG. 7B shows, according to certain embodiments, a comparison between NNK and nicotine removal efficiencies of polymers P1, P2, and P3.
Figure 7C:
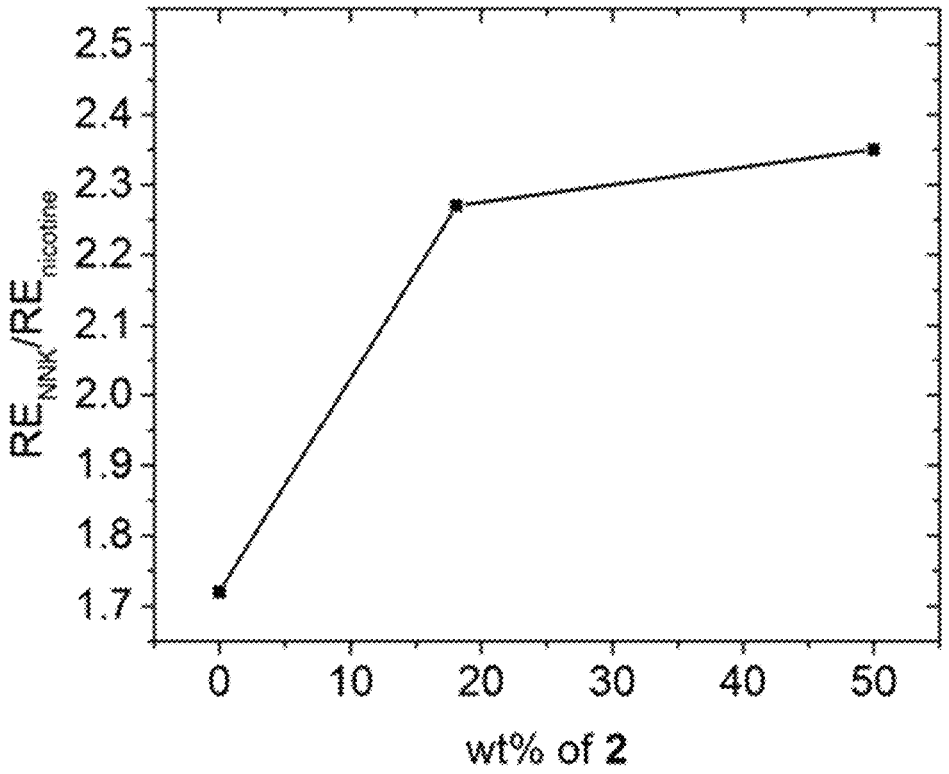
FIG. 7C shows, according to certain embodiments, selectivity factors where RE is removal efficiency.
Figure 22A:
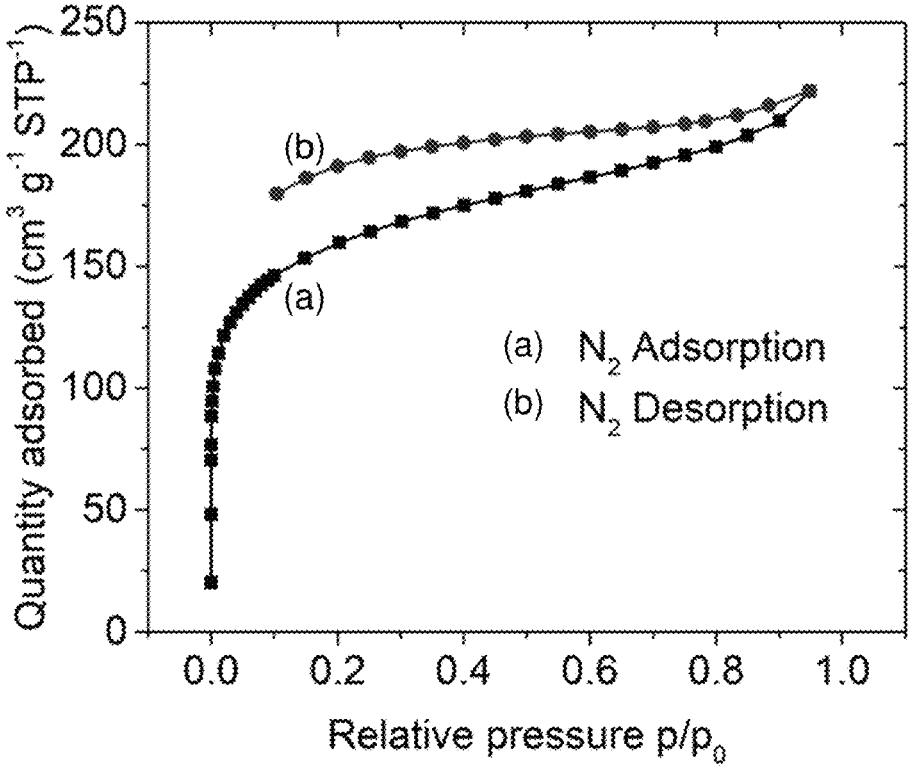
FIG. 22A shows, according to certain embodiments, $N_2$ adsorption-desorption isotherms of polymer P1.
Figure 22B:
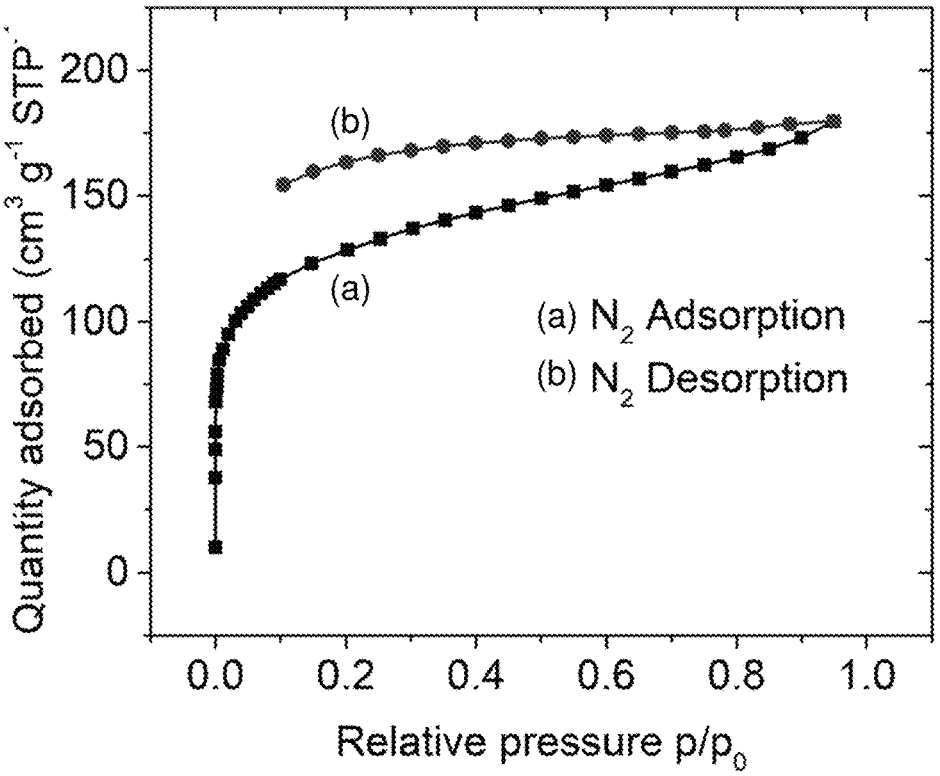
FIG. 22B shows, according to certain embodiments, $N_2$ adsorption-desorption isotherms of polymer P2.
Figure 22C:
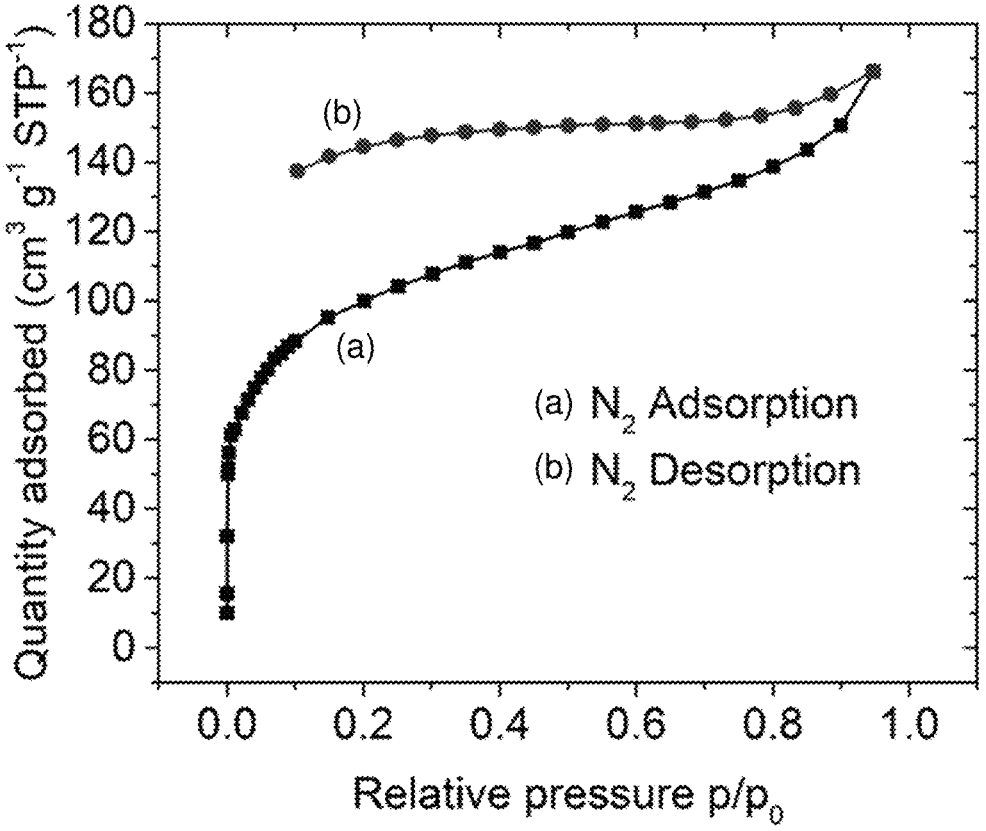
FIG. 22C shows, according to certain embodiments, $N_2$ adsorption-desorption isotherms of polymer P3.
Figure 22D:
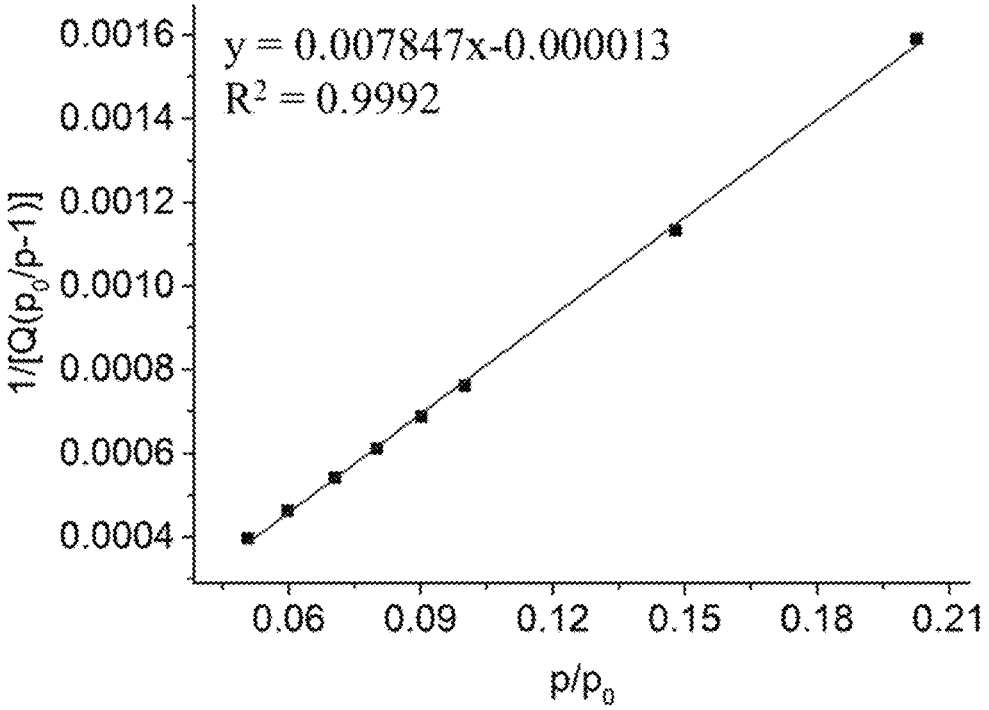
FIG. 22D shows, according to certain embodiments, BET linear fitting of $1/[Q(p_0/p-1)]$ against $p/p_0$ from 0.05 to 0.2 for $N_2$ adsorption isotherms of polymer P1.
Figure 22E:
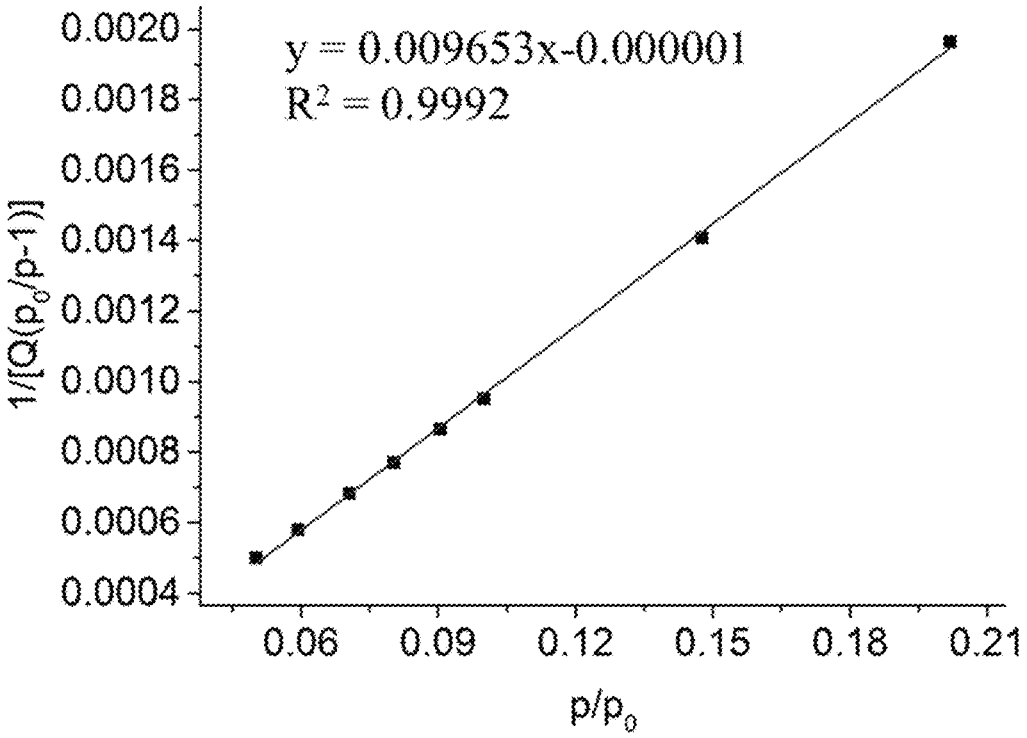
FIG. 22E shows, according to certain embodiments, BET linear fitting of $1/[Q(p_0/p-1)]$ against $p/p_0$ from 0.05 to 0.2 for $N_2$ adsorption isotherms of polymer P2.
Figure 22F:
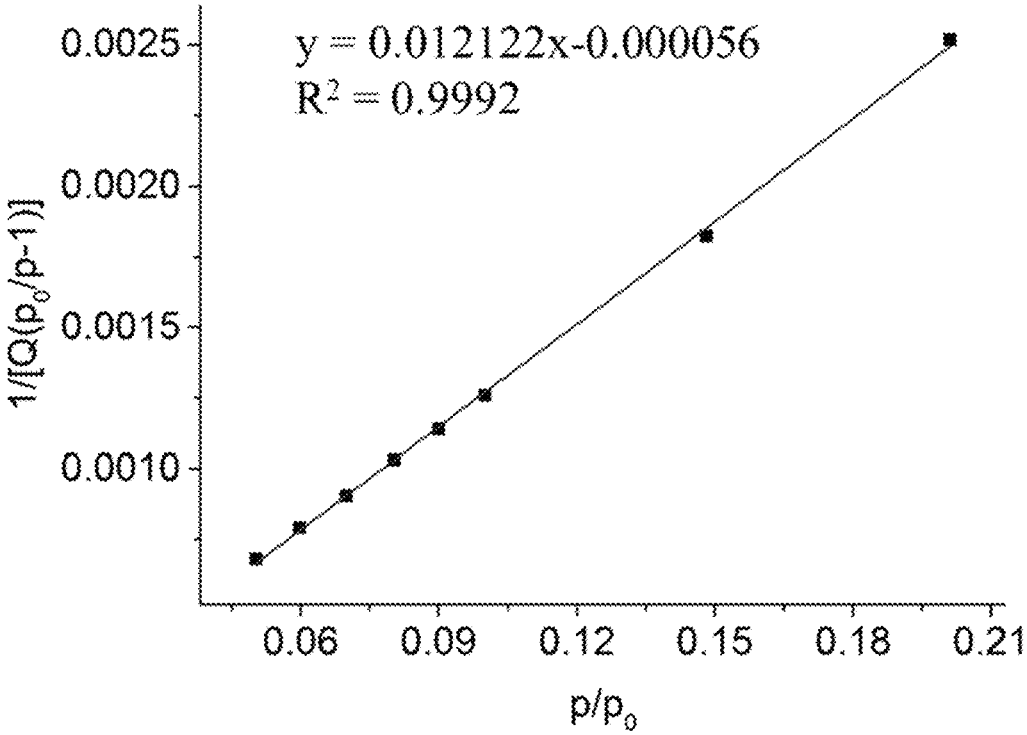
FIG. 22F shows, according to certain embodiments, BET linear fitting of $1/[Q(p_0/p-1)]$ against $p/p_0$ from 0.05 to 0.2 for $N_2$ adsorption isotherms of polymer P3.
Figure 22G:
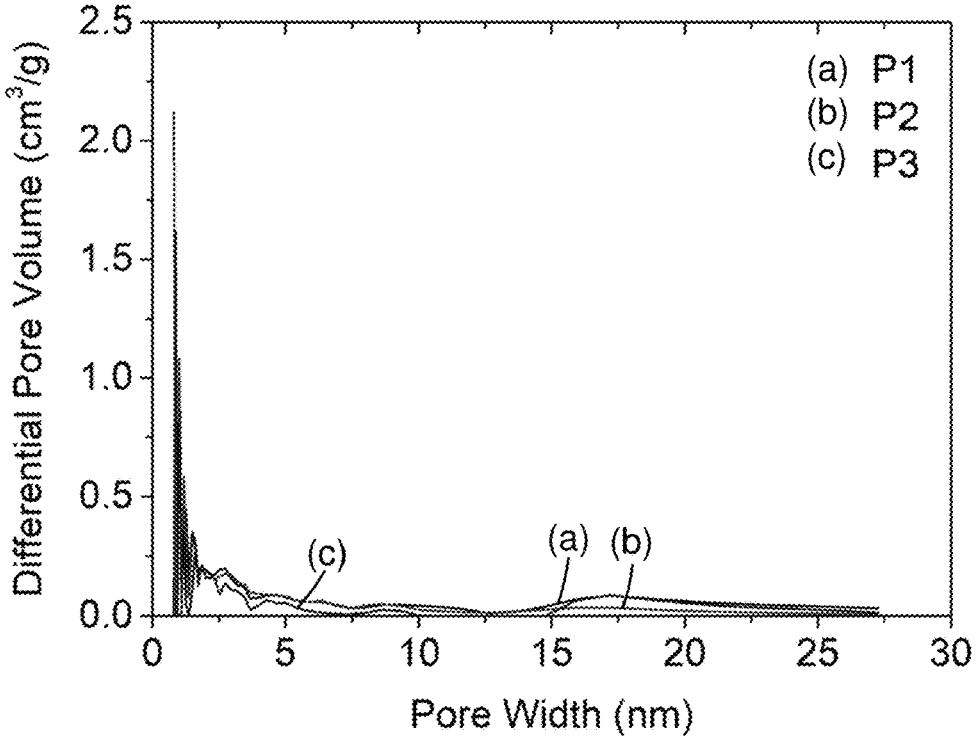
FIG. 22G shows, according to certain embodiments, pore-size distribution of polymers P1, P2, and P3 for pore sizes 0 run to 30 nm.
Figure 22H:
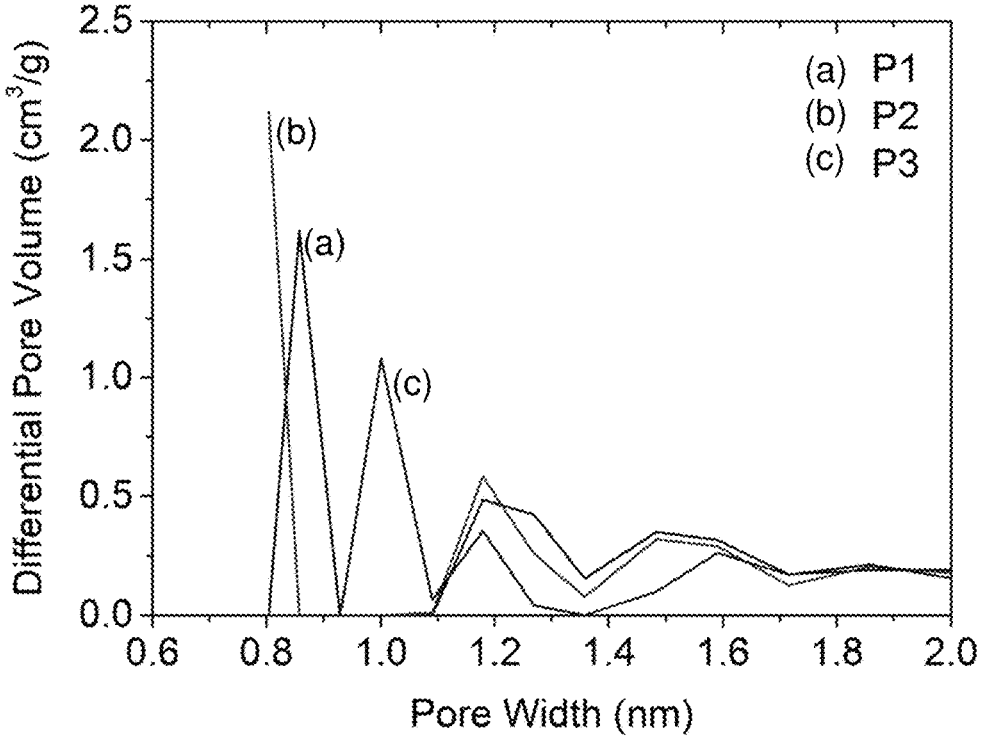
FIG. 22H shows, according to certain embodiments, pore-size distribution of polymers P1, P2, and P3 for pore sizes 0.6 nm to 2.0 nm.
Figure 22I:
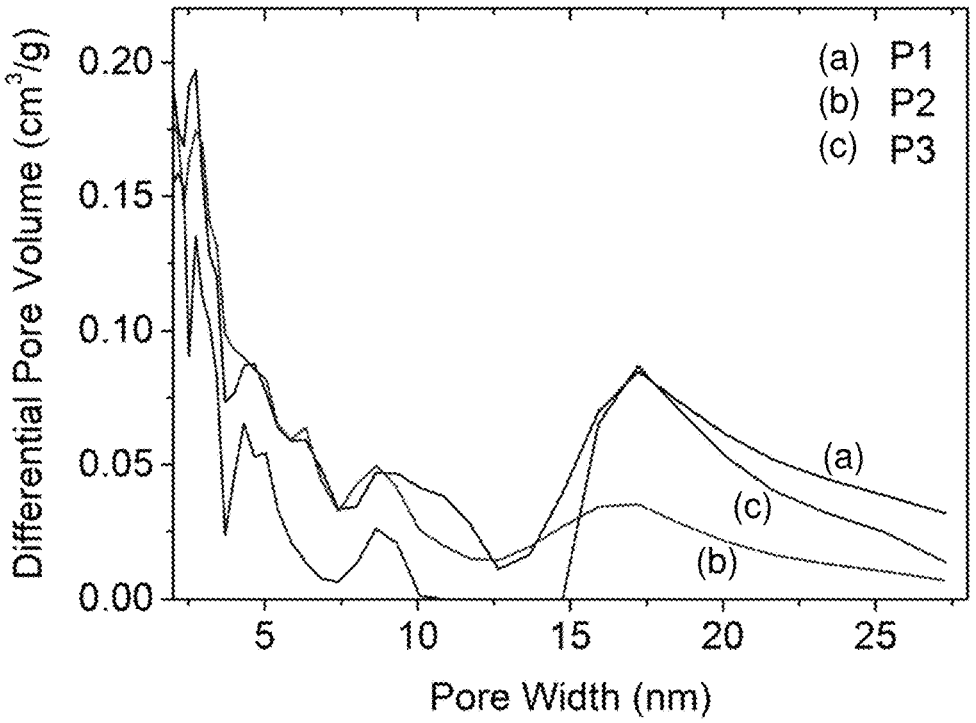
FIG. 22I shows, according to certain embodiments, pore-size distribution of polymers P1, P2, and P3 for pore sizes 2.0 nm to 28 nm.

The NNK extraction performance of both batches of polymers, P1, P2, and P3, was evaluated. The polymers were suspended in NNK solution (100 ppm, $D_2O$) in NMR tubes. The suspension was then sonicated for 30 minutes. The removal efficiency was determined by $^1$H-NMR using sodium methanesulfonate as an internal standard (FIGS. 14A-16B). In FIGS. 14A-16B, the conditions were 100 ppm NNK in 0.5 mL $D_2O$, 0.3 mg of adsorbent, and sonication for 30 minutes. The results are summarized in FIGS. 7A-7C. In FIG. 7A, the removal efficiencies are an average value of six trials based on two different batches of polymers. The NNK removal efficiency of P2, which has 18.9 wt. % of receptor monomer 2, is comparable to that of calixarene-free polymer (P1). Further increase in wt. % of the receptor monomer 2 decreases the removal efficiency. To understand these results, Brunauer-Emmett-Teller (BET) surface areas were measured (Table 1, FIGS. 7A and 22A-22F). The surface area of the polymers decreases with increasing amount of receptor monomer 2 (i.e., 556 $m^2$/g for P1, 451 $m^2$/g fir P2, and 357 $m^2$/g for P3). All three polymers show a broad distribution of pore size from the mesopore region to more than 27 nm (FIGS. 22G-22I). Although the BET surface area of P2 is lower than that of the calixarene-free polymer P1, the removal efficiency of P2 is comparable to that of P1 One possible reason for this observation is that the incorporation of the metallocalix[4]arene provides binding sites and therefore facilitates NNK extraction. The lower removal efficiency towards NNK of P3 than those of P1 and P2 may be partly attributed to a further reduction in surface area.

To further demonstrate the advantages of introducing the receptor, the selectivity of the three polymers towards NNK was determined. Nicotine was used as an example of a potential interferent, because it is present in tobacco at much higher concentrations. The selectivity factor was defined as the ratio of removal efficiencies of NNK and nicotine. With increasing wt. % of the receptor monomer, the selectivity factor increases from 1.7 for P1 to 2.4 for P3 (FIG. 7C), indicating the introduction of the metallocalix[4]arene can indeed increase the selectivity towards NNK. Considering a balance between removal efficiency and selectivity, P2 was used for further characterization.

Figure 8A:
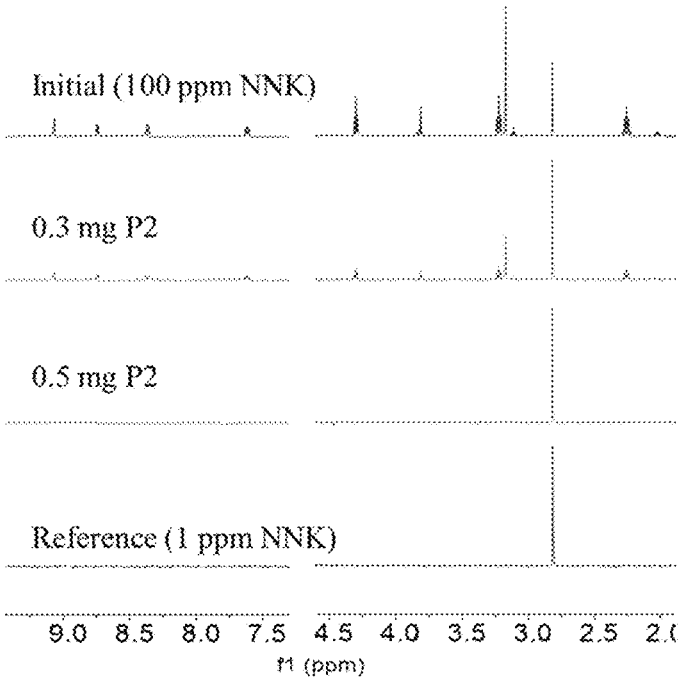
FIG. 8A shows, according to certain embodiments, $^1$H-NMR spectra of NNK solutions before and after extraction with different concentrations of polymer P2.
Figure 8B:
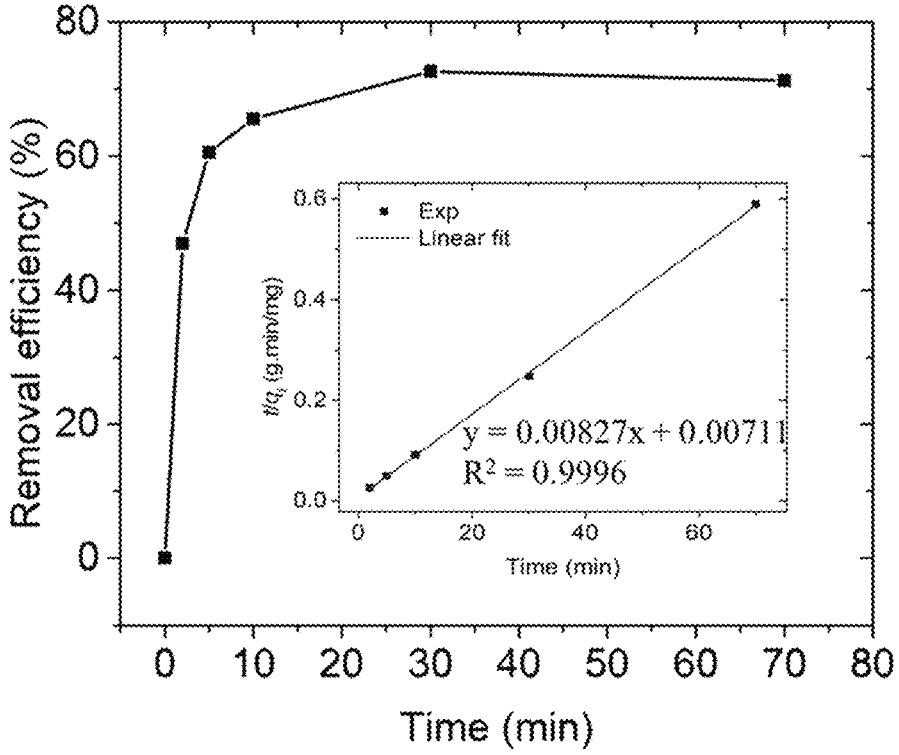
FIG. 8B shows, according to certain embodiments, NNK removal kinetics of polymer P2.
Figure 8C:
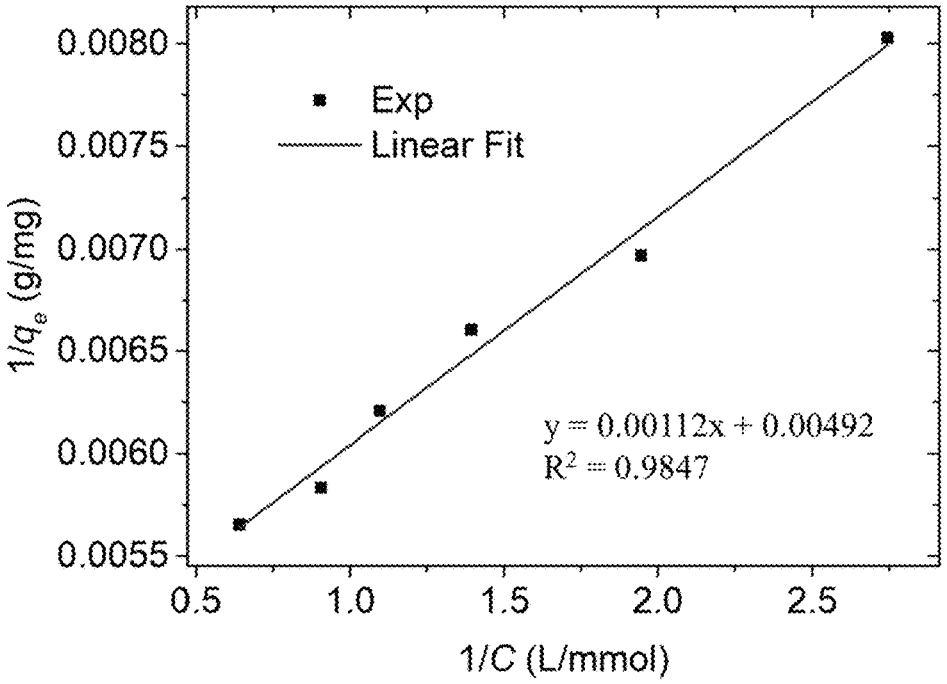
FIG. 8C shows, according to certain embodiments, a thermodynamic fit.
Figure 21:
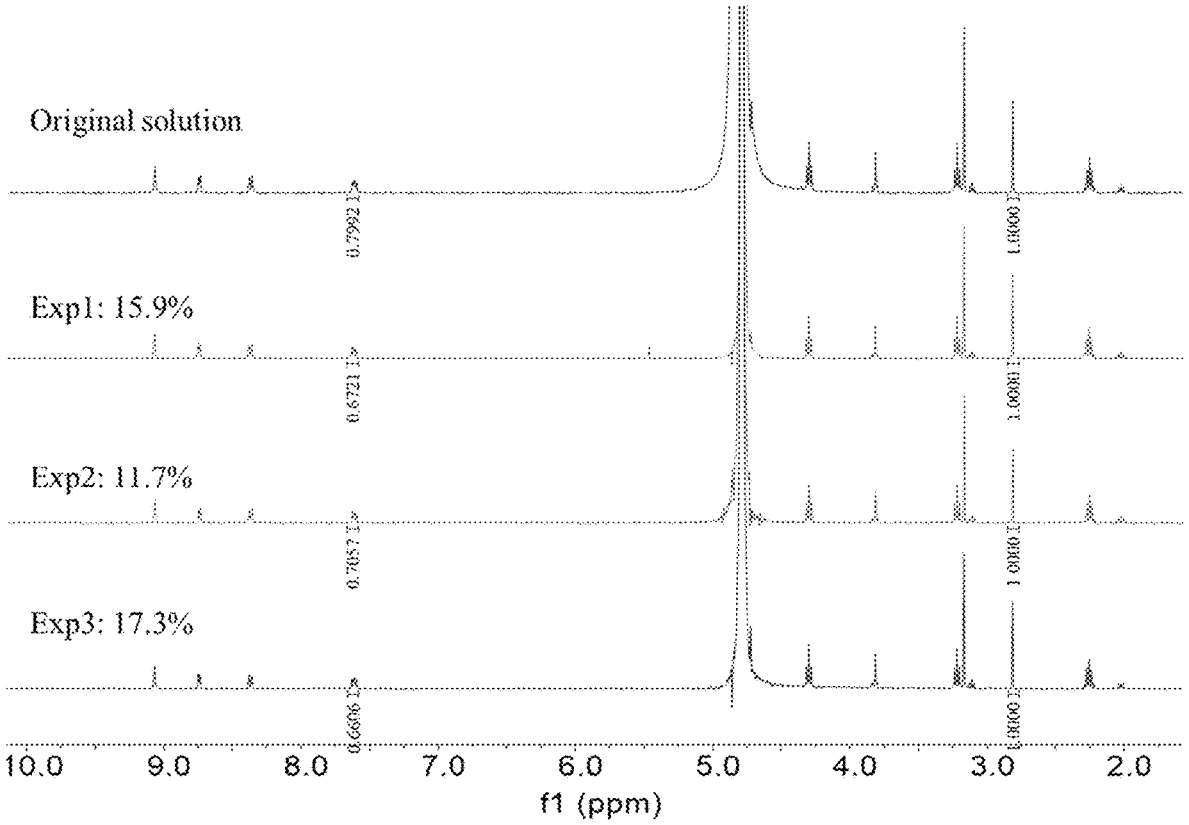
FIG. 21 shows, according to certain embodiments, $^1$H-NMR spectra of NNK solution before and after extraction with Carboxen Adsorbent.
Figure 23:
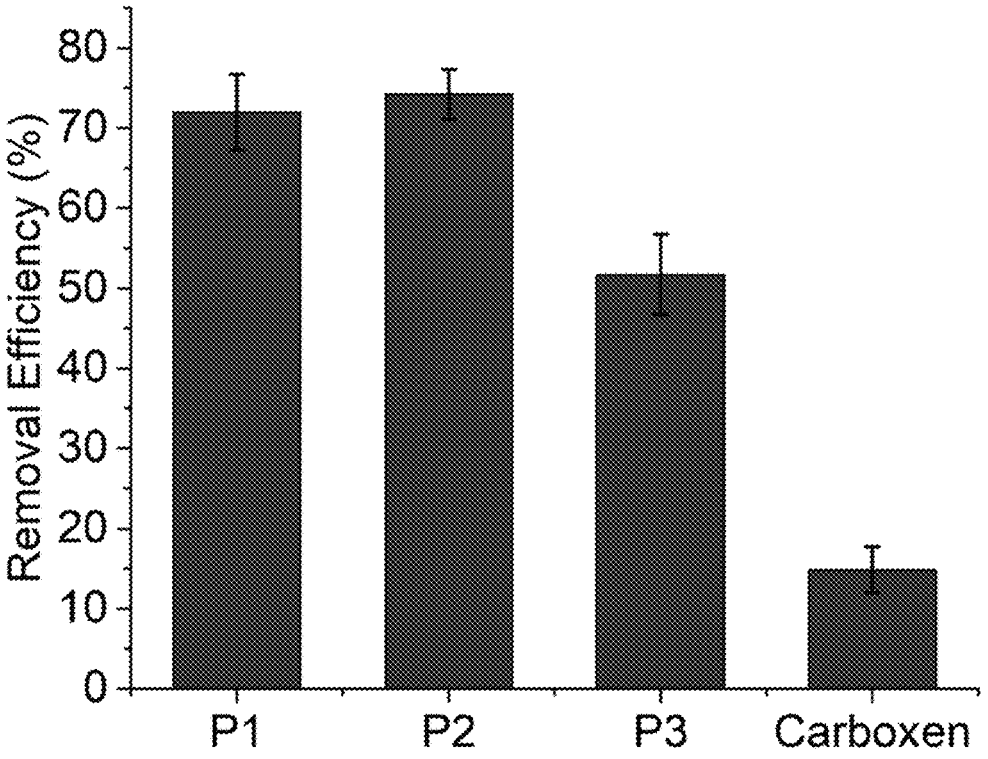
FIG. 23 shows, according to certain embodiments, removal efficiencies of P1-P3 and Carboxen Adsorbent towards NNK.
Figure 24A:
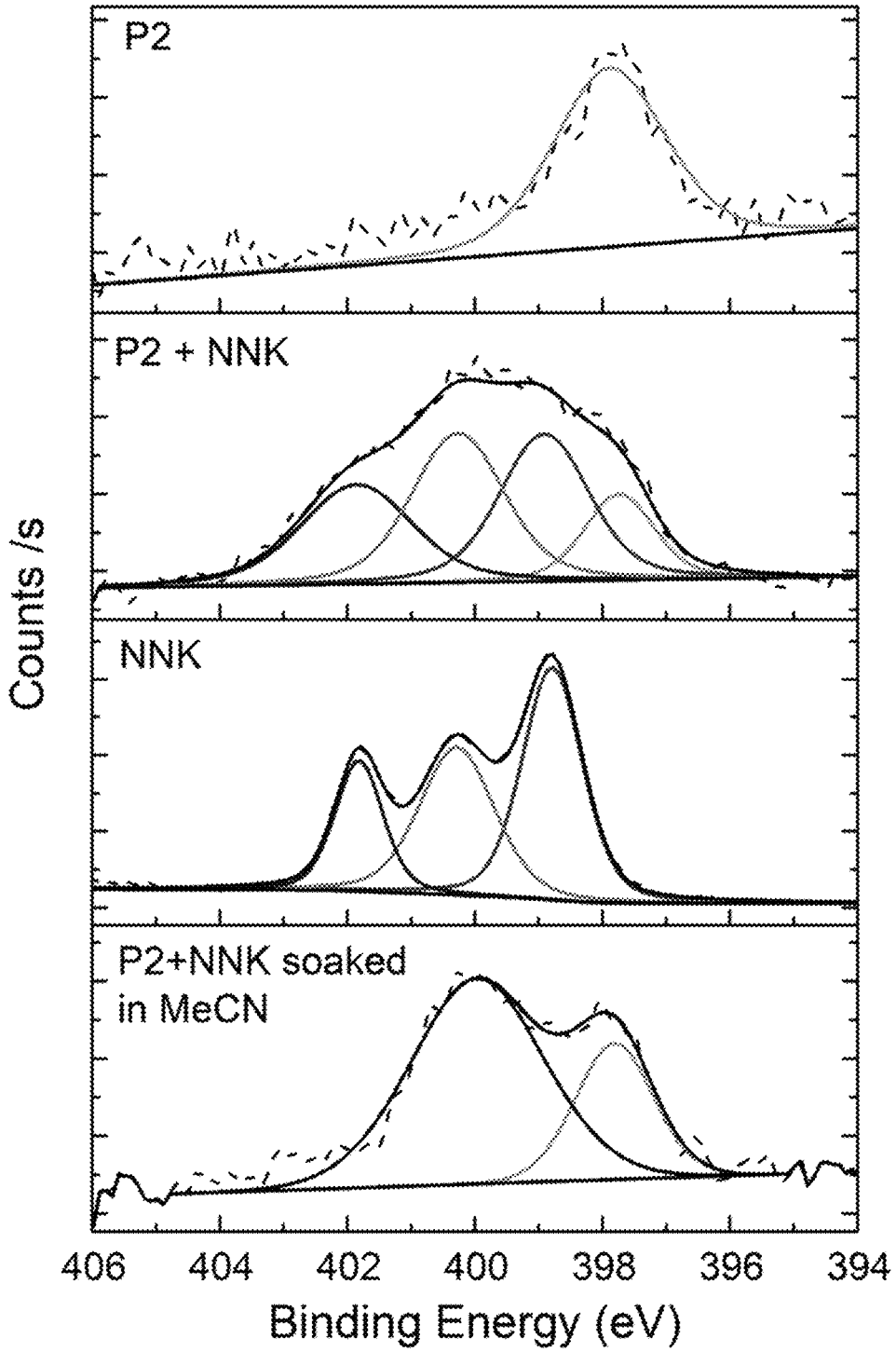
FIG. 24A shows, according to certain embodiments, XPS N is spectra of P2, P2+NNK, NNK, and P2+NNK soaked in acetonitrile (MeCN)
Figure 24B:
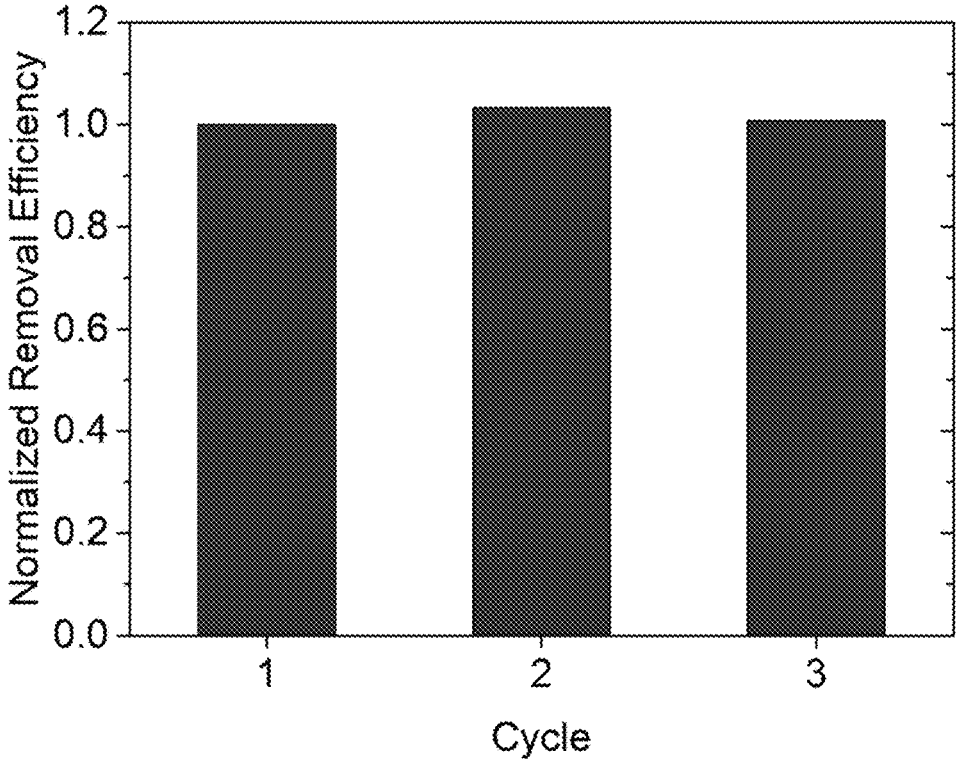
FIG. 24B shows, according to some embodiments, the recyclability of using P2 as an adsorbent for NNK.
Figure 24C:
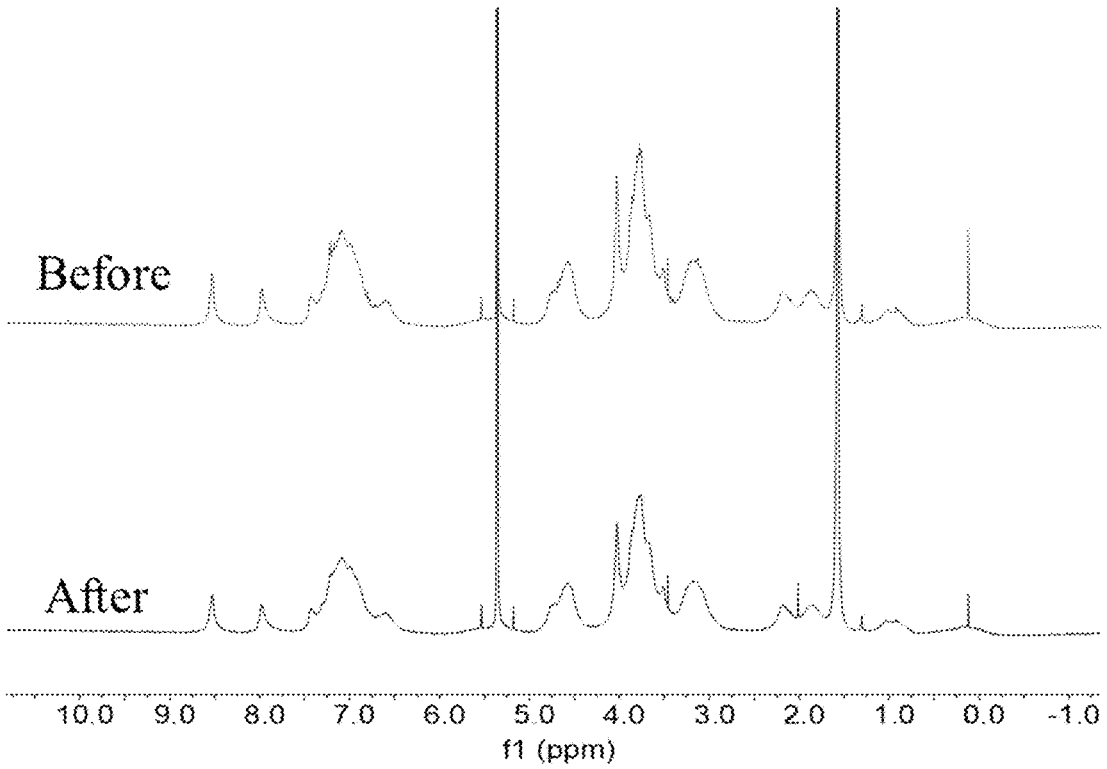
FIG. 24C shows, according to certain embodiments, $^1$H-NMR spectra of polymer P2 before and after two NNK extraction-desorption cycles.
Figure 24D:
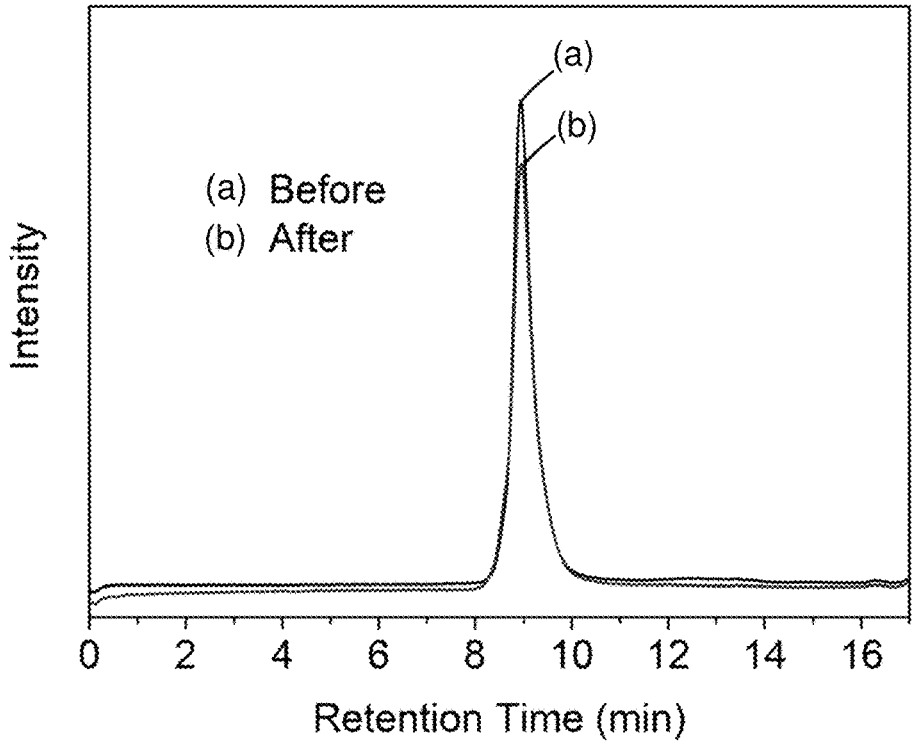
FIG. 24D shows, according to certain embodiments, gel permeation chromatography (GPC) traces of polymer P2 before and after two NNK extraction desorption cycles.
Figure 24E:
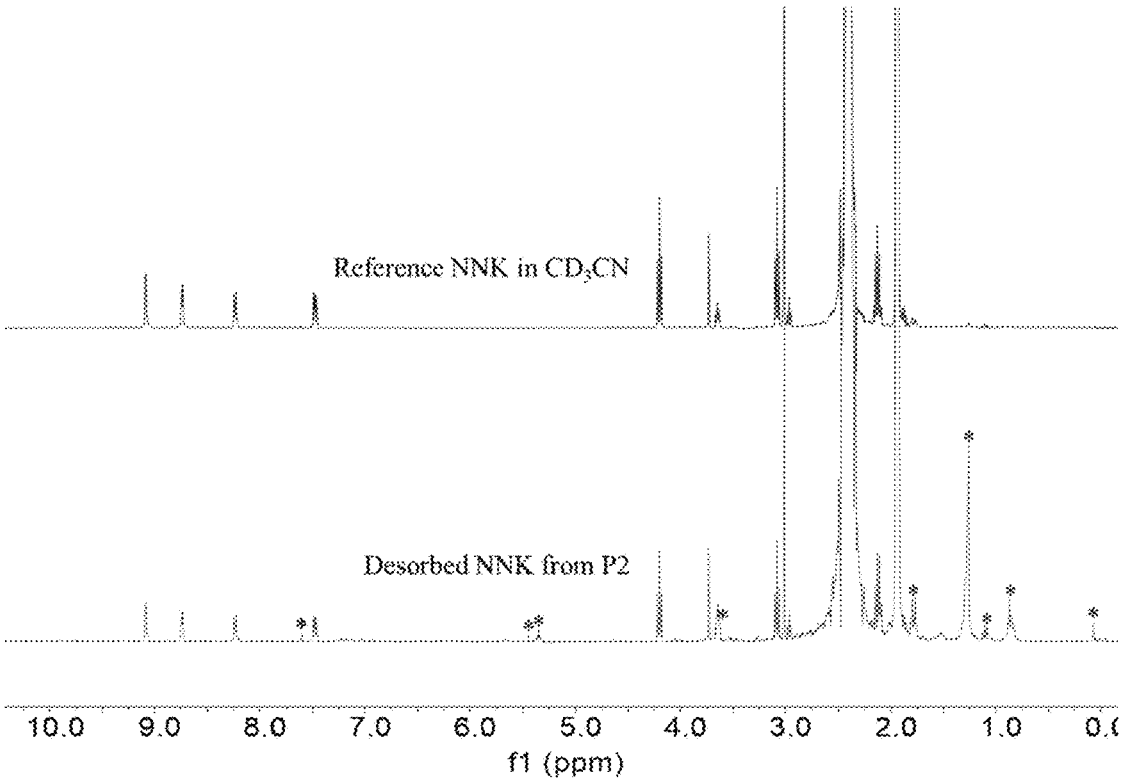
FIG. 24E shows, according to certain embodiments, $^1$H-NMR spectra of NNK and desorbed NNK in $CD_3CN$.

After determining the selectivity, the dependence of polymer concentration on the removal efficiency of NNK was examined and it was found that the use of a small amount of P2 results in high NNK removal efficiencies. For example, the removal efficiency reaches 74% and ~99% using polymer concentrations of 0.6 mg/ML and 1 mg/mL (FIG. 8A), respectively. In FIG. 8A, the conditions were 100 ppm NNK in $D_2O$, 0.5 mL, and sonication for 30 minutes. The adsorption kinetics of P2 towards NNK are very rapid. NNK adsorption equilibrates within 30 minutes for P2 (FIG. 8B), and the pseudo-second-order adsorption model provides a good correlation of the kinetic data, which gives an apparent adsorption rate constant of 9.6 $mg \cdot mg^{-1}min^{-1}$. In FIG. 8B, the conditions were 100 ppm NNK in $D_2O$ and 0.6 mg/mL P2. The extraction was also performed in NNK solutions of different concentrations to determine the maximum NNK adsorption capacity of P2. Using the Langmuir model, the adsorption equilibrium constant ($K_{eq}$) and the maximum adsorption capacity ($q_{max,e}$) were determined to be 4393 L/mol and 203 mg/g (FIG. 8C), respectively. In FIG. 8C, the conditions were 1 mg/mL P2, 0.5 mL NNK solution in $D_2O$, and sonication for 70 minutes. Note that the experimental maximum adsorption capacity is higher than the theoretical value (~48 mg/g) calculated from exclusive specific host-guest binding. This indicates that, at high concentrations, NNK is also adsorbed nonspecifically by the polymer. This was also observed for other polymer adsorbents based on host-guest interactions. Compared with previously reported materials such as imprinted polymers ($q_{max,e}$=1.7 mg/g), graphene aerogel ($q_{max,e}$=59.66 mg/g) and zeolite ($q_{max,e}$=70 mg/g), P2 shows much higher performance. The NNK removal efficiency of P2 also exceeds that of a commercial activated-carbon-based adsorbent (Carboxen Adsorbent, FIGS. 21 and 23). In FIGS. 21 and 23, the conditions were 100 ppm NNK in 0.5 $D_2O$, 0.3 mg of adsorbent, and sonication for 30 minutes. The high maximum adsorption capacity could be a synergistic effect of hydrophobicity of NNK, strong binding between NNK and the receptor within the polymer, and large surface area of the polymer. Furthermore, the adsorbed NNK can be desorbed by soaking the contaminated polymer in acetonitrile due to, for example, the large solubility of NNK in acetonitrile and the competing binding between acetonitrile and NNK to tungsten. The complete desorption of NNK was confirmed by X-ray photoelectron spectroscopy and $^1H$ NMR spectra (FIGS. 24A and 24E). In FIG. 24A, for P2+NNK, P2 on a silicon wafer was soaked in NNK water solution (100 ppm) for ~2 hours, and for P2+NNK soaked in MeCN, P2+NNK was soaked in MeCN for ~3 hours. In FIG. 24E, 1.0 mg/mL P2 in 2 mL 100 ppm NNK in $D_2O$ was sonicated for 40 minutes, and the solid was collected by filtration and dried under vacuum overnight. The solid was then suspended in $CD_3CN$ and sonicated for 5 minutes, and removed by filtration through a Nylon syringe filter. The desorbed NNK was observed in the mother liquor. Peaks denoted with a star are from $CD_3CN$ or the syringe filter. After three extraction-desorption cycles, the extraction efficiency of P2 towards NNK did not show an obvious decrease (FIG. 24B). Meanwhile, P2 showed no observable decomposition after two recycles (FIGS. 24C and 24D).

Figure 17:
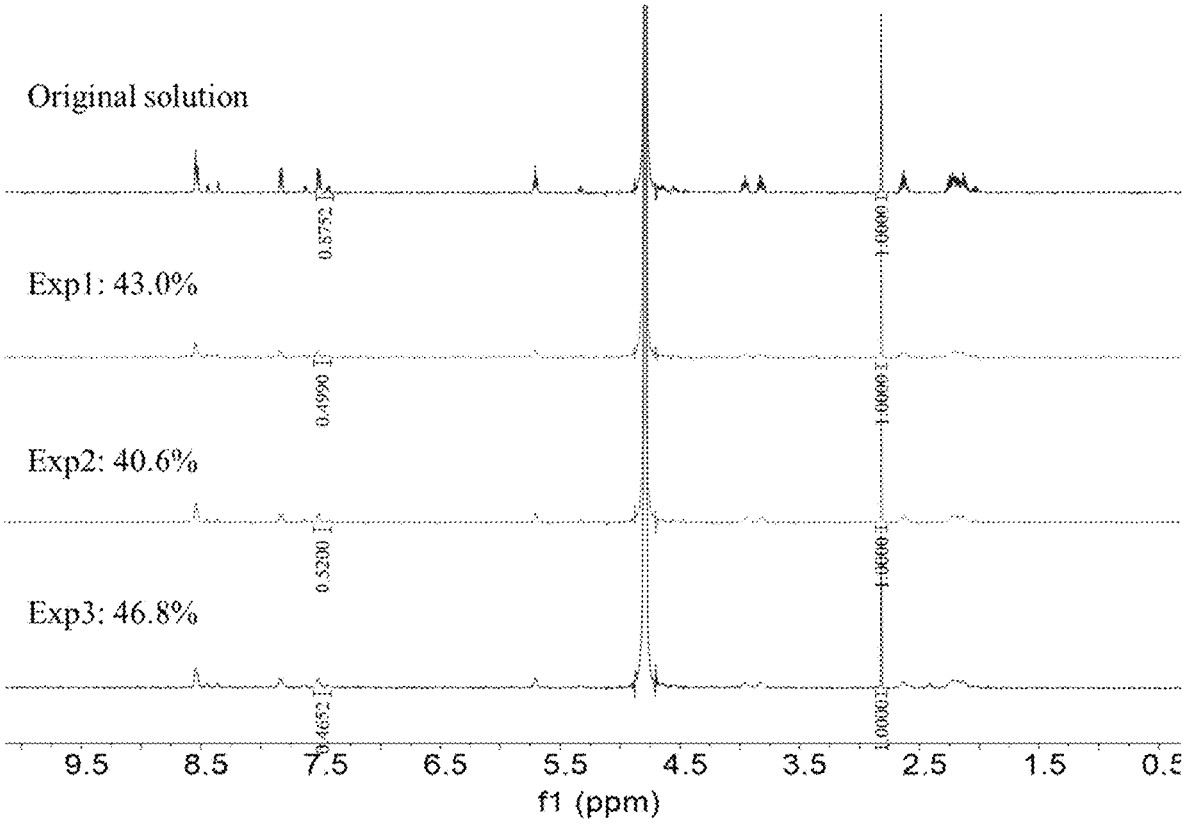
FIG. 17 shows, according to certain embodiments, $^1$H-NMR spectra of NNN solution before and after extraction with polymer P2.
Figure 18:
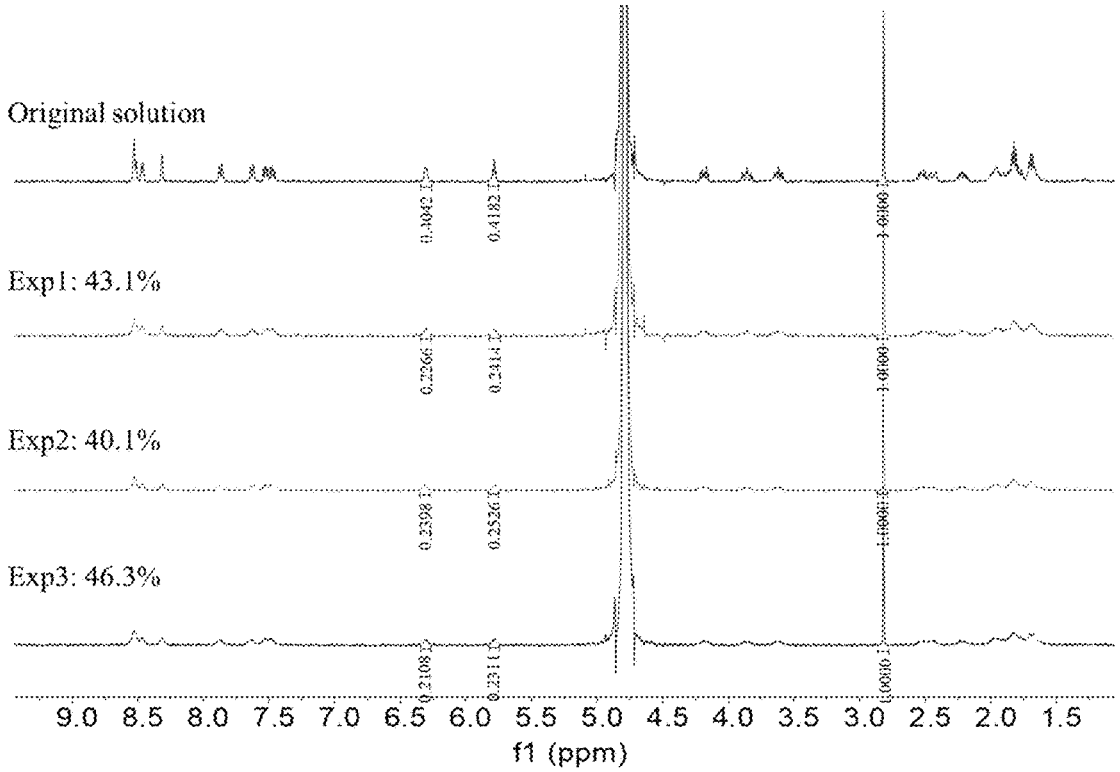
FIG. 18 shows, according to certain embodiments, $^1$H-NMR spectra of NAB solution before and after extraction with polymer P2.
Figure 19:
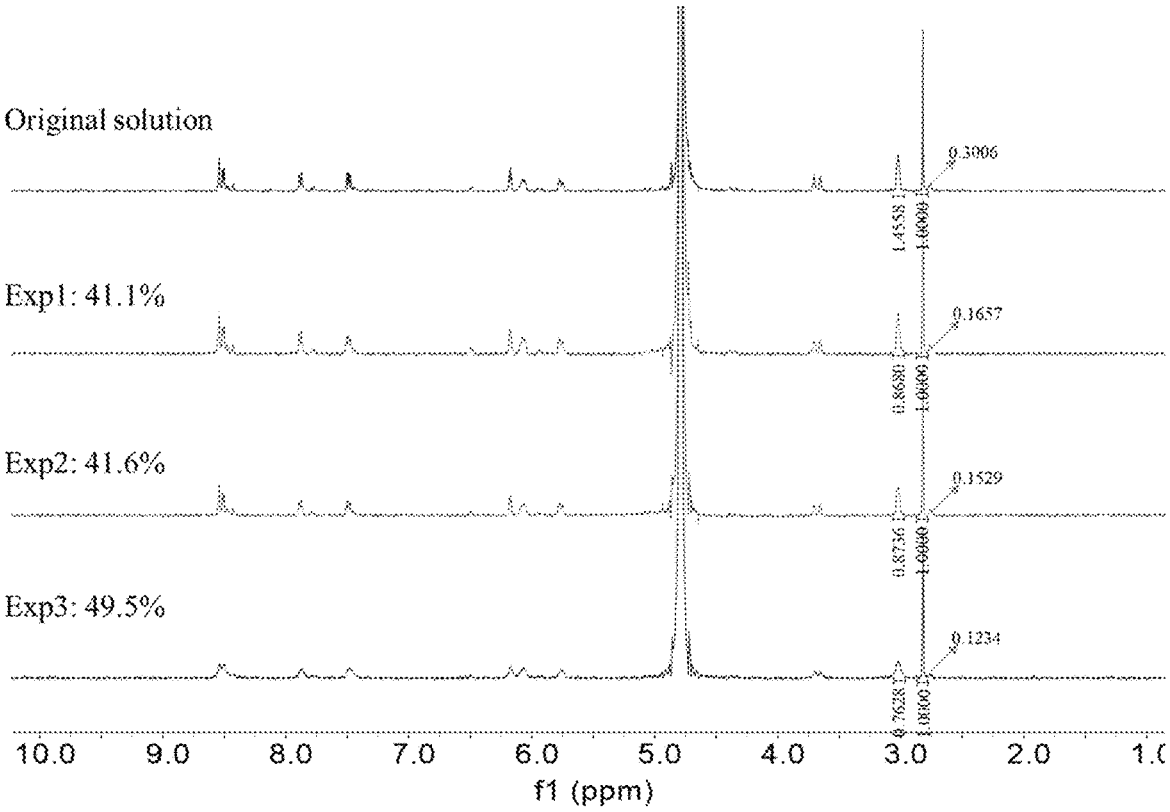
FIG. 19 shows, according to certain embodiments, $^1$H-NMR spectra of NAT solution before and after extraction with polymer P2.

The removal efficiencies of P2 towards TSNAs including NNN, NAB, and NAT were also determined (FIGS. 17-19). In FIG. 17, the conditions were 100 ppm NNN in 0.5 mL $D_2O$, 0.3 mg of adsorbent, and sonication for 30 minutes. The removal efficiencies shown in FIG. 17 are combined values for cis- and trans-NNN. In FIG. 18, the conditions were 100 ppm NAB in 0.5 mL $D_2O$, 0.3 mg of adsorbent, and sonication for 30 minutes. The removal efficiencies shown in FIG. 18 are combined values for cis- and trans-NAB. In FIG. 19, the conditions were 100 ppm NAT in 0.5 mL $D_2O$, 0.3 mg of adsorbent, and sonication for 30 minutes. The removal efficiencies shown in FIG. 19 are combined values for cis- and trans-NAT.

Figure 9A:
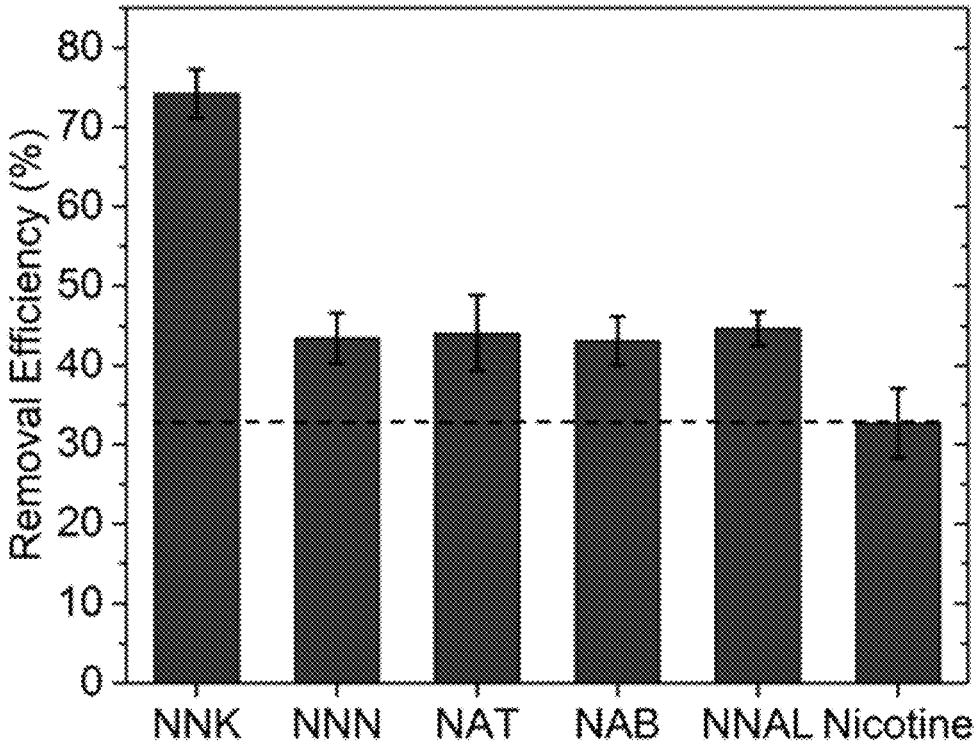
FIG. 9A shows, according to certain embodiments, removal efficiencies of polymer P2 towards NNK, rac-N'-nitrosonornicotine (NNN), (R,S)—N'-nitrosoanatabine (NAT), (R,S)—N'-nitrosoanabasine (NAB), rac-4-(methylnitrosamino)-1-(3-pyridyl)-1-butanol (NNAL), and (−)-nicotine.
Figure 20:
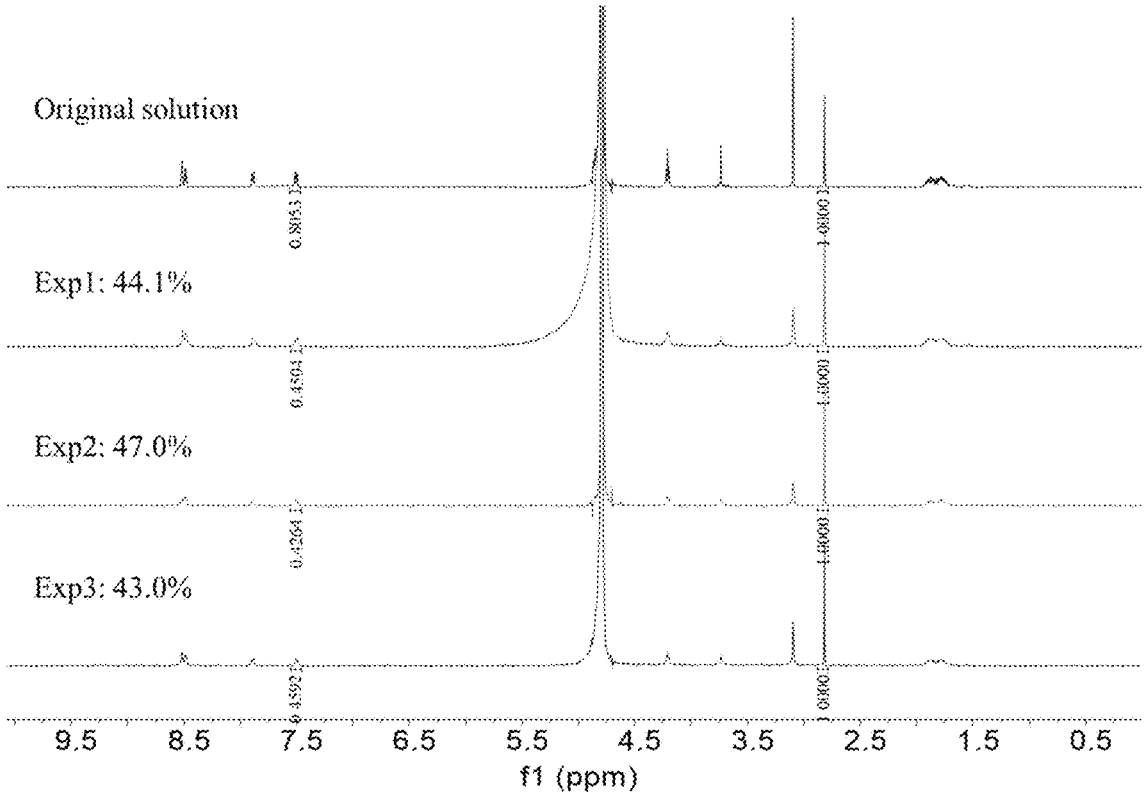
FIG. 20 shows, according to certain embodiments, $^1$H-NMR spectra of NNAL solution before and after extraction with polymer P2.
Figure 25A:
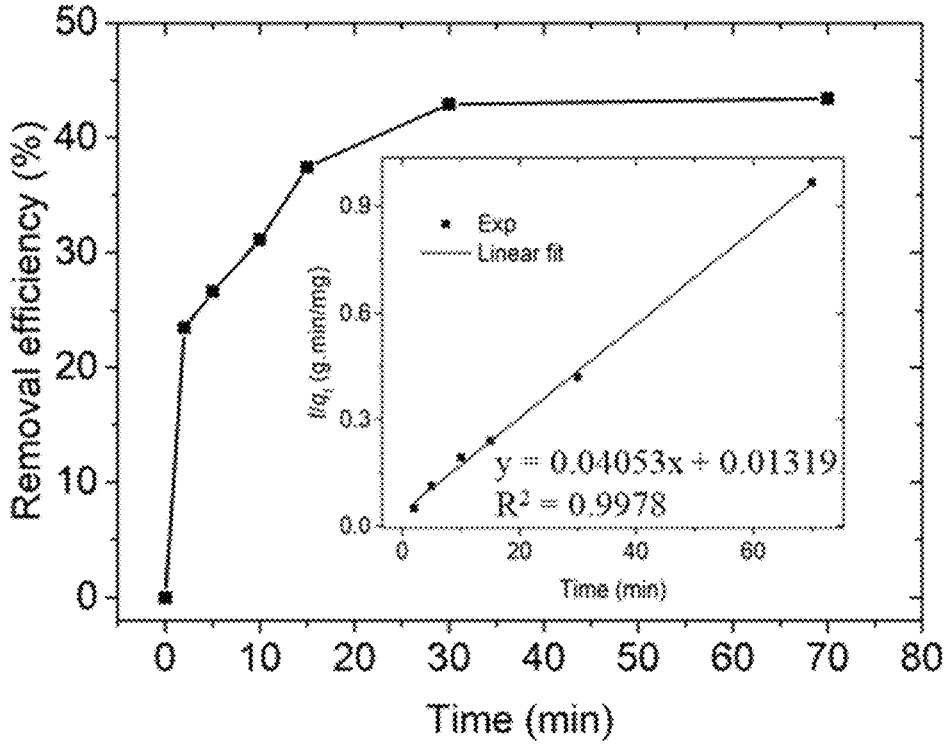
FIG. 25A shows, according to certain embodiments, NNN removal kinetics of polymer P2.
Figure 25B:
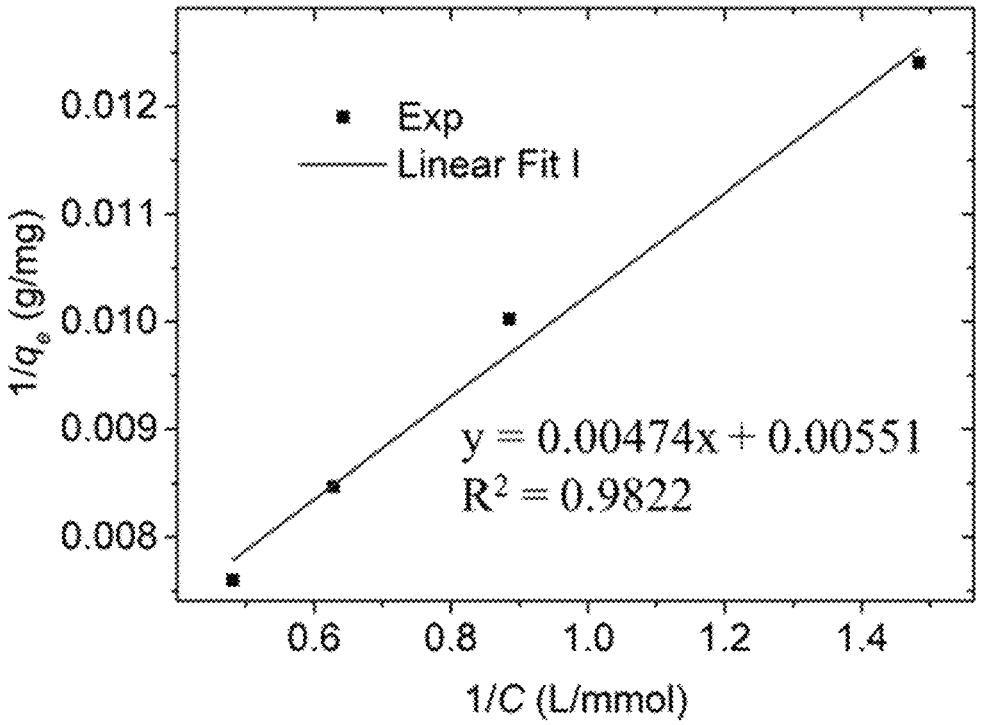
FIG. 25B shows, according to certain embodiments, a thermodynamic fit.

The removal efficiencies for these TSNAs are all higher than that determined for nicotine (FIG. 9A). In FIG. 9A, the conditions were 100 ppm in 0.5 mL $D_2O$, 0.3 mg P2, and sonication for 30 minutes. Particularly, the removal efficiency of NNK is about one-fold higher than that of nicotine. Since NNN is also listed as group 1 carcinogens by IARC, its adsorption kinetics and thermodynamics were investigated (FIGS. 25A-25B). In FIG. 25A, the conditions were 100 ppm NNN in $D_2O$ and 0.6 mg/mL P2. In FIG. 25B, the conditions were 1 mg/mL P2, 0.5 mL NNN solution in $D_2O$, and sonication for 70 minutes. The maximum adsorption capacity of P2 towards NNN was determined to be 181 mg/g, which is lower than that of NNK. NNAL (4-(methylnitrosamino)-1-(3-pyridyl)-1-butanol) is a metabolic product of NNK, and its concentration in human urine is a reliable method by which to evaluate NNK exposure for smokers and passive smokers. P2 also shows a high removal efficiency to NNAL (FIG. 20), but it is lower than that of NNK, probably due to the more hydrophilic nature of NNAL owing to the presence of hydroxyl group. In FIG. 20, the conditions were 100 ppm NNAL in 0.5 mL $D_2O$, 0.3 mg of adsorbent, and sonication for 30 minutes. Overall, the porous polymer with the nitrosamine receptor (P2) shows clear selectivity towards nitrosamines.

Figure 9B:
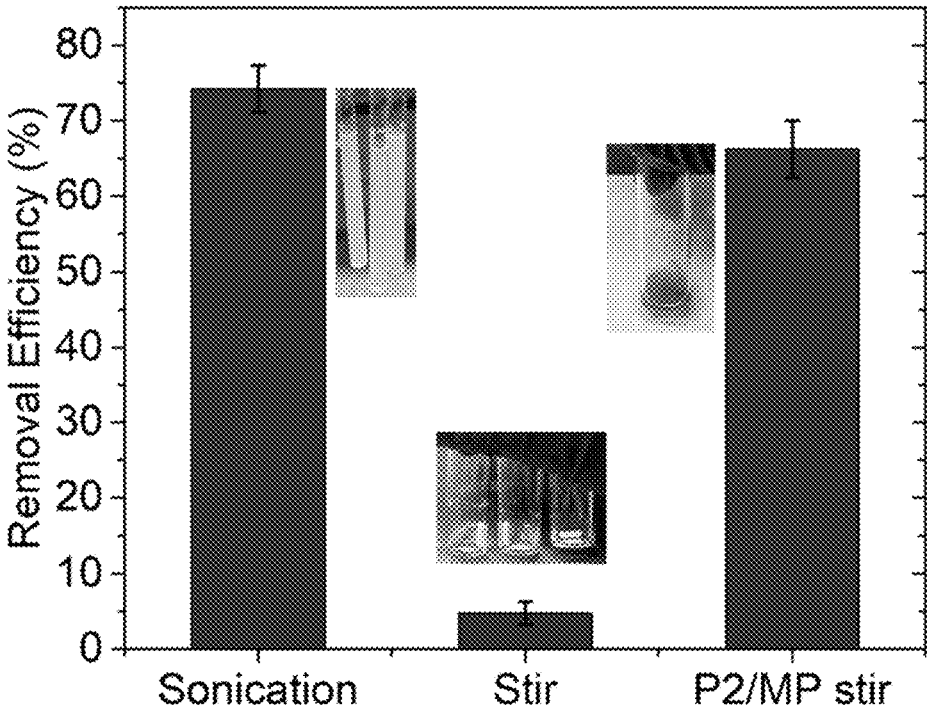
FIG. 9B shows, according to certain embodiments, removal efficiencies towards NNK under sonication and stir with polymer P2 and under stir with P2/magnetic particles (MPs)
Figure 26A:
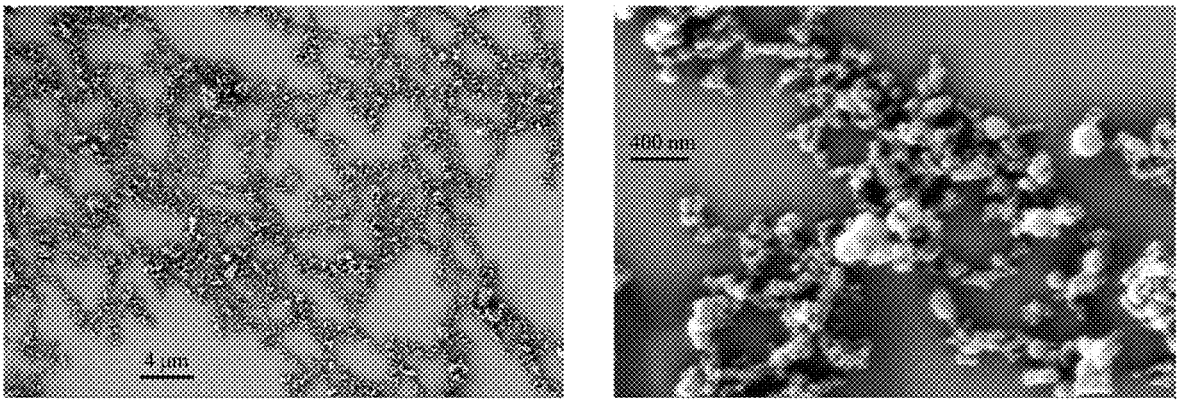
FIG. 26A shows, according to certain embodiments, scanning electron microscope (SEM) images of polymer P2 under sonication for 30 minutes in water.
Figure 26B:
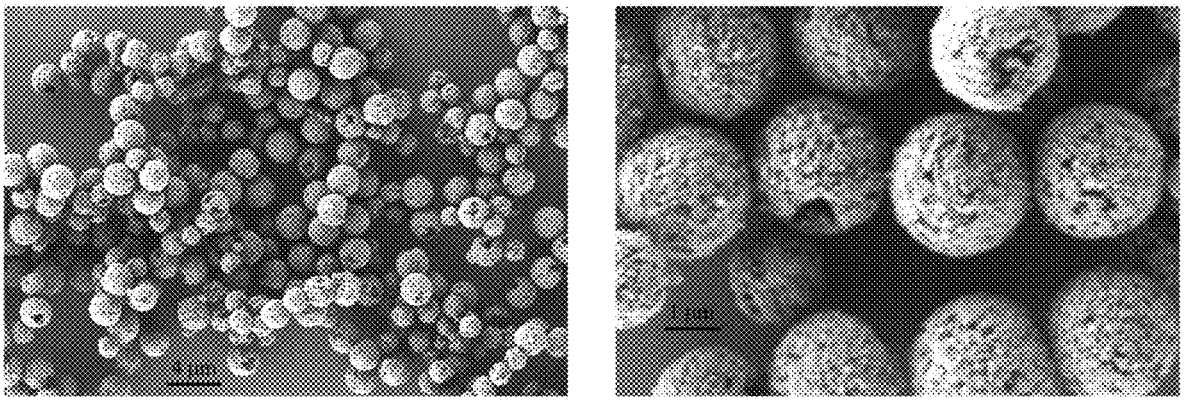
FIG. 26B shows, according to certain embodiments, SEM images of commercial MPs.
Figure 26C:
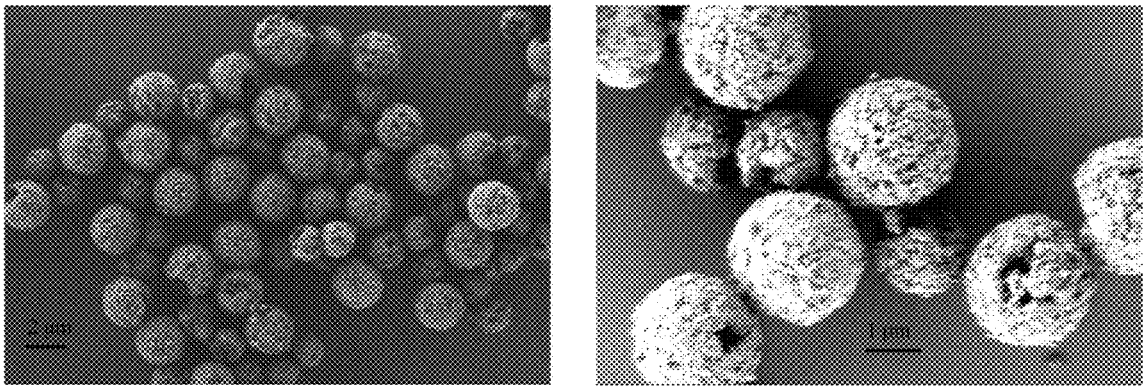
FIG. 26C shows, according to certain embodiments, SEM images of MPs coated with polymer P2.
Figure 27:
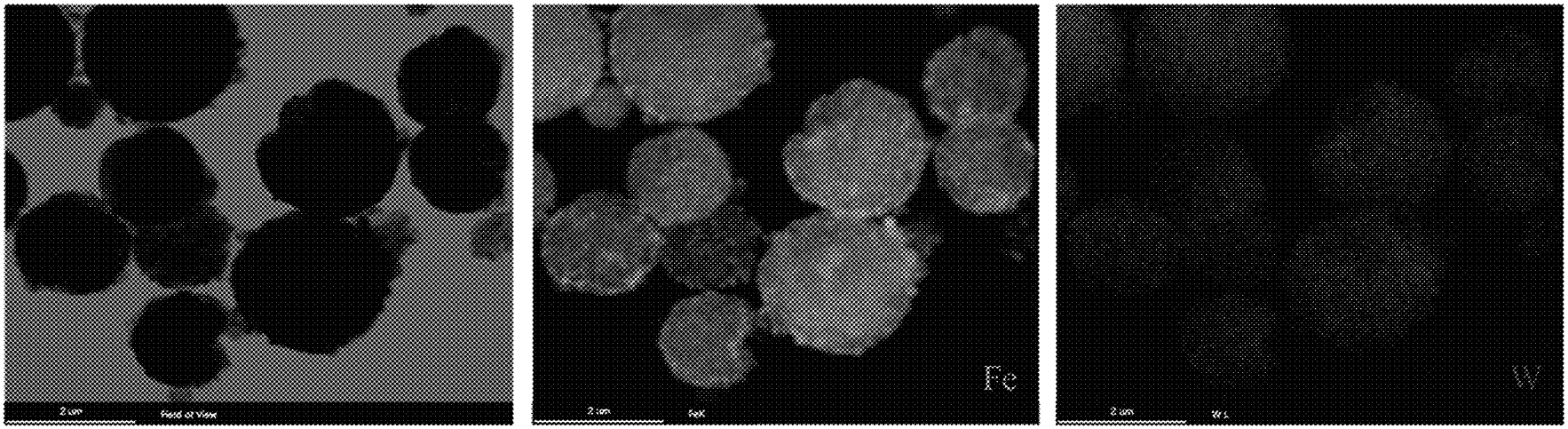
FIG. 27 shows, according to certain embodiments, transmission electron microscopy (TEM) images and TEM-energy dispersive x-ray spectroscopy (EDS) elemental mapping of MPs coated with polymer P2.
Figure 28A:
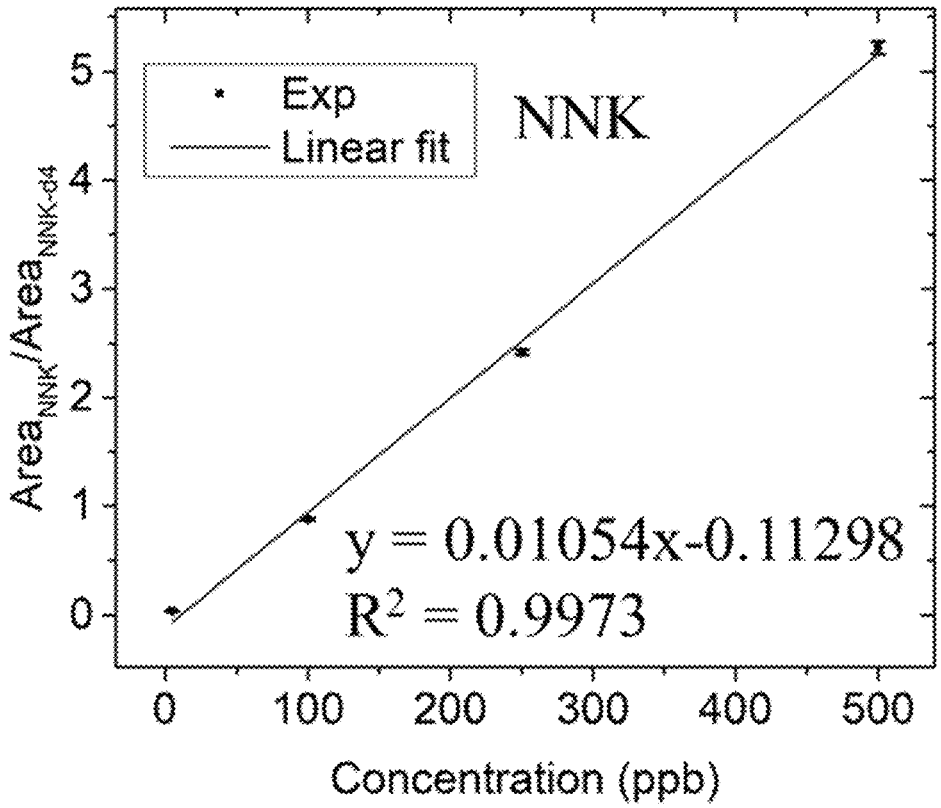
FIG. 28A shows, according to certain embodiments, a calibration curve for NNK.
Figure 28B:
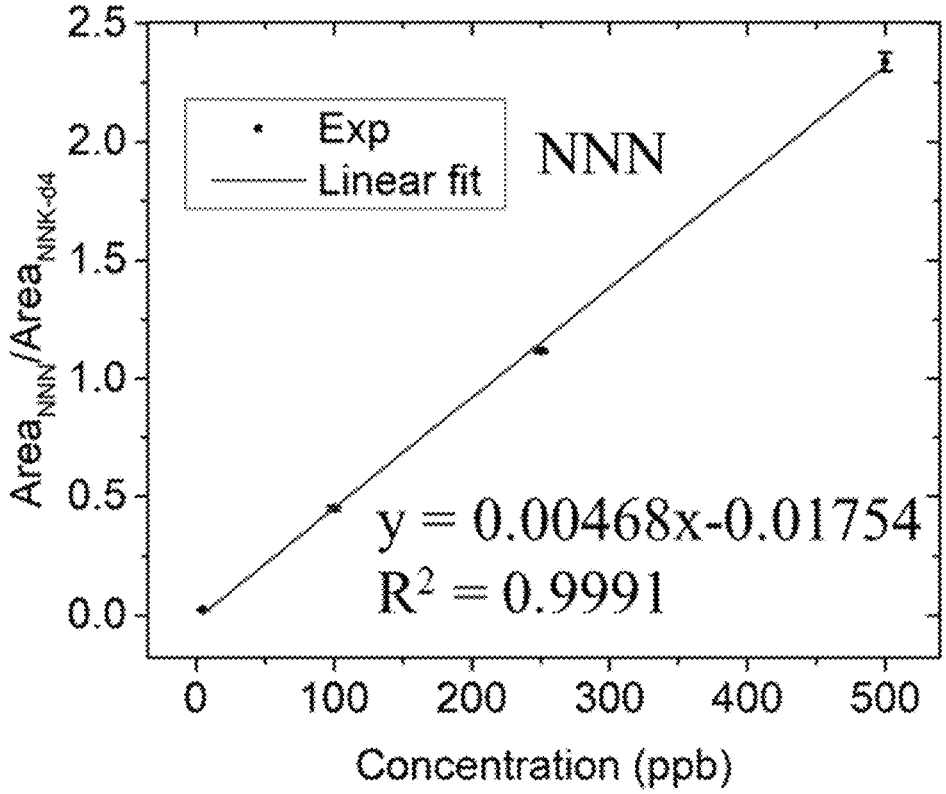
FIG. 28B shows, according to certain embodiments, a calibration curve for NNN.
Figure 28C:
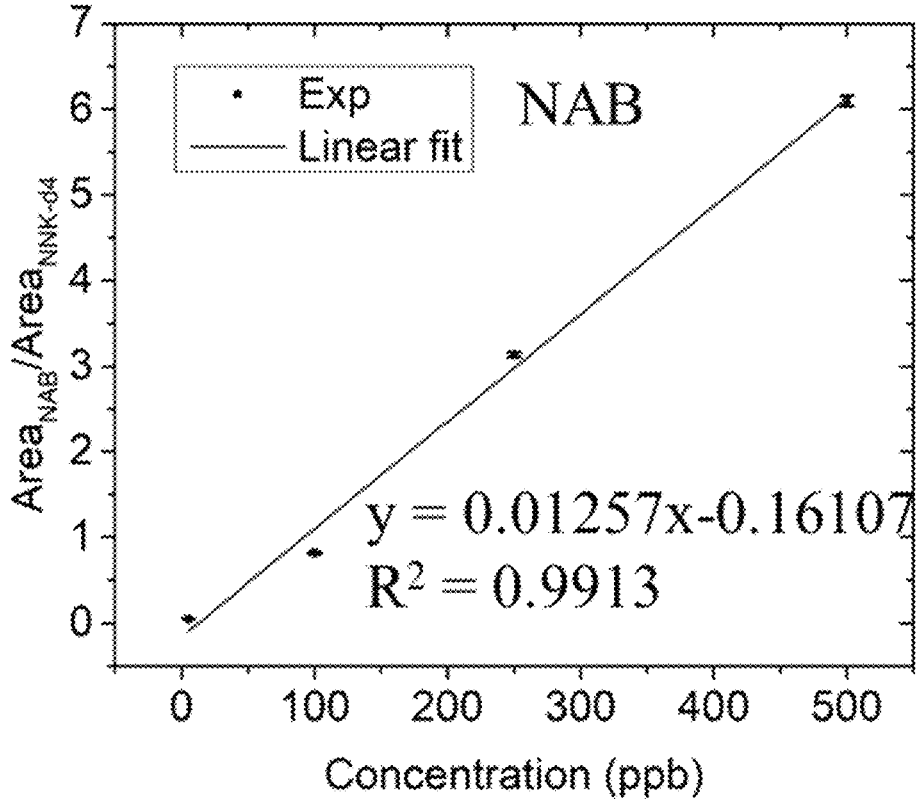
FIG. 28C shows, according to certain embodiments, a calibration curve for NAB.
Figure 28D:
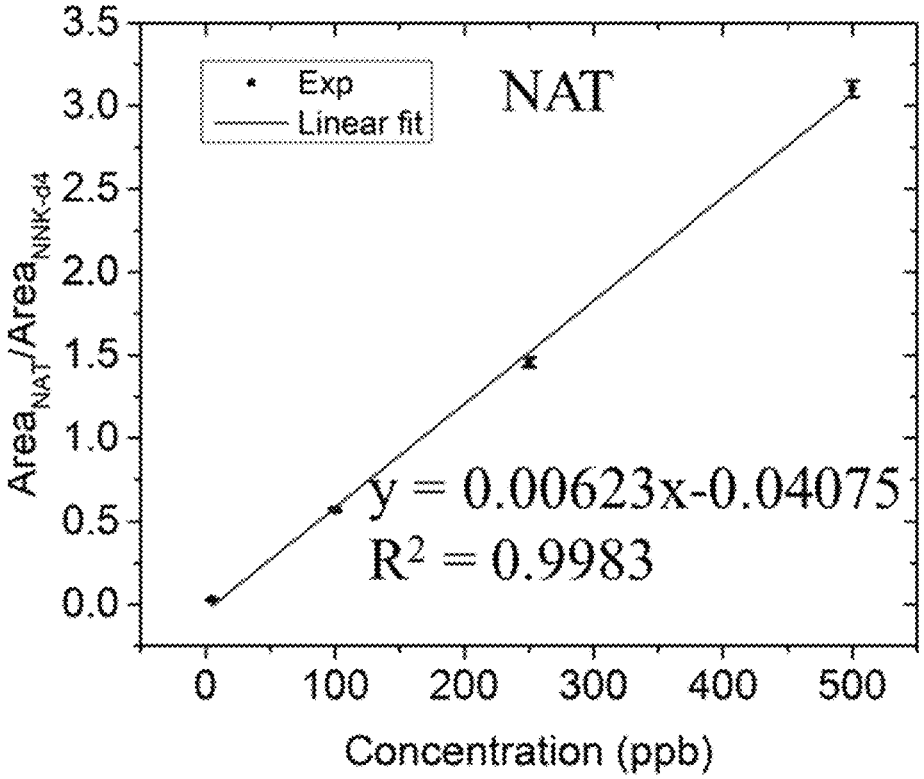
FIG. 28D shows, according to certain embodiments, a calibration curve for NAT.
Figure 28E:
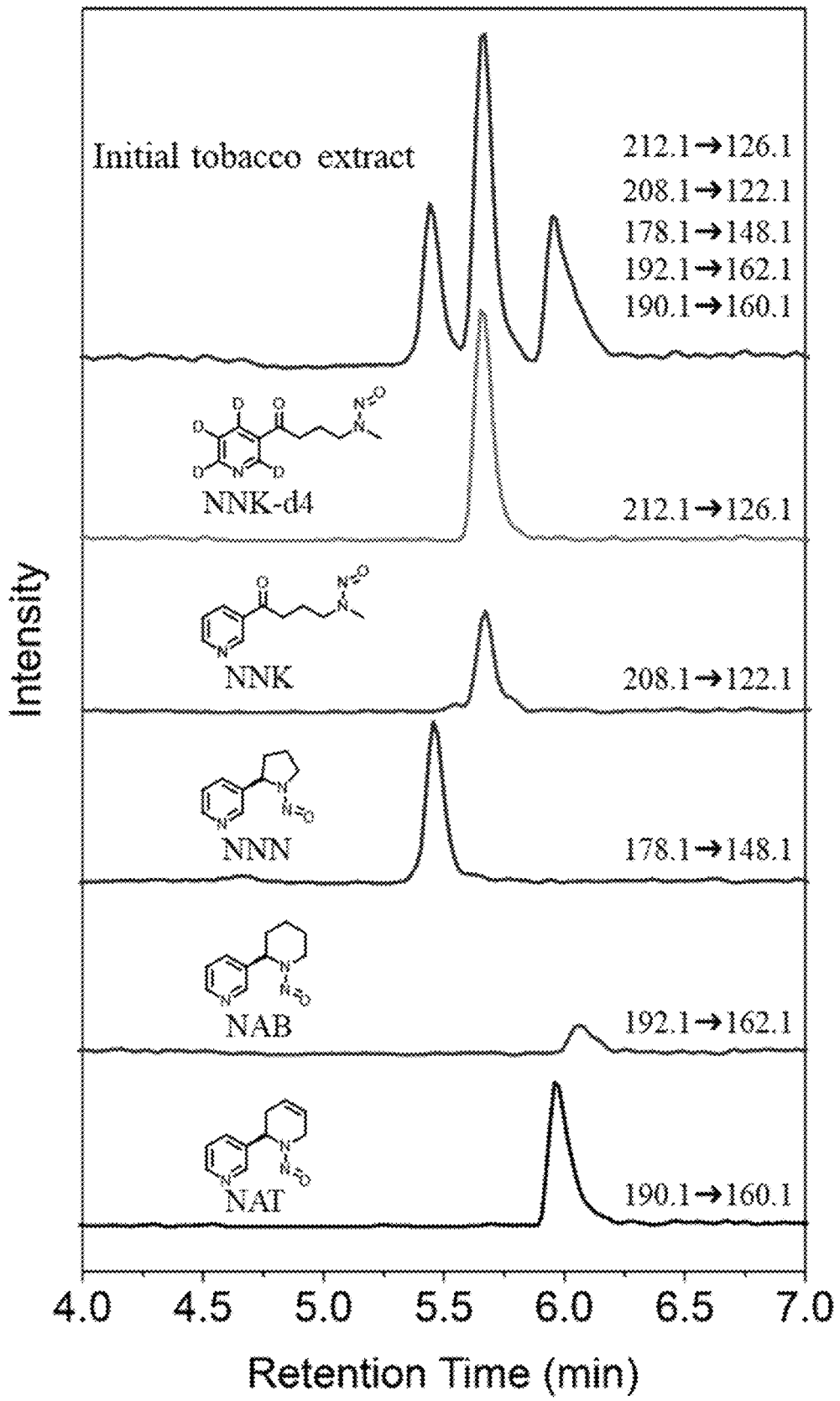
FIG. 28E shows, according to certain embodiments, LC-MS/MS spectra of tobacco extract.

Extraction using the pure polymer benefits from sonication, which provides a better dispersion of P2 in water. To circumvent the need for sonication, the hydrophilic magnetic particles were used to create dispersions of P2 in water that have high amounts of polymer-solvent interfaces. Magnetic particles and polymer-coated magnetic particles have been used in extraction of species and facilitate convenient collection of adsorbents from solution, Using hydrophilic magnetic particles also allows for the extraction to be performed under milder conditions with simple stirring. Specifically, the polymer was dissolved in tetrahydrofuran (THF) and mixed with magnetic silica particles before drying on a rotary evaporator to give magnetic particles (MPs) with a polymer shell. The spherical shape of the magnetic particles was maintained after coaling with P2 as revealed by scanning electron microscope (SEM) images (FIGS. 26A-26C). The transmission electron microscopy (TEM)-energy dispersive X-ray spectroscopy (EDS) of W atoms suggests that P2 distributes evenly on the MPs (FIG. 27). The NNK removal efficiency of P2 with stirring is 4.8%, which is much lower than that achieved with sonication (FIG. 9B). The low removal efficiency likely resulted from poor wetting of the polymer. Hydrophilic magnetic particles produced much better dispersions (FIG. 9B), and significantly improved efficiency to 66.2% under stirring. In FIG. 9B, the conditions were a ⅛ weight ratio of P2/MPs, stir for 30 minutes, and 0.3 mg of P2 (2.7 mg P2/MPs). The inset photos show the dispersion states of P2 under sonication and stir and of P2/MPs under stir.

Figure 10:
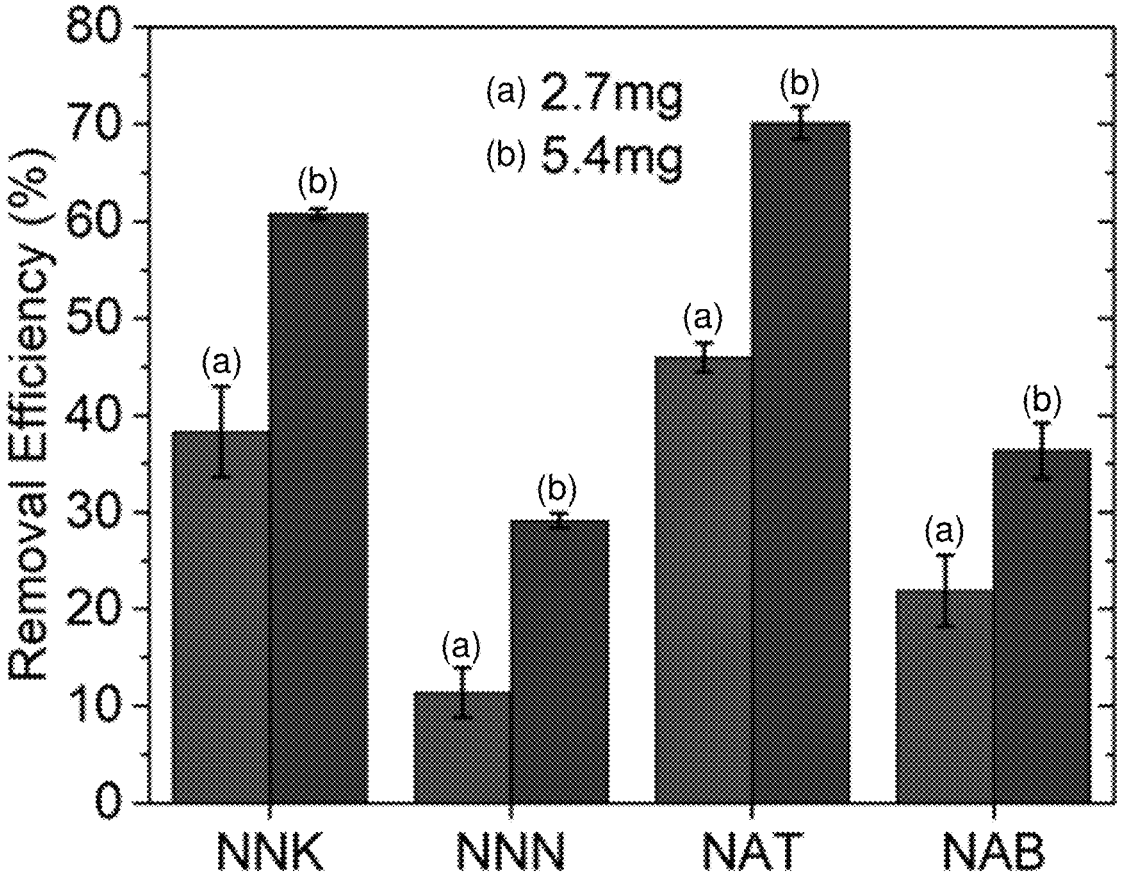
FIG. 10 shows, according to certain embodiments, removal efficiencies of P2/MPs towards TSNAs from 0.5 mL, tobacco extract with different material loading.

Tobacco extract is a complex matrix and may contain thousands of chemical species. To demonstrate the possible applications of P2 in real-world scenarios, water extraction solutions of a commercial tobacco were prepared. The MPs coated with P2 removed all four TSNAs shown in FIG. 5 from the tobacco extract. The removal efficiencies for NNK, NNN, NAB, and NAT in 0.5 mL tobacco extract were 38%, 11%, 22%, and 46%, respectively, when using a material loading of 2.7 mg (FIG. 10). Further increasing the material loading to 5.4 mg leads to higher TSNA removal efficiencies of 60%, 29%, 36%, and 70% for NNK, NNN, NAB and NAT, respectively. These results clearly demonstrate the promising future applications of P2 in extraction of TSNAs.

An efficient adsorbent for TSNAs was developed based on porous polymers bearing a tungsten-calix[4]arene imido complex as the nitrosamine receptor. It was found that the metallocalix[4]arene unit increased the polymer's selectivity towards TSNAs. The optimal ratio of the receptor to the porosity-inducing monomer was determined. The optimal polymer displays a high maximum adsorption capacity and fast adsorption kinetics toward NNK and NNN. It is noteworthy that the material exhibits a clear selectivity for TSNAs over nicotine and can be used repeatedly. The extraction of TSNAs from the extract of commercial tobacco product was demonstrated. The compositions described herein not only provide an efficient material for extraction of TSNAs, but also offer a new design strategy for efficient and selective adsorbents.

General procedure for synthesis of copolymers. Monomers 1 and 2 were dissolved in dichloromethane (DCM) and polymerized using the third-generation Grubbs catalyst (0.005 eq of overall monomers) at room temperature overnight in a glovebox. The reaction was then quenched with ethyl vinyl ether. The solution was passed through a 0.22 μm PTFE syringe filter and added dropwise into methanol under sonication. The resulting solid was collected and washed with methanol three times. The obtained polymers were dried at 70° C. under vacuum overnight.

General methods for extraction experiments. The polymer (0.3 mg) was suspended in 0.5 mL of NNK, NNN, NAT, NAB, NNAL, or nicotine solution in $D_2O$ (100 ppm) in NMR tubes. The mixtures were sonicated for 30 minutes. The NMR tube was thoroughly shaken during the initial 30 seconds. The removal efficiency was determined by $^1$H-NMR, using $CH_3SO_3Na$ as an internal standard for NNK, NNN, NAT, NAB, and NNAL and using UV vis absorption spectra for nicotine.

Extraction of TSNAs with Magnetic particles (MPs) coated with P2. The MPs were fixed with a magnet and washed with tetrahydrofuran (THF) to remove water. The obtained magnetic particles were then dried under vacuum. P2 was dissolved in tetrahydrofuran. MPs were added to the solution (usually at a ~10 mg scale, weight ratio of P2/MPs was 1:8). The mixture was dried using a rotary evaporator at room temperature. The MPs coated with P2 were further dried under vacuum. MPs coated with P2 (2.7 mg containing 0.3 mg polymer) were suspended in 0.5 mL of NNK solution in $D_2O$ (100 ppm). The mixtures were stirred for 30 minutes at room temperature.

After extraction, the solid was removed with the help of a magnet and filtration using a 0.22 μm Nylon syringe filter. The removal efficiency was determined by $^1$H-NMR using $CH_3SO_3Na$ as an internal standard.

CCDC 2176483 contains the supplementary crystallographic data for this Example. These data can be obtained free of charge from The Cambridge Crystallographic Data Centre via www.ccdc.cam.ac.uk/data_request/cif.

Instruments, chemicals and methods. All chemicals were used as they were received. Compounds 1, 2 (n ~3.4), and 3 were synthesized according to previous procedures. Deuterium oxide (D, 99.9%) was purchased from the Cambridge Isotope Laboratories, Inc. NNK was synthesized according to a known procedure. 4-(N-Methyl-N-nitrosamino)-1-(3-pyridyl-$d_4$)-1-butanone (NNK-$d_4$, 0.1 mg/mL in methanol) and rac-NNAL were purchased from Toronto Research Chemicals. rac-NNN and (R,S)—N-Nitrosoanabasine were purchased from Santa Cruz Biotechnology. (R,S)—N-Nitrosoanatabine was purchased from Cayman Chemical. Carboxen® 572 adsorbent (20-45 mesh) was purchased from Sigma Aldrich. Magnetic Silica Beads (2 μm, Hydroxyl-Terminated) were purchased from the ALPHA Nanotech Inc. NMR spectra were recorded on a Bruker Avance 400 MHz or a 500 MHz spectrometer. Thermogravimetric analysis was carried out on a TA Thermogravimetric Analyzer in nitrogen. X-ray photoelectron spectroscopy (XPS) was recorded on a Thermo Scientific K-Alpha+ XPS. Molecular weights of polymers were measured by an Agilent 1260 Infinity system with dual Agilent PL1110-6500 columns using a chloroform eluent. SEM characterization was conducted with a Merlin and Crossbeam 540 Zeiss. Samples were drop casted on a silicon wafer and dried in a vacuum oven overnight. TEM characterization and EDS elemental mapping was performed via a 120 kV FEI Tecnai Multipurpose Digital TEM (G2 Spirit TWIN). Samples were dropped casted on a carbon Type-B TEM grid (where a Formvar film is coated with a "heavier" layer of carbon) and dried in a vacuum oven overnight.

BET surface area was measured with a Micromeritics ASAP2020 ($N_2$ sorption at 77 K). The surface area was obtained by fitting the data points of $N_2$ adsorption isotherms with relative pressures ($p/p_0$) ranging from 0.05 to 0.2 using the BET theory.

LC-MS/NIS analysis was performed on a LC system with Agilent 1100 and 1200 series components and an Agilent, Poroshell 120, SB C18-reverse-phase column (length: 30 mm, internal diameter: 2.1 mm and particle size: 2.7 μm). The LC was coupled to an Agilent G6410A Triple Quadrupole Mass Spectrometer. The flow rate was 0.4 mL/min. The gradient elution conditions and parameters for mass analysis are shown in Tables 2 and 3.

TABLE 2

Gradient elution conditions.

| Time (min) | Water (10 mM $HCOONH_4$) (%) | $CH_3CN$(%) |
|---|---|---|
| 0 | 100 | 0 |
| 1 | 100 | 0 |
| 3 | 70 | 30 |
| 4 | 50 | 50 |
| 6 | 40 | 60 |
| 7 | 5 | 95 |
| 8 | 5 | 95 |
| 9 | 100 | 0 |
| 13 | 100 | 0 |

TABLE 3

Parameters for mass analysis.

| Analyte | Precursor Ion | Product Ion | Dwell (ms) | Collison energy (V) |
|---|---|---|---|---|
| NNK-$d_4$ | 212.1 | 126.1 | 200 | 5 |
| NNK | 208.1 | 122.1 | 200 | 5 |
| NNN | 178.1 | 148.1 | 200 | 5 |

TABLE 3-continued

Parameters for mass analysis.

| Analyte | Precursor Ion | Product Ion | Dwell (ms) | Collison energy (V) |
|---|---|---|---|---|
| NAB | 192.1 | 162.1 | 200 | 5 |
| NAT | 190.1 | 160.1 | 200 | 5 |

Synthesis of Copolymers.

P1: Monomer 1 ($M_n$=~1033 Da, 105.6 mg, 0.102 mmol) was reacted in the presence of the third-generation Grubbs catalyst (0.45 mg, 0.51 μmol). P1 was received as a white solid (89 mg, 84%).

P2: Monomer 1 ($M_n$=~1033 Da, 85.6 mg, 0.083 mmol) and monomer 2 (20.0 mg, 0.024 mmol) were reacted in the presence of the third-generation Grubbs catalyst (0.47 mg, 0.54 μmol). P2 was received as a light yellow solid (9.5 mg, 90%).

P3: Monomer 1 ($M_n$=~1033 Da, 52.8 mg, 0.051 mmol) and monomer 2 (52.8 mg, 0.065 mmol) were reacted in the presence of the third-generation Grubbs catalyst (0.51 mg, 0.58 μmol). P1 was received as a yellow solid (91 mg, 86%).

Figure 31:
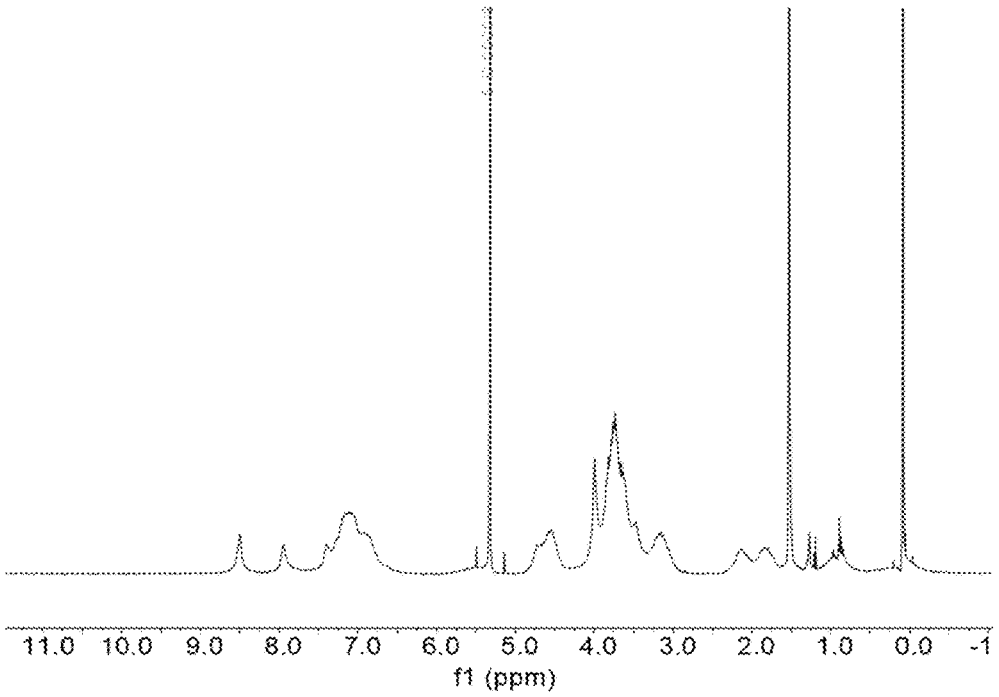
FIG. 31 shows, according to certain embodiments, an $^1$H-NMR spectrum of polymer P1 in $CD_2Cl_2$.
Figure 32:
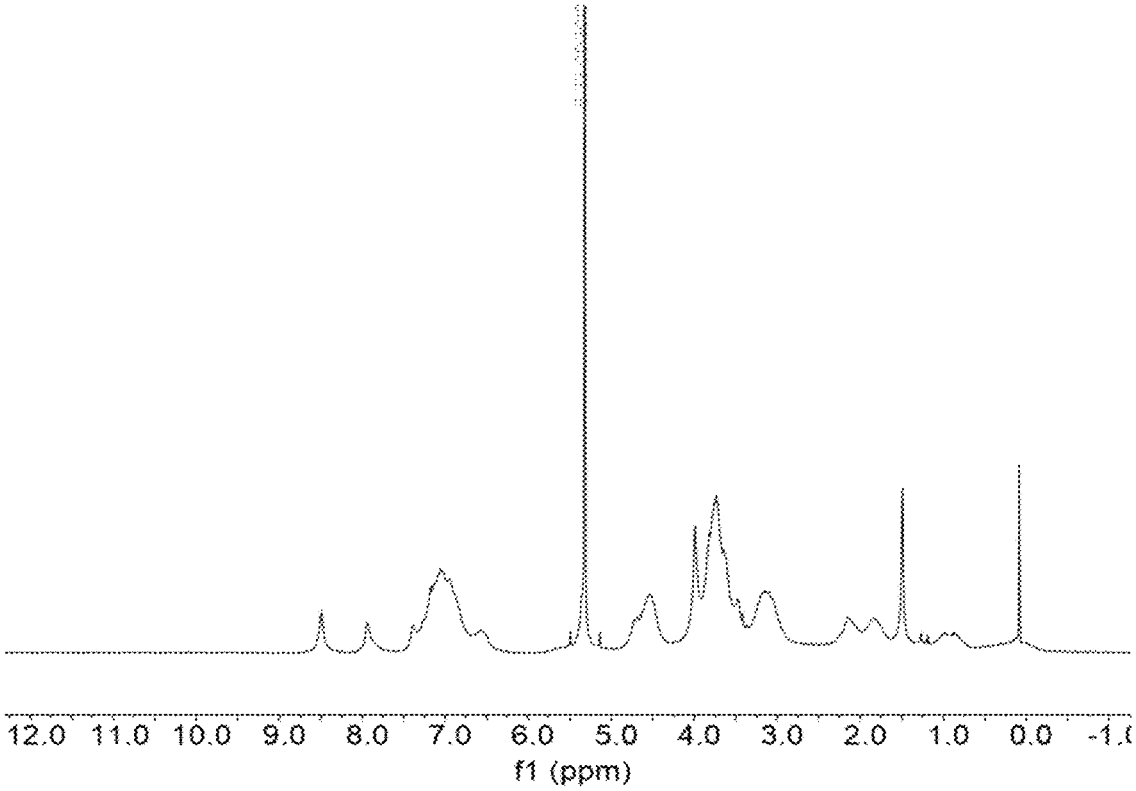
FIG. 32 shows, according to certain embodiments, an $^1$H-NMR spectrum of polymer P2 in $CD_2Cl_2$.
Figure 33:
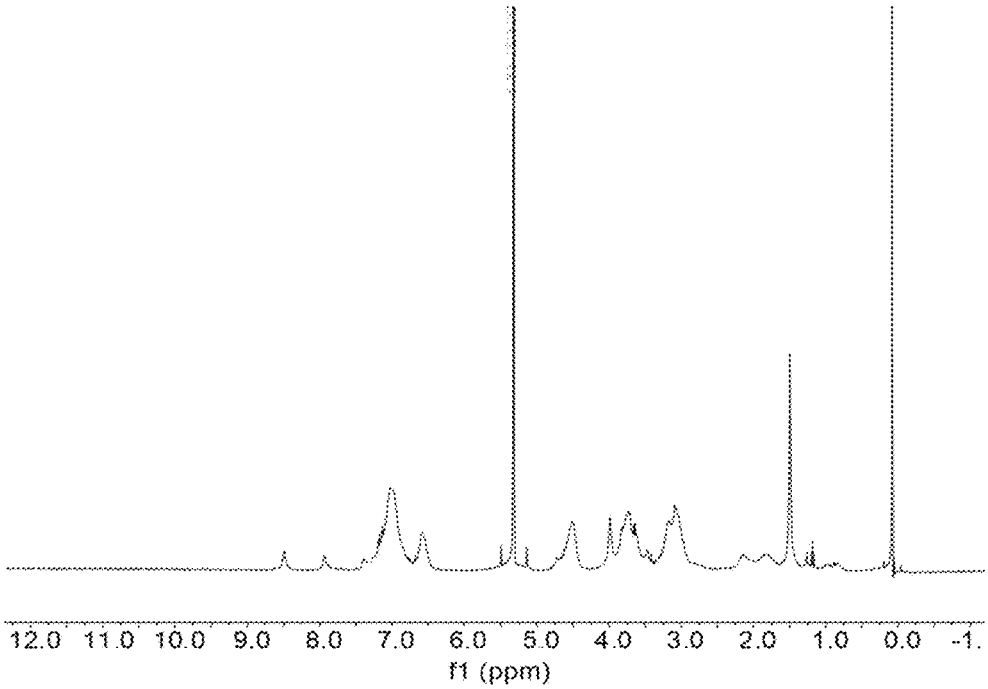
FIG. 33 shows, according to certain embodiments, an $^1$H-NMR spectrum of polymer P3 in $CD_2Cl_2$.

The $^1$H-NMR spectra of P1-P3 are shown in FIGS. 31-33.

TABLE 4

Chemical compositions and characterization data of P1-P3 (batch 1).

| | 1 (%)[a] | 2 (%)[a] | $M_n$ (kDa)/PDI |
|---|---|---|---|
| P1 | 100 | 0 | 84.3/1.18 |
| P2 | 81.1 | 18.9 | 80.3/1.18 |
| P3 | 50 | 50 | 50.5/1.31 |

[a]Weight percentage.

Kinetic and thermodynamic studies. For the kinetic study, P2 (0.36 mg) was suspended in 0.6 mL of nitrosamine solutions in $D_2O$ (100 ppm) in NMR tubes. The mixtures were sonicated for different time durations. The NMR tube was thoroughly shaken during the initial 30 seconds. After sonication, the mixture was immediately filtered through a 0.22 μm Nylon syringe filter. The removal efficiency was determined by $^1$H-NMR using $CH_3SO_3Na$ as an internal standard. The kinetic data were fitted with Ho and McKay's pseudo-second-order model as shown below:

$$\frac{t}{q_t} = \frac{t}{q_e} + \frac{1}{k_{obs}, q_e^2},$$

wherein $q_t$ (mg/g) and $q_e$ (mg/g) are the NNK uptakes at time t (min) and at equilibrium, respectively, and $k_{obs}$ (g/(mg·min)) is an apparent second-order rate constant.

For the thermodynamic study, P2 (0.5 mg) was suspended in 0.5 mL of nitrosamine solutions in $D_2O$ (200, 300, 400 and 500 ppm) in NMR tubes. The mixtures were sonicated for 70 minutes. The NMR tube was thoroughly shaken during the initial 30 seconds. The removal efficiency was determined by $^1$H-NMR. The thermodynamic data were fitted with the Langmuir model as shown below:

$$\frac{1}{q_e} = \frac{1}{q_{max,e}} + \frac{1}{q_{max,e}K_{eq}C},$$

wherein $q_{max,e}$ (mg/g) is the maximum adsorption capacity, $K_{eq}$ (L/mol) is the equilibrium constant, and C (mol/L) is the residual NNK concentration at equilibrium.

Recycling extraction of NNK: P2 (0.6 mg/mL) was suspended in 100 ppm NNK in HPLC water. The suspension was sonicated for 40 minutes. The mixture was thoroughly shaken during the initial 30 seconds. The removal efficiency was determined by UV-vis spectroscopy. The solid was collected by filtration and dried under vacuum. The solid was then suspended in acetonitrile. The suspension was sonicated for 5 minutes. The solid was collected by filtration and washed three times with acetonitrile. The obtained solid was dried under vacuum at 70° C. overnight and then was used for further extraction or characterization.

Removal of TSNAs from tobacco extract: The commercial fine cut tobacco was soaked in HPLC grade water (2 g/20 mL) and the mixture was stirred under dark for 24 hours at room temperature. The obtained solution was filtered with a 0.22 μm Nylon syringe filter. The initial concentrations of NNK, NNN, NAB and NAT were about 54, 160, 26 and 127 ppb, respectively. MPs coated with P2 were suspended in 0.5 ml of the tobacco extract. The mixture was stirred for 45 minutes at room temperature under dark. After extraction, the solid was removed with the help of a magnet and filtration using a 0.22 μm Nylon syringe filter. The removal efficiencies of TSNAs were determined by LC-MS/MS using NNK-$d_4$ as an internal standard. The LC-MS/MS spectra of the tobacco extract and the calibration curves for NNK, NNN, NAB, and NAT are shown in FIGS. 28A-28E.

TABLE 5

Crystal data and structure refinement for 3:NNK complex.

| | |
|---|---|
| CCDC | 2176483 |
| Empirical formula | $C_{47}H_{44}N_4O_6W$ |
| Formula weight | 944.71 |
| Temperature/K | 100(2) |
| Crystal system | monoclinic |
| Space group | $P2_1/c$ |
| a/Å | 17.6911(7) |
| b/Å | 15.6835(5) |
| c/Å | 16.1348(6) |
| α/° | 90 |
| β/° | 112.5784(9) |
| γ/° | 90 |
| Volume/Å$^3$ | 4133.6(3) |
| Z | 4 |
| $\rho_{calc}$g/cm$^3$ | 1.518 |
| μ/mm$^{-1}$ | 2.849 |
| F(000) | 1904.0 |
| Crystal size/mm$^3$ | 0.185 × 0.080 × 0.050 |
| Radiation | MoKα (λ = 0.71073) |
| 2Θ range for data collection/° | 2.494 to 64.044 |
| Index ranges | −26 ≤ h ≤ 26, −22 ≤ k ≤ 23, −24 ≤ l ≤ 24 |
| Reflections collected | 171494 |
| Independent reflections | 14354 [$R_{int}$ = 0.0471, $R_{sigma}$ = 0.0228] |
| Data/restraints/parameters | 14354/0/527 |
| Goodness-of-fit on $F^2$ | 1.033 |
| Final R indexes [I >= 2σ (I)] | $R_1$ = 0.0221, $wR_2$ = 0.0473 |
| Final R indexes [all data] | $R_1$ = 0.0277, $wR_2$ = 0.0489 |
| Largest diff. peak/hole/e Å$^{-3}$ | 0.80/−0.72 |

Theoretical Calculations: Geometries were optimized using the ωB97X-D functional with the 6-311G(d) basic set for C, H, O and N and the LanL2DZ basic set for W in the gas phase on Gaussian 09, Revision D.01. Harmonic vibrational frequency calculations were performed for the stationary points to confirm them as local minima. The singlepoint energies were further calculated using the ωB97X-D functional with the 6-311G(d,p) basic set for C, H, O and N and the LanL2DZ basic set liar W. Polarization functions were added for W (ξ(f)=0.823) in all calculations. The energies of complexes were corrected for basis set superposition error (BSSE) by the counterpoise procedure. Binding energies were reported as positive in the maintext to provide a better comparison.

What is claimed is:

1. A composition, comprising:

a polymer comprising a first component and a second component, wherein the first component and the second component are different, and wherein the first component comprises a selector configured to interact with an organic molecule, wherein the polymer comprises:

the first component in an amount of at least 15 weight percent (wt. %) versus a total weight of the polymer; and the second component in an amount of at least 50 wt. % versus the total weight of the polymer, and wherein the first component comprises a calixarene moiety.

2. The composition of claim 1, wherein the first component comprises a monomer.

3. The composition of claim 1, wherein the second component comprises a monomer.

4. The composition of claim 1, wherein the polymer comprises the first component in an amount of at least 15 wt. % and less than or equal to 50 wt. % versus the total weight of the polymer.

5. The composition of claim 1, wherein the polymer comprises the second component in an amount of at least 50 wt. % and less than or equal to 85 wt. % versus the total weight of the polymer.

6. The composition of claim 1, wherein the first component comprises a metallocalix[4] arene moiety.

7. The composition of claim 1, wherein the first component comprises a calix[4] arene tungsten-imido complex.

8. The composition of claim 1, wherein the first component and/or the second component comprises a structure that comprises cavities configured to host guest molecules.

9. A composition, comprising:

a polymer comprising a first component and a second component, wherein the first component and the second component are different, and wherein the first component comprises a selector configured to interact with an organic molecule, wherein the polymer comprises:

the first component in an amount of at least 15 wt. % versus a total weight of the polymer; and the second component in an amount of at least 50 wt. % versus the total weight of the polymer, and wherein the second component comprises an oligomer.

10. A composition, comprising:

a polymer comprising a first component and a second component, wherein the first component and the second component are different, and wherein the first component comprises a selector configured to interact with an organic molecule, wherein the polymer comprises:

the first component in an amount of at least 15 wt. % versus a total weight of the polymer; and the second component in an amount of at least 50 wt. % versus the total weight of the polymer, wherein the first component and/or the second component comprises a structure that comprises cavities configured to host guest molecules, and wherein a free volume created by the cavities provides a solid material with a Brunauer, Emmett, and Teller (BET) surface area greater than or equal to 100 $m^2/g$.

11. The composition of claim 10, wherein the solid material is solvent free.

12. The composition of claim 10, wherein the BET surface area of the polymer is greater than or equal to 100 $m^2/g$.

13. The composition of claim 12, wherein the BET surface area of the polymer is greater than or equal to 100 $m^2/g$ and less than or equal to 350 $m^2/g$.

14. A composition, comprising:

a polymer comprising a first component and a second component, wherein the first component and the second component are different, and wherein the first component comprises a selector configured to interact with an organic molecule, wherein the polymer comprises:

the first component in an amount of at least 15 wt. % versus a total weight of the polymer; and the second component in an amount of at least 50 wt. % versus the total weight of the polymer, and wherein a molecular weight of the polymer is greater than or equal to 60 kDa.

15. The composition of claim 14, wherein the molecular weight of the polymer is greater than or equal to 60 kDa and less than or equal to 80 kDa.

16. A composition, comprising:

a polymer comprising a first component and a second component, wherein the first component and the second component are different, and wherein the first component comprises a selector configured to interact with an organic molecule, wherein the polymer comprises:

the first component in an amount of at least 15 wt. % versus a total weight of the polymer; and the second component in an amount of at least 50 wt. % versus the total weight of the polymer, and wherein the polymer has a weight loss less than 5% as a result of thermal decomposition at 250° C.

17. A composition, comprising:

a polymer comprising a first component and a second component, wherein the first component and the second component are different, and wherein the first component comprises a selector configured to interact with an organic molecule, wherein the polymer comprises:

the first component in an amount of at least 15 wt. % versus a total weight of the polymer; and the second component in an amount of at least 50 wt. % versus the total weight of the polymer, and wherein an adsorption capacity of the composition towards the organic molecule is at least 200 mg of the organic molecule per gram of the polymer.

18. The composition of claim 17, wherein the adsorption capacity of the composition towards the organic molecule is at least 200 mg of the organic molecule per gram of the polymer and less than or equal to 300 mg of the organic molecule per gram of the polymer.

19. An article, comprising:

a substrate, and a composition disposed on the substrate, wherein the composition comprises a polymer comprising a first component and a second component, wherein the first component and the second component are different, and wherein the first component comprises a selector configured to interact with an organic molecule, wherein an adsorption capacity of the composition towards the organic molecule is at least 200 mg of the organic molecule per gram of the polymer.

20. The article of claim 19, wherein the substrate comprises a particle.

21. The article of claim 20, wherein the particle comprises a microparticle and/or nanoparticle.

22. The article of claim 20, wherein the particle comprises a magnetic material.

23. The article of claim 20, wherein the particle comprises silica.

24. The article of claim 20, wherein the composition is coated on the particle.

25. The article of claim 20, wherein the particle is packed in a tube and/or column.

26. The article of claim 19, wherein the substrate comprises a film and/or a filter.

27. The article of claim 26, wherein the composition is coated on the film and/or the filter.

28. The article of claim 19, wherein the adsorption capacity of the composition towards the organic molecule is at least 200 mg of the organic molecule per gram of the polymer and less than or equal to 300 mg of the organic molecule per gram of the polymer.

* * * * *